US008440031B2

(12) United States Patent
Syed et al.

(10) Patent No.: US 8,440,031 B2
(45) Date of Patent: May 14, 2013

(54) NICKEL-TITANIUM-RARE EARTH ALLOY AND METHOD OF PROCESSING THE ALLOY

(75) Inventors: Tofail Ansar Md. Syed, Limerick (IE); James M. Carlson, Bloomington, IN (US); Abbasi A. Gandhi, Ahmedabad (IN); Peter Tiernan, Limerick (IE); Lisa O'Donoghue, Limerick (IE); James Butler, Aherlow, Co. Tipperary (IE)

(73) Assignees: Cook Medical Technologies LLC, Bloomington, IN (US); University of Limerick, Limerick (IE)

( * ) Notice: Subject to any disclaimer, the term of this patent is extended or adjusted under 35 U.S.C. 154(b) by 299 days.

(21) Appl. No.: 12/946,291

(22) Filed: Nov. 15, 2010

(65) Prior Publication Data

US 2011/0114230 A1 May 19, 2011

(30) Foreign Application Priority Data

Nov. 17, 2009 (GB) ..... 0920123.7

(51) Int. Cl.
*C22F 1/18* (2006.01)
*C22C 30/00* (2006.01)

(52) U.S. Cl.
USPC ..... 148/402; 420/580; 420/417; 420/441; 148/563

(58) Field of Classification Search .... 148/563; 420/580
See application file for complete search history.

(56) References Cited

U.S. PATENT DOCUMENTS

| | | | |
|---|---|---|---|
| 5,964,968 | A | 10/1999 | Kaneko |
| 2008/0053577 | A1 | 3/2008 | Syed et al. |

FOREIGN PATENT DOCUMENTS

| | | | |
|---|---|---|---|
| CN | 101314826 | | 12/2008 |
| JP | 58157935 | | 9/1983 |
| WO | 2006081011 | A2 | 8/2006 |
| WO | 2009070784 | A1 | 6/2009 |

OTHER PUBLICATIONS

PCT/US2010/056687 International Search Report dated Jan. 19, 2011.
PCT/US2010/056687 Written Opinion dated Jan. 19, 2011.

*Primary Examiner* — Jessee R. Roe
(74) *Attorney, Agent, or Firm* — Richard J. Godlewski

(57) ABSTRACT

A nickel-titanium-rare earth (Ni—Ti-RE) alloy comprises nickel at a concentration of from about 35 at. % to about 65 at. %, a rare earth element at a concentration of from about 1.5 at. % to about 15 at. %, boron at a concentration of up to about 0.1 at. %, with the balance of the alloy being titanium. In addition to enhanced radiopacity compared to binary Ni—Ti alloys and improved workability, the Ni—Ti-RE alloy preferably exhibits superelastic behavior. A method of processing a Ni—Ti-RE alloy includes providing a nickel-titanium-rare earth alloy comprising nickel at a concentration of from about 35 at. % to about 65 at. %, a rare earth element at a concentration of from about 1.5 at. % to about 15 at. %, the balance being titanium; heating the alloy in a homogenization temperature range below a critical temperature; and forming spheroids of a rare earth-rich second phase in the alloy while in the homogenization temperature range.

15 Claims, 33 Drawing Sheets

NICKEL-TITANIUM-RARE EARTH ALLOY AND METHOD OF PROCESSING THE ALLOY

TECHNICAL FIELD

The present disclosure relates generally to nickel-titanium alloys and more particularly to nickel-titanium-rare earth alloys with enhanced workability.

BACKGROUND

Nickel-titanium alloys are commonly used for the manufacture of intraluminal biomedical devices, such as self-expandable stents, stent grafts, embolic protection filters, and stone extraction baskets. Such devices may exploit the superelastic or shape memory behavior of equiatomic or near-equiatomic nickel-titanium alloys, which are commonly referred to as Nitinol.

Nickel-titanium medical devices may be made viewable from outside the body using non invasive imaging techniques, such as x-ray fluoroscopy, by the use of radiopaque markers or coatings on the devices. For example, gold markers attached to one or both ends of a stent may guide the positioning of the device and delineate its length during an x-ray procedure. Alternatively, a medical device may be plated, clad or otherwise coated with gold or another heavy metal to create a radiopaque surface or outer layer. In another approach, a heavy metal cylinder may be included within the lumen of a stent to produce a radiopaque core.

BRIEF SUMMARY

The present invention relates to nickel-titanium-rare earth (Ni—Ti-RE) alloys that exhibit enhanced radiopacity as compared to binary Ni—Ti alloys and may show improved workability over previous Ni—Ti-RE alloys. Boron (B) may be included as an alloying element to enhance the ductility of the alloy. In addition to radiopacity and workability, the Ni—Ti-RE alloy also preferably exhibits superelastic or shape memory behavior. A method of processing such an alloy also is disclosed.

An exemplary Ni—Ti-RE alloy may include nickel at a concentration of from about 35 at. % to about 65 at. %, a rare earth element at a concentration of from about 1.5 at. % to about 15 at. %, boron at a concentration of up to about 0.1 at. %, with the balance being titanium.

A method of processing an exemplary Ni—Ti-RE alloy includes providing a nickel-titanium-rare earth alloy comprising nickel at a concentration of from about 35 at. % to about 65 at. %, a rare earth element at a concentration of from about 1.5 at. % to about 15 at. %, the balance being titanium; heating the nickel-titanium-rare earth alloy in a homogenization temperature range below a critical temperature; and forming spheroids or other shaped particles of a rare earth-rich second phase in the alloy while in the homogenization temperature range.

BRIEF DESCRIPTION OF THE DRAWINGS

Preferred features of the present invention will now be described, by way of example, with reference to the accompanying drawings, in which.

DETAILED DESCRIPTION

Definitions

Figure 1:
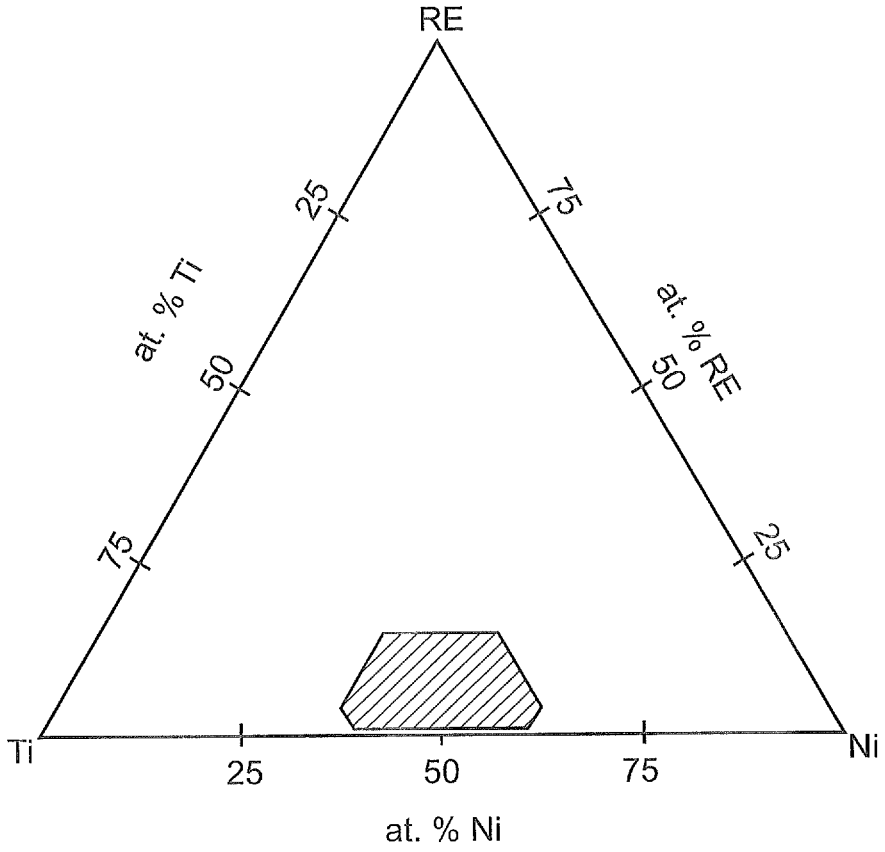
FIG. 1 is a ternary alloy concentration diagram showing a composition range of a nickel-titanium alloy according to one embodiment.

As used in the following specification and the appended claims, the following terms will have the meanings ascribed below:

Martensite start temperature ($M_s$) is the temperature at which a phase transformation to martensite begins upon cooling for a shape memory material exhibiting a martensitic phase transformation.

Martensite finish temperature ($M_f$) is the temperature at which the phase transformation to martensite concludes upon cooling.

Austenite start temperature ($A_s$) is the temperature at which a phase transformation to austenite begins upon heating for a shape memory material exhibiting an austenitic phase transformation.

Austenite finish temperature ($A_f$) is the temperature at which the phase transformation to austenite concludes upon heating.

R'-phase start temperature ($R'_s$) is the temperature at which a phase transformation to R-phase begins upon heating for shape memory material exhibiting an R-phase transformation.

R'-phase finish temperature ($R'_f$) is the temperature at which the phase transformation to R-phase concludes upon heating.

R-phase start temperature ($R_s$) is the temperature at which a phase transformation to R-phase begins upon cooling for a shape memory material exhibiting an R-phase transformation.

R-phase finish temperature ($R_f$) is the temperature at which the phase transformation to R-phase concludes upon cooling.

Radiopacity is a measure of the capacity of a material or object to absorb incident electromagnetic radiation, such as x-ray radiation. A radiopaque material preferentially absorbs incident x-rays and tends to show high radiation contrast and good visibility in x-ray images. A material that is not radiopaque tends to transmit incident x-rays and may not be readily visible in x-ray images. A linear absorption coefficient ($\mu$) of a material may be a good indicator of its capacity for absorbing x-ray radiation, and thus its radiopacity. For the purposes of this disclosure, a cumulative linear absorption coefficient, which is defined and described in detail below, may be taken as representative of the radiopacity of a material.

The term "workability" refers to the ease with which an alloy may be formed to have a different shape and/or dimensions, where the forming is carried out by a method such as rolling, forging, extrusion, etc.

The term "spheroidization" refers to the formation of a plurality of discrete second phase particles ("spheroids") in an alloy. The spheroids need not be spherical in shape, and as used here, the term spheroids includes particles of any shape.

The term "rare-earth rich second phase" refers to a second phase constituent of a nickel-titanium-rare earth alloy, where the second phase constituent includes the rare earth element.

The term "near-equiatomic binary nickel-titanium alloy" refers to a two-component alloy including from 45 at. % to 55 at. % nickel and the balance titanium.

Described herein is a nickel-titanium alloy comprising nickel, titanium, and at least one rare earth element. According to one embodiment, the nickel-titanium alloy comprises at least one additional alloying element that may provide desired characteristics of the alloy depending on the desired use. The nickel-titanium alloy preferably has improved radiopacity compared to previous nickel-titanium alloys. Accordingly, a medical device comprising the nickel-titanium alloy may have better visibility during non-invasive imaging procedures such as x-ray fluoroscopy. The nickel-titanium alloy preferably has superelastic or shape memory properties that are advantageous for medical devices, as will be discussed below.

Preferably, the one or more rare earth elements of the nickel-titanium alloy are chosen from the lanthanide series and/or the actinide series of the periodic table, which include La, Ce, Pr, Nd, Pm, Sm, Eu, Gd, Tb, Dy, Ho, Er, Tm, Yb, Lu, Ac, Th, Pa, and U. Yttrium (Y) and scandium (Sc) are sometimes referred to as rare earth elements although they are not elements of the lanthanide or actinide series. More preferably, the rare earth (RE) element is selected from the group consisting of La, Pr, Nd, Pm, Sm, Eu, Gd, Tb, Dy, Ho, Er, Tm, Yb, and Lu.

According to one exemplary preferred embodiment, the rare earth element occupies a ternary position in terms of concentration in the alloy. In other words, the amount of the rare earth element is preferably less than the respective amounts of nickel and titanium, but greater than the amount of any additional alloying elements that may be present in the alloy. An exemplary composition range for the alloy is shown schematically in FIG. 1.

The nickel-titanium alloy may include at least about 0.1% at least one rare earth element, according to one embodiment. Preferably, the nickel-titanium alloy comprises at least about 1.0 at. % at least one rare earth element. More preferably, the nickel-titanium alloy comprises at least about 2.5 at. % at least one rare earth element. It may be desirable that the nickel-titanium alloy comprises at least about 5 at. % at least one rare earth element.

It also is preferred that the nickel-titanium alloy comprises no more than about 15 at. % at least one rare earth element. More preferably, the nickel-titanium alloy comprises no more than about 12.5 at. % at least one rare earth element. Even more preferably, the nickel-titanium alloy comprises no more than about 10 at. % at least one rare earth element. Yet even more preferably, the nickel-titanium alloy comprises no more than about 7.5 at. % at least one rare earth element. Most preferably, the nickel-titanium alloy comprises no more than about 5.0 at. % at least one rare earth element.

By way of example, the nickel-titanium alloy comprises from about 0.1 at. % to about 15 at. % at least one rare earth element, according to a preferred embodiment. Preferably, the nickel-titanium alloy comprises from about 1.0 at. % to about 12.5 at. %. More preferably, the nickel-titanium alloy comprises from about 1.0 at. % to about 10.0 at. % at least one rare earth element. Even more preferably, the nickel-titanium alloy comprises from about 1.0 at. % to about 7.5 at. %, or from about 2.5 at. % to about 7.5 at. % at least one rare earth element. Most preferably, the nickel-titanium alloy comprises from about 2.5 at. % to about 5.0 at. % at least one rare earth element. For example, the nickel-titanium alloy may comprise 3.0 at. %, 3.25 at. %, 3.5 at. %, 3.75 at. % or 4 at. % at least one rare earth element.

According to a preferred embodiment, the nickel-titanium alloy comprises at least about 34 at. % nickel. More preferably, the nickel-titanium alloy comprises at least about 36.5 at. % nickel. Even more preferably, the nickel-titanium alloy comprises at least about 39 at. % nickel. Still more preferably, the nickel-titanium alloy comprises at least about 44 at. % nickel.

It also is preferred that the nickel-titanium alloy comprises no more than about 60 at. % nickel. More preferably, the nickel-titanium alloy comprises no more than about 55 at. % nickel. The nickel-titanium alloy may comprise 50 at. % nickel.

According to a preferred embodiment, the nickel-titanium alloy comprises at least about 34 at. % titanium. More preferably, the nickel-titanium alloy comprises at least about 36.5 at. % titanium. Even more preferably, the nickel-titanium alloy comprises at least about 39 at. % titanium. Still more preferably, the nickel-titanium alloy comprises at least about 44 at. % titanium.

It also is preferred that the nickel-titanium alloy comprises no more than about 60 at. % titanium. More preferably, the nickel-titanium alloy comprises no more than about 55 at. % titanium. Even more preferably, the nickel-titanium alloy comprises no more than about 50 at. % titanium.

According to an exemplary embodiment, the nickel-titanium alloy comprises from about 36.5 at. % to about 55 at. % nickel, from about 36.5 at. % to about 55 at. % titanium, and from about 2.5 at. % to about 12.5 at. % at least one rare earth element. According to another exemplary embodiment, the nickel-titanium alloy comprises from about 39 at. % to about 55 at. % nickel, from about 39 at. % to about 55 at. % titanium, and from about 5 at. % to about 10 at. % at least one rare earth element.

The nickel-titanium alloy also may contain one or more additional alloying elements, such as transition metals or other metals. For example, one or more of Al, Cr, Mn, Fe, Co, Cu, Zn, Ga, Ge, Zr, Nb, Mo, Tc, Ru, Rh, Pd, Ag, Cd, In, Sn, Sb, Hf, Ta, W, Re, Os, Ir, Pt, Au, Hg, Tl, Pb, Bi, Po, V, and Mischmetal may be included as the additional alloying element (AAE). It is preferable that the nickel-titanium alloy comprises no more than about 14.9 at. % AAE. More preferably, the nickel-titanium alloy comprises no more than about 9.9 at. % AAE. Even more preferably, the nickel-titanium alloy comprises no more than about 7.4 at. % AAE. Still more preferably, the nickel-titanium alloy comprises no more than about 4.9 at. % AAE. Most preferably, the nickel-titanium alloy comprises no more than about 1.9 at. % AAE. According to one preferred embodiment, the nickel-titanium alloy includes at least about 0.1 at. % AAE. Preferably, the additional alloying element has a lower concentration in the nickel-titanium alloy than the rare earth element when the one or more additional alloying elements are selected from the group consisting of Ir, Pt, Au, Re, W, Pd, Rh, Ta, Ag, Ru, Hf, Os, Zr, Nb, and Mo.

A equiatomic or near-equiatomic binary nickel-titanium alloys may exhibit superelastic or shape memory behavior. Such alloys are commonly referred to as Nitinol or Nitinol alloys. Slightly nickel-rich Nitinol alloys including, for example, 51 at. % Ni and 49 at. % Ti, are known to be useful for medical devices which are austenitic at body temperature. Specifically, alloys including 50.6-50.8 at. % Ni and 49.2-49.4 at. % Ti are considered to be medical grade Nitinol alloys.

Accordingly, the nickel-titanium alloy of the present disclosure may include about 51 at. % Ni, about 34 at. % Ti, and about 15 at. % RE, according to one preferred embodiment. In another example in which one or more additional alloying elements (AAE) are present in the alloy, the nickel-titanium alloy preferably includes about 51 at. % Ni, about 34 at. % Ti, about (15−x) at. % RE, and about x at. % AAE, where $0 \leqq x \leqq 14.9$. Preferably, the rare earth element is in the ternary position in the alloy and $0 \leqq x \leqq 7.4$. According to these examples, the rare earth element substitutes for titanium. Alternatively, the rare earth element may substitute for nickel, or may substitute for both nickel and titanium.

According to another preferred embodiment, the nickel-titanium alloy of the present disclosure comprises about 51 at. % Ni, about 36.5 at. % Ti, and about 12.5 at. % RE. In another example in which one or more additional alloying elements (AAE) are present in the alloy, the nickel-titanium alloy preferably includes about 51 at. % Ni, about 36.5 at. % Ti, about (12.5−x) at. % RE, and about x at. % AAE, where $0 \leqq x \leqq 12.4$. Preferably, the rare earth element is in the ternary position in the alloy and $0 \leqq x \leqq 6.2$. According to these examples, the rare earth element substitutes for titanium. Alternatively, the rare earth element may substitute for nickel, or may substitute for both nickel and titanium.

According to another preferred embodiment, the nickel-titanium alloy of the present disclosure comprises about 51 at. % Ni, about 39 at. % Ti, and about 10 at. % RE. In another example in which one or more additional alloying elements (AAE) are present in the alloy, the nickel-titanium alloy preferably includes about 51 at. % Ni, about 39 at. % Ti, about (10−x) at. % RE, and about x at. % AAE, where $0 \leqq x \leqq 9.9$. Preferably, the rare earth element is in the ternary position in the alloy and $0 \leqq x \leqq 4.9$. According to these examples, the rare earth element substitutes for titanium. Alternatively, the rare earth element may substitute for nickel, or may substitute for both nickel and titanium.

According to another preferred embodiment, the nickel-titanium alloy comprises about 51 at. % Ni, about 41.5 at. % Ti, and about 7.5 at. % RE. In another example in which one or more additional alloying elements are present in the alloy, the nickel-titanium alloy preferably includes about 51 at. % Ni, about 41.5 at. % Ti, about (7.5−x) at. % RE, and about x at. % AAE, where $0 \leqq x \leqq 7.4$. Preferably, the rare earth element is in the ternary position in the alloy and $0 \leqq x \leqq 3.7$. According to these examples, the rare earth element substitutes for titanium. Alternatively, the rare earth element may substitute for nickel, or may substitute for both nickel and titanium.

According to another preferred embodiment, the nickel-titanium alloy comprises about 51 at. % Ni, about 44 at. % Ti, and about 5.0 at. % RE. In another example in which one or more additional alloying elements are present in the alloy, the nickel-titanium alloy includes about 51 at. % Ni, about 44 at. % Ti, about (5.0−x) at. % RE, and about x at. % AAE, where $0 \leqq x \leqq 4.9$. Preferably, the rare earth element is in the ternary position in the alloy and $0 \leqq x \leqq 2.4$. According to these examples, the rare earth element substitutes for titanium. Alternatively, the rare earth element may substitute for nickel, or may substitute for both nickel and titanium.

According to another preferred embodiment, the nickel-titanium alloy comprises about 51 at. % Ni, about 46.5 at. % Ti, and about 2.5 at. % RE. In another example in which one or more additional alloying elements are present in the alloy, the nickel-titanium alloy includes about 51 at. % Ni, about 46.5 at. % Ti, about (2.5−x) at. % RE, and about x at. % AAE, where $0 \leqq x \leqq 2.4$. Preferably, the rare earth element is in the ternary position in the alloy and $0 \leqq x \leqq 1.2$. According to these examples, the rare earth element substitutes for titanium. Alternatively, the rare earth element may substitute for nickel, or may substitute for both nickel and titanium.

In an alternative embodiment, the nickel-titanium alloy may include about 50 at. % Ni, (50−y−x) at. % Ti, y at. % RE, and x at. % AAE, where x is no more than about 15 and y is no more than about 14.9, as described previously. In another example, the nickel-titanium alloy may include about 52 at. % Ni, (48−y−x) at. % Ti, y at. % RE, and x at. % AAE, with x and y having the bounds described above. Alternatively, the alloy may include about 53 at. % Ni, (47−y−x) at. % Ti, y at. % RE, and x at. % AAE. It also is envisioned that the alloy may include about 54 at. % Ni, (46−y−x) at. % Ti, y at. % RE, and x at. % AAE, or 55 at. % Ni, (45−y−x) at. % Ti, y at. % RE, and x at. % AAE. In another example, the alloy may include about or 56 at. % Ni, (44−y−x) at. % Ti, y at. % RE, and x at. % AAE. According to one preferred embodiment, y is equal to (4−x), and x has the exemplary values shown in Table 1 below.

TABLE 1

| Preferred Alloy Compositions (at. %) | | | | |
|---|---|---|---|---|
| $Ni_{50}Ti_{46}RE_4$ | $Ni_{50}Ti_{46}RE_{3.75}AAE_{0.25}$ | $Ni_{50}Ti_{46}RE_{3.5}AAE_{0.5}$ | $Ni_{50}Ti_{46}RE_{3.25}AAE_{0.75}$ | $Ni_{50}Ti_{46}RE_3AAE_1$ |
| $Ni_{51}Ti_{45}RE_4$ | $Ni_{51}Ti_{45}RE_{3.75}AAE_{0.25}$ | $Ni_{51}Ti_{45}RE_{3.5}AAE_{0.5}$ | $Ni_{51}Ti_{45}RE_{3.25}AAE_{0.75}$ | $Ni_{51}Ti_{45}RE_3AAE_1$ |
| $Ni_{52}Ti_{44}RE_4$ | $Ni_{52}Ti_{44}RE_{3.75}AAE_{0.25}$ | $Ni_{52}Ti_{44}RE_{3.5}AAE_{0.5}$ | $Ni_{52}Ti_{44}RE_{3.25}AAE_{0.75}$ | $Ni_{52}Ti_{44}RE_3AAE_1$ |
| $Ni_{53}Ti_{43}RE_4$ | $Ni_{53}Ti_{43}RE_{3.75}AAE_{0.25}$ | $Ni_{53}Ti_{43}RE_{3.5}AAE_{0.5}$ | $Ni_{53}Ti_{43}RE_{3.25}AAE_{0.75}$ | $Ni_{53}Ti_{43}RE_3AAE_1$ |
| $Ni_{54}Ti_{42}RE_4$ | $Ni_{54}Ti_{42}RE_{3.75}AAE_{0.25}$ | $Ni_{54}Ti_{42}RE_{3.5}AAE_{0.5}$ | $Ni_{54}Ti_{42}RE_{3.25}AAE_{0.75}$ | $Ni_{54}Ti_{42}RE_3AAE_1$ |
| $Ni_{55}Ti_{41}RE_4$ | $Ni_{55}Ti_{41}RE_{3.75}AAE_{0.25}$ | $Ni_{55}Ti_{41}RE_{3.5}AAE_{0.5}$ | $Ni_{55}Ti_{41}RE_{3.25}AAE_{0.75}$ | $Ni_{55}Ti_{41}RE_3AAE_1$ |
| $Ni_{56}Ti_{40}RE_4$ | $Ni_{56}Ti_{40}RE_{3.75}AAE_{0.25}$ | $Ni_{56}Ti_{40}RE_{3.5}AAE_{0.5}$ | $Ni_{56}Ti_{40}RE_{3.25}AAE_{0.75}$ | $Ni_{56}Ti_{40}RE_3AAE_1$ |

Erbium (Er) is a preferred rare earth element. It is believed that Er is less likely to cause cracking or brittleness of the nickel-titanium alloy at increasing rare earth concentrations than other rare earth elements. Chromium (Cr) is a preferred additional alloying element (AAE). It is believed that increasing concentrations of chromium are effective for suppressing the austenitic phase transformation temperatures of the alloy to near body temperature, as further discussed below. Nickel-rich alloys also are known to have suppressed transformation temperatures. Accordingly, compiled in Table 2 below are several preferred Ni—Ti alloy compositions that include Er and Cr, along with increasing concentrations of nickel.

TABLE 2

| Exemplary Alloy Compositions including Er and Cr (at. %) | | | | |
|---|---|---|---|---|
| $Ni_{50}Ti_{46}Er_4$ | $Ni_{50}Ti_{46}Er_{3.75}Cr_{0.25}$ | $Ni_{50}Ti_{46}Er_{3.5}Cr_{0.5}$ | $Ni_{50}Ti_{46}Er_{3.25}Cr_{0.75}$ | $Ni_{50}Ti_{46}Er_3Cr_1$ |
| $Ni_{51}Ti_{45}Er_4$ | $Ni_{51}Ti_{45}Er_{3.75}Cr_{0.25}$ | $Ni_{51}Ti_{45}Er_{3.5}Cr_{0.5}$ | $Ni_{51}Ti_{45}Er_{3.25}Cr_{0.75}$ | $Ni_{51}Ti_{45}Er_3Cr_1$ |
| $Ni_{52}Ti_{44}Er_4$ | $Ni_{52}Ti_{44}Er_{3.75}Cr_{0.25}$ | $Ni_{52}Ti_{44}Er_{3.5}Cr_{0.5}$ | $Ni_{52}Ti_{44}Er_{3.25}Cr_{0.75}$ | $Ni_{52}Ti_{44}Er_3Cr_1$ |
| $Ni_{53}Ti_{43}Er_4$ | $Ni_{53}Ti_{43}Er_{3.75}Cr_{0.25}$ | $Ni_{53}Ti_{43}Er_{3.5}Cr_{0.5}$ | $Ni_{53}Ti_{43}Er_{3.25}Cr_{0.75}$ | $Ni_{53}Ti_{43}Er_3Cr_1$ |
| $Ni_{54}Ti_{42}Er_4$ | $Ni_{54}Ti_{42}Er_{3.75}Cr_{0.25}$ | $Ni_{54}Ti_{42}Er_{3.5}Cr_{0.5}$ | $Ni_{54}Ti_{42}Er_{3.25}Cr_{0.75}$ | $Ni_{54}Ti_{42}Er_3Cr_1$ |
| $Ni_{55}Ti_{41}Er_4$ | $Ni_{55}Ti_{41}Er_{3.75}Cr_{0.25}$ | $Ni_{55}Ti_{41}Er_{3.5}Cr_{0.5}$ | $Ni_{55}Ti_{41}Er_{3.25}Cr_{0.75}$ | $Ni_{55}Ti_{41}Er_3Cr_1$ |
| $Ni_{56}Ti_{40}Er_4$ | $Ni_{56}Ti_{40}Er_{3.75}Cr_{0.25}$ | $Ni_{56}Ti_{40}Er_{3.5}Cr_{0.5}$ | $Ni_{56}Ti_{40}Er_{3.25}Cr_{0.75}$ | $Ni_{56}Ti_{40}Er_3Cr_1$ |

Palladium (Pd) also may be useful for suppressing the austenitic phase transformation temperature of the alloy, and it may further improve the radiopacity of the material. Palladium also may be useful for improving the pliability and the workability of the nickel-titanium alloy. Accordingly, Pd may be included as an alloying element in place of or in addition to Cr. Compiled in Tables 3-8 below are preferred Ni—Ti-RE alloy compositions that include Pd along with a rare earth element (RE=Er, La, Gd, Dy, Sm, or Ce), and increasing concentrations of nickel. It also may be useful to include iron (Fe) in the alloy composition as a quaternary or higher order elemental addition, as iron can improve the hot workability of the nickel-titanium alloy. For example, up to about 10 at. % Fe may be suitable for addition to the Ni—Ti-RE alloy. In some cases, up to about 3 at. % Fe, or up to about 1 at. % Fe, may be advantageous for addition to the alloy.

TABLE 3

| Exemplary Alloy Compositions Including Er and Pd (at. %) | | | | |
|---|---|---|---|---|
| $Ni_{50}Ti_{46}Er_4$ | $Ni_{50}Ti_{46}Er_{3.5}Pd_{0.5}$ | $Ni_{50}Ti_{46}Er_3Pd_1$ | $Ni_{50}Ti_{46}Er_{2.5}Pd_{1.5}$ | $Ni_{50}Ti_{46}Er_2Pd_2$ |
| $Ni_{51}Ti_{45}Er_4$ | $Ni_{51}Ti_{45}Er_{3.5}Pd_{0.5}$ | $Ni_{51}Ti_{45}Er_3Pd_1$ | $Ni_{51}Ti_{45}Er_{2.5}Pd_{1.5}$ | $Ni_{51}Ti_{45}Er_2Pd_2$ |
| $Ni_{52}Ti_{44}Er_4$ | $Ni_{52}Ti_{44}Er_{3.5}Pd_{0.5}$ | $Ni_{52}Ti_{44}Er_3Pd_1$ | $Ni_{52}Ti_{44}Er_{2.5}Pd_{1.5}$ | $Ni_{52}Ti_{44}Er_2Pd_2$ |
| $Ni_{53}Ti_{43}Er_4$ | $Ni_{53}Ti_{43}Er_{3.5}Pd_{0.5}$ | $Ni_{53}Ti_{43}Er_3Pd_1$ | $Ni_{53}Ti_{43}Er_{2.5}Pd_{1.5}$ | $Ni_{53}Ti_{43}Er_2Pd_2$ |
| $Ni_{54}Ti_{42}Er_4$ | $Ni_{54}Ti_{42}Er_{3.5}Pd_{0.5}$ | $Ni_{54}Ti_{42}Er_3Pd_1$ | $Ni_{54}Ti_{42}Er_{2.5}Pd_{1.5}$ | $Ni_{54}Ti_{42}Er_2Pd_2$ |
| $Ni_{55}Ti_{41}Er_4$ | $Ni_{55}Ti_{41}Er_{3.5}Pd_{0.5}$ | $Ni_{55}Ti_{41}Er_3Pd_1$ | $Ni_{55}Ti_{41}Er_{2.5}Pd_{1.5}$ | $Ni_{55}Ti_{41}Er_2Pd_2$ |
| $Ni_{56}Ti_{40}Er_4$ | $Ni_{56}Ti_{40}Er_{3.5}Pd_{0.5}$ | $Ni_{56}Ti_{40}Er_3Pd_1$ | $Ni_{56}Ti_{40}Er_{2.5}Pd_{1.5}$ | $Ni_{56}Ti_{40}Er_2Pd_2$ |

TABLE 4

| Exemplary Alloy Compositions Including La and Pd (at. %) | | | | |
|---|---|---|---|---|
| $Ni_{50}Ti_{46}La_4$ | $Ni_{50}Ti_{46}La_{3.5}Pd_{0.5}$ | $Ni_{50}Ti_{46}La_3Pd_1$ | $Ni_{50}Ti_{46}La_{2.5}Pd_{1.5}$ | $Ni_{50}Ti_{46}La_2Pd_2$ |
| $Ni_{51}Ti_{45}La_4$ | $Ni_{51}Ti_{45}La_{3.5}Pd_{0.5}$ | $Ni_{51}Ti_{45}La_3Pd_1$ | $Ni_{51}Ti_{45}La_{2.5}Pd_{1.5}$ | $Ni_{51}Ti_{45}La_2Pd_2$ |
| $Ni_{52}Ti_{44}La_4$ | $Ni_{52}Ti_{44}La_{3.5}Pd_{0.5}$ | $Ni_{52}Ti_{44}La_3Pd_1$ | $Ni_{52}Ti_{44}La_{2.5}Pd_{1.5}$ | $Ni_{52}Ti_{44}La_2Pd_2$ |
| $Ni_{53}Ti_{43}La_4$ | $Ni_{53}Ti_{43}La_{3.5}Pd_{0.5}$ | $Ni_{53}Ti_{43}La_3Pd_1$ | $Ni_{53}Ti_{43}La_{2.5}Pd_{1.5}$ | $Ni_{53}Ti_{43}La_2Pd_2$ |
| $Ni_{54}Ti_{42}La_4$ | $Ni_{54}Ti_{42}La_{3.5}Pd_{0.5}$ | $Ni_{54}Ti_{42}La_3Pd_1$ | $Ni_{54}Ti_{42}La_{2.5}Pd_{1.5}$ | $Ni_{54}Ti_{42}La_2Pd_2$ |
| $Ni_{55}Ti_{41}La_4$ | $Ni_{55}Ti_{41}La_{3.5}Pd_{0.5}$ | $Ni_{55}Ti_{41}La_3Pd_1$ | $Ni_{55}Ti_{41}La_{2.5}Pd_{1.5}$ | $Ni_{55}Ti_{41}La_2Pd_2$ |
| $Ni_{56}Ti_{40}La_4$ | $Ni_{56}Ti_{40}La_{3.5}Pd_{0.5}$ | $Ni_{56}Ti_{40}La_3Pd_1$ | $Ni_{56}Ti_{40}La_{2.5}Pd_{1.5}$ | $Ni_{56}Ti_{40}La_2Pd_2$ |

TABLE 5

| Exemplary Alloy Compositions Including Gd and Pd (at. %) | | | | |
|---|---|---|---|---|
| $Ni_{50}Ti_{46}Gd_4$ | $Ni_{50}Ti_{46}Gd_{3.5}Pd_{0.5}$ | $Ni_{50}Ti_{46}Gd_3Pd_1$ | $Ni_{50}Ti_{46}Gd_{2.5}Pd_{1.5}$ | $Ni_{50}Ti_{46}Gd_2Pd_2$ |
| $Ni_{51}Ti_{45}Gd_4$ | $Ni_{51}Ti_{45}Gd_{3.5}Pd_{0.5}$ | $Ni_{51}Ti_{45}Gd_3Pd_1$ | $Ni_{51}Ti_{45}Gd_{2.5}Pd_{1.5}$ | $Ni_{51}Ti_{45}Gd_2Pd_2$ |
| $Ni_{52}Ti_{44}Gd_4$ | $Ni_{52}Ti_{44}Gd_{3.5}Pd_{0.5}$ | $Ni_{52}Ti_{44}Gd_3Pd_1$ | $Ni_{52}Ti_{44}Gd_{2.5}Pd_{1.5}$ | $Ni_{52}Ti_{44}Gd_2Pd_2$ |
| $Ni_{53}Ti_{43}Gd_4$ | $Ni_{53}Ti_{43}Gd_{3.3}Pd_{0.5}$ | $Ni_{53}Ti_{43}Gd_3Pd_1$ | $Ni_{53}Ti_{43}Gd_{2.5}Pd_{1.5}$ | $Ni_{53}Ti_{43}Gd_2Pd_2$ |
| $Ni_{54}Ti_{42}Gd_4$ | $Ni_{54}Ti_{42}Gd_{3.5}Pd_{0.5}$ | $Ni_{54}Ti_{42}Gd_3Pd_1$ | $Ni_{54}Ti_{42}Gd_{2.5}Pd_{1.5}$ | $Ni_{54}Ti_{42}Gd_2Pd_2$ |
| $Ni_{55}Ti_{41}Gd_4$ | $Ni_{55}Ti_{41}Gd_{3.5}Pd_{0.5}$ | $Ni_{55}Ti_{41}Gd_3Pd_1$ | $Ni_{55}Ti_{41}Gd_{2.5}Pd_{1.5}$ | $Ni_{55}Ti_{41}Gd_2Pd_2$ |
| $Ni_{56}Ti_{40}Gd_4$ | $Ni_{56}Ti_{40}Gd_{3.5}Pd_{0.5}$ | $Ni_{56}Ti_{40}Gd_3Pd_1$ | $Ni_{56}Ti_{40}Gd_{2.5}Pd_{1.5}$ | $Ni_{56}Ti_{40}Gd_2Pd_2$ |

TABLE 6

| Exemplary Alloy Composition Including Dy and Pd (at. %) | | | | |
|---|---|---|---|---|
| $Ni_{50}Ti_{46}Dy_4$ | $Ni_{50}Ti_{46}Dy_{3.5}Pd_{0.5}$ | $Ni_{50}Ti_{46}Dy_3Pd_1$ | $Ni_{50}Ti_{46}Dy_{2.5}Pd_{1.5}$ | $Ni_{50}Ti_{46}Dy_2Pd_2$ |
| $Ni_{51}Ti_{45}Dy_4$ | $Ni_{51}Ti_{45}Dy_{3.5}Pd_{0.5}$ | $Ni_{51}Ti_{45}Dy_3Pd_1$ | $Ni_{51}Ti_{45}Dy_{2.5}Pd_{1.5}$ | $Ni_{51}Ti_{45}Dy_2Pd_2$ |
| $Ni_{52}Ti_{44}Dy_4$ | $Ni_{52}Ti_{44}Dy_{3.5}Pd_{0.5}$ | $Ni_{52}Ti_{44}Dy_3Pd_1$ | $Ni_{52}Ti_{44}Dy_{2.5}Pd_{1.5}$ | $Ni_{52}Ti_{44}Dy_2Pd_2$ |
| $Ni_{53}Ti_{43}Dy_4$ | $Ni_{53}Ti_{43}Dy_{3.5}Pd_{0.5}$ | $Ni_{53}Ti_{43}Dy_3Pd_1$ | $Ni_{53}Ti_{43}Dy_{2.5}Pd_{1.5}$ | $Ni_{53}Ti_{43}Dy_2Pd_2$ |
| $Ni_{54}Ti_{42}Dy_4$ | $Ni_{54}Ti_{42}Dy_{3.5}Pd_{0.5}$ | $Ni_{54}Ti_{42}Dy_3Pd_1$ | $Ni_{54}Ti_{42}Dy_{2.5}Pd_{1.5}$ | $Ni_{54}Ti_{42}Dy_2Pd_2$ |
| $Ni_{55}Ti_{41}Dy_4$ | $Ni_{55}Ti_{41}Dy_{3.5}Pd_{0.5}$ | $Ni_{55}Ti_{41}Dy_3Pd_1$ | $Ni_{55}Ti_{41}Dy_{2.5}Pd_{1.5}$ | $Ni_{55}Ti_{41}Dy_2Pd_2$ |
| $Ni_{56}Ti_{40}Dy_4$ | $Ni_{56}Ti_{40}Dy_{3.5}Pd_{0.5}$ | $Ni_{56}Ti_{40}Dy_3Pd_1$ | $Ni_{56}Ti_{40}Dy_{2.5}Pd_{1.5}$ | $Ni_{56}Ti_{40}Dy_2Pd_2$ |

TABLE 7

| Exemplary Alloy Compositions Including Sm and Pd (at. %) | | | | |
|---|---|---|---|---|
| $Ni_{50}Ti_{46}Sm_4$ | $Ni_{50}Ti_{46}Sm_{3.5}Pd_{0.5}$ | $Ni_{50}Ti_{46}Sm_3Pd_1$ | $Ni_{50}Ti_{46}Sm_{2.5}Pd_{1.5}$ | $Ni_{50}Ti_{46}Sm_2Pd_2$ |
| $Ni_{51}Ti_{45}Sm_4$ | $Ni_{51}Ti_{45}Sm_{3.5}Pd_{0.5}$ | $Ni_{51}Ti_{45}Sm_3Pd_1$ | $Ni_{51}Ti_{45}Sm_{2.5}Pd_{1.5}$ | $Ni_{51}Ti_{45}Sm_2Pd_2$ |
| $Ni_{52}Ti_{44}Sm_4$ | $Ni_{52}Ti_{44}Sm_{3.5}Pd_{0.5}$ | $Ni_{52}Ti_{44}Sm_3Pd_1$ | $Ni_{52}Ti_{44}Sm_{2.5}Pd_{1.5}$ | $Ni_{52}Ti_{44}Sm_2Pd_2$ |
| $Ni_{53}Ti_{43}Sm_4$ | $Ni_{53}Ti_{43}Sm_{3.5}Pd_{0.5}$ | $Ni_{53}Ti_{43}Sm_3Pd_1$ | $Ni_{53}Ti_{43}Sm_{2.5}Pd_{1.5}$ | $Ni_{53}Ti_{43}Sm_2Pd_2$ |
| $Ni_{54}Ti_{42}Sm_4$ | $Ni_{54}Ti_{42}Sm_{3.5}Pd_{0.5}$ | $Ni_{54}Ti_{42}Sm_3Pd_1$ | $Ni_{54}Ti_{42}Sm_{2.5}Pd_{1.5}$ | $Ni_{54}Ti_{42}Sm_2Pd_2$ |
| $Ni_{55}Ti_{41}Sm_4$ | $Ni_{55}Ti_{41}Sm_{3.5}Pd_{0.5}$ | $Ni_{55}Ti_{41}Sm_3Pd_1$ | $Ni_{55}Ti_{41}Sm_{2.5}Pd_{1.5}$ | $Ni_{55}Ti_{41}Sm_2Pd_2$ |
| $Ni_{56}Ti_{40}Sm_4$ | $Ni_{56}Ti_{40}Sm_{3.5}Pd_{0.5}$ | $Ni_{56}Ti_{40}Sm_3Pd_1$ | $Ni_{56}Ti_{40}Sm_{2.5}Pd_{1.5}$ | $Ni_{56}Ti_{40}Sm_2Pd_2$ |

TABLE 8

| Exemplary Alloy Compositions Including Ce and Pd (at. %) | | | | |
|---|---|---|---|---|
| $Ni_{50}Ti_{46}Ce_4$ | $Ni_{50}Ti_{46}Ce_{3.5}Pd_{0.5}$ | $Ni_{50}Ti_{46}Ce_3Pd_1$ | $Ni_{50}Ti_{46}Ce_{2.5}Pd_{1.5}$ | $Ni_{50}Ti_{46}Ce_2Pd_2$ |
| $Ni_{51}Ti_{45}Ce_4$ | $Ni_{51}Ti_{45}Ce_{3.5}Pd_{0.5}$ | $Ni_{51}Ti_{45}Ce_3Pd_1$ | $Ni_{51}Ti_{45}Ce_{2.5}Pd_{1.5}$ | $Ni_{51}Ti_{45}Ce_2Pd_2$ |
| $Ni_{52}Ti_{44}Ce_4$ | $Ni_{52}Ti_{44}Ce_{3.5}Pd_{0.5}$ | $Ni_{52}Ti_{44}Ce_3Pd_1$ | $Ni_{52}Ti_{44}Ce_{2.5}Pd_{1.5}$ | $Ni_{52}Ti_{44}Ce_2Pd_2$ |
| $Ni_{53}Ti_{43}Ce_4$ | $Ni_{53}Ti_{43}Ce_{3.5}Pd_{0.5}$ | $Ni_{53}Ti_{43}Ce_3Pd_1$ | $Ni_{53}Ti_{43}Ce_{2.5}Pd_{1.5}$ | $Ni_{53}Ti_{43}Ce_2Pd_2$ |
| $Ni_{54}Ti_{42}Ce_4$ | $Ni_{54}Ti_{42}Ce_{3.5}Pd_{0.5}$ | $Ni_{54}Ti_{42}Ce_3Pd_1$ | $Ni_{54}Ti_{42}Ce_{2.5}Pd_{1.5}$ | $Ni_{54}Ti_{42}Ce_2Pd_2$ |

TABLE 8-continued

| Exemplary Alloy Compositions Including Ce and Pd (at. %) | | | | |
|---|---|---|---|---|
| $Ni_{55}Ti_{41}Ce_4$ | $Ni_{55}Ti_{41}Ce_{3.5}Pd_{0.5}$ | $Ni_{55}Ti_{41}Ce_3Pd_1$ | $Ni_{55}Ti_{41}Ce_{2.5}Pd_{1.5}$ | $Ni_{55}Ti_{41}Ce_2Pd_2$ |
| $Ni_{56}Ti_{40}Ce_4$ | $Ni_{56}Ti_{40}Ce_{3.5}Pd_{0.5}$ | $Ni_{56}Ti_{40}Ce_3Pd_1$ | $Ni_{56}Ti_{40}Ce_{2.5}Pd_{1.5}$ | $Ni_{56}Ti_{40}Ce_2Pd_2$ |

In general, when Pd is included as the additional alloying element (AAE), the nickel-titanium alloy includes less than about 6 at. % RE; for example, the nickel-titanium alloy may include from about 2 at. % RE to about 6 at. % RE, from about 2 at. % RE to about 3.5 at. % RE, or from about 3 at. % RE to about 6 at. % RE, where the amount of palladium ranges from about 0.5 at. % Pd to about 5 at. % Pd, from about 0.5 at. % Pd to about 2 at. % Pd, or from about 1 at. % Pd to about 5 at. % Pd.

The overall ductility of the Ni—Ti-RE alloy may be improved by the addition of very small amounts of boron (B), up to about 0.1 at. %. The inventors believe that grain boundary segregation of B may promote slip during plastic deformation, thus improving hot and cold workability of the alloy.

Due to the improvement in workability obtained with boron additions combined with the enhanced radiopacity provided by the rare earth alloying element, a family of preferred Ni—Ti-RE-B alloys has been identified by a series of experiments, which are discussed in greater detail in Example 3, wherein erbium is employed as the rare earth alloying element. However, any of the alloy compositions discussed in the present disclosure may benefit from small additions of boron, such as from about 0.001 at. % to about 0.1 at. %.

For example, the Ni—Ti-RE-B alloy may include nickel at a concentration of from about 35 at. % to about 65 at. %, a rare earth element at a concentration of up to about 15 at. %, boron at a concentration of up to about 0.1 at. %, and the balance titanium. In another example, the Ni—Ti-RE-B alloy may include nickel at a concentration of from about 35 at. % to about 65 at. %, a rare earth element at a concentration of from about 1.5 at. % to about 15 at. %, boron at a concentration of up to about 0.1 at. %, and the balance titanium. The concentration of nickel in the Ni—Ti-RE-B alloy also may lie in the range of from about 45 at. % to about 55 at. %. For example, the concentration of nickel may be about 50 at. %.

The concentration of the rare earth element also may lie in one or more of the following ranges: from about 1.5 at. % to about 12 at. %, from about 3 at. % to about 7.5 at. %, or from about 4.5 at. % to about 6 at. %. Preferably, the rare earth element is erbium.

The concentration of boron may lie in one or more of the following ranges: from about 0.001 at. % to about 0.1 at. %; from about 0.005 at. % to about 0.1 at. %; from about 0.01 at. % to about 0.1 at. %, or from about 0.01 at. % to about 0.05 at. %. The concentration of boron is about 35 ppm (approximately 0.02 at. %), according to one embodiment.

The alloy may further include an additional alloying element (AAE) in an amount up to about 5 at. %, such as in the range of from about 1 at. % to about 5 at. %. For example, the nickel-titanium alloy may include from about 50 at. % Ni to about 51 at. % Ni, from about 3 at. % Er to about 6 at. % Er, from about 1 at. % Pd to about 5 at. % Pd, and from about 5 ppm to about 500 ppm of boron. A concentration of boron of from about 10 ppm to about 100 ppm, or from about 20 ppm to about 50 ppm, also may be suitable for the nickel-titanium alloy. A preferred ternary alloy composition comprising boron includes about 51 at. % Ni, about 4 at. % Er, about 3 at. % Pd, and about 35 ppm B. Another preferred composition includes about 51 at. % Ni, about 3 at. % Er, about 2 at. % Pd, and about 35 ppm B.

Small amounts (e.g., hundreds of ppm) of non-metal elemental additions, such as, for example, C, H, N, or O, also may be present in the nickel-titanium alloy, although non-metallic elements are generally not included in the summation of alloying elements used to specify the composition of the alloy. Preferably, the amounts of C, O, and N are consistent with the American Society of Testing and Materials (ASTM) standard F2063, so as to avoid forming a high number density of and/or large-size carbide, oxide, nitride or complex carbonitride particles. This may result in a better electropolished surface and better fatigue life of the nickel-titanium alloy. H is preferably controlled per ASTM standard F2063 to minimize hydrogen embrittlement of the alloy. The aforementioned ASTM standards are hereby incorporated by reference.

The nickel-titanium alloy has a phase structure that depends on the composition and processing history of the alloy. The rare earth element may form a solid solution with nickel and/or titanium. The rare earth element also may form one or more binary intermetallic compound phases with nickel and/or with titanium. In other words, the rare earth element may combine with nickel in specific proportions and/or with titanium in specific proportions. Without wishing to be bound by theory, it is believed that most of the rare earth elements set forth as preferred ternary alloying additions will substitute for titanium and form one or more intermetallic compound phases with nickel, such as, for example, NiRE, $Ni_2RE$, $Ni_3RE_2$ or $Ni_3RE_7$. In some cases, however, the rare earth element may substitute for nickel and combine with titanium to form a solid solution or a compound such as $Ti_xRE_Y$. The nickel-titanium alloy also may include one or more other intermetallic compound phases of nickel and titanium, such as NiTi, $Ni_3Ti$ and/or $NiTi_2$, depending on the composition and heat treatment. The rare earth addition may form a ternary intermetallic compound phase with both nickel and titanium atoms, such as $Ni_xTi_yRE_Z$. Some exemplary phases in various Ni—Ti-RE alloys are identified below in Table 9. Also, in the event that one or more additional alloying elements are present in the nickel-titanium alloy, the additional alloying elements may form intermetallic compound phases with nickel, titanium, and/or the rare earth element.

TABLE 9

| Exemplary Phases in Ni—Ti-RE Alloys | |
|---|---|
| Alloy | Exemplary Phases |
| Ni—Ti—Dy | DyNi, $DyNi_2$, $Dy_xTi_y$, α(Ti), α(Ni), $Ni_xTi_yDy_z$ |
| Ni—Ti—Er | ErNi, $ErNi_2$, $Er_xTi_y$, α(Ti), α(Ni), $Ni_xTi_yEr_z$ |
| Ni—Ti—Gd | GdNi, $GdNi_2$, $Gd_xTi_y$, α(Ti), α(Ni), $Ni_xTi_yGd_z$ |
| Ni—Ti—La | LaNi, $La_2Ni_3$, $La_xTi_y$, α(Ti), α(Ni), $Ni_xTi_yLa_z$ |
| Ni—Ti—Nd | NdNi, $NdNi_2$, $Nd_xTi_y$, α(Ti), α(Ni), $Ni_xTi_yNd_z$ |
| Ni—Ti—Yb | $YbNi_2$, $Yb_xTi_y$, α(Ti), α(Ni), $Ni_xTi_yYb_z$ |

The phase structure of the nickel-titanium alloy may be determined by experimental and/or computational methods. For example, diffraction methods, such as x-ray diffraction, neutron diffraction, and/or electron diffraction, may be employed. Alternatively, the CALPHAD method (CALculation of PHAse Diagrams) may be employed. Implementation of the CALPHAD method is discussed in "Thermodynamic Modeling of Multicomponent Phase Equilibria," *JOM* 49, 12 (1997) 14-19, which is hereby incorporated by reference. A number of commercially available software programs may be used to carry out the CALPHAD method, including, for example, ChemSage, MTDATA and Thermo-Calc. The Thermo-Calc program, for example, uses a combination of pre-existing published data on elements and data provided by the user in order to calculate phase diagrams. The program includes some pre-existing data for NiTi, while data and thermodynamic equations for rare earth systems obtained from the scientific literature may have to be provided. A ternary phase diagram can be constructed from these two sets of information. The process involves entering the known phase data, adding additional phases unknown to the program, and manipulating the interactions between the elements and phases. A set of equations derived from these manipulations may then be applied to invariant points or features of the phase diagram which are known or expected, and the program calculates the diagram from the given data, optimizing the given parameters to fit.

Ab initio superstructure calculations may be used to determine the energetics of the substitution mechanisms, that is, whether the rare earth element is substituting for nickel or titanium. These calculations also reveal the effect of the rare earth substitution on the mechanical properties of the energetically favorable configurations. Once the energetics of the alloys of interest are determined, semi-empirical interatomic potentials may be fit to the ab initio data and to available experimental data to describe the alloys. For example, these potential models may be utilized to predict and describe the dynamic behaviour of the nickel-titanium alloys, e.g., the dependence of phase stability on temperature and pressure (stress), which may be indicative of the $M_f$ and $A_f$ temperatures.

In selecting a desired alloy composition, the effect of the rare earth alloying element on various properties of the nickel-titanium alloy, including radiopacity, transformation temperatures ($M_f$, $M_s$, $R'_s$, $R'_f$, $R_s$, $R_f$, $A_5$, $A_f$), and mechanical properties, may be considered.

The radiopacity of a material is related to its linear absorption coefficient, μ, which depends on its effective atomic number ($Z_{eff}$) and density (ρ), and on the energy (E) of the incoming x-ray photons:

$$\frac{\mu}{\rho} = const \cdot \frac{Z_{eff}^3}{E^3}$$

The linear absorption coefficient μ is proportional to the density ρ of the material, and thus the quantity μ/ρ is a material constant known as the mass absorption coefficient and expressed in units of $cm^2g^{-1}$.

Figure 2:
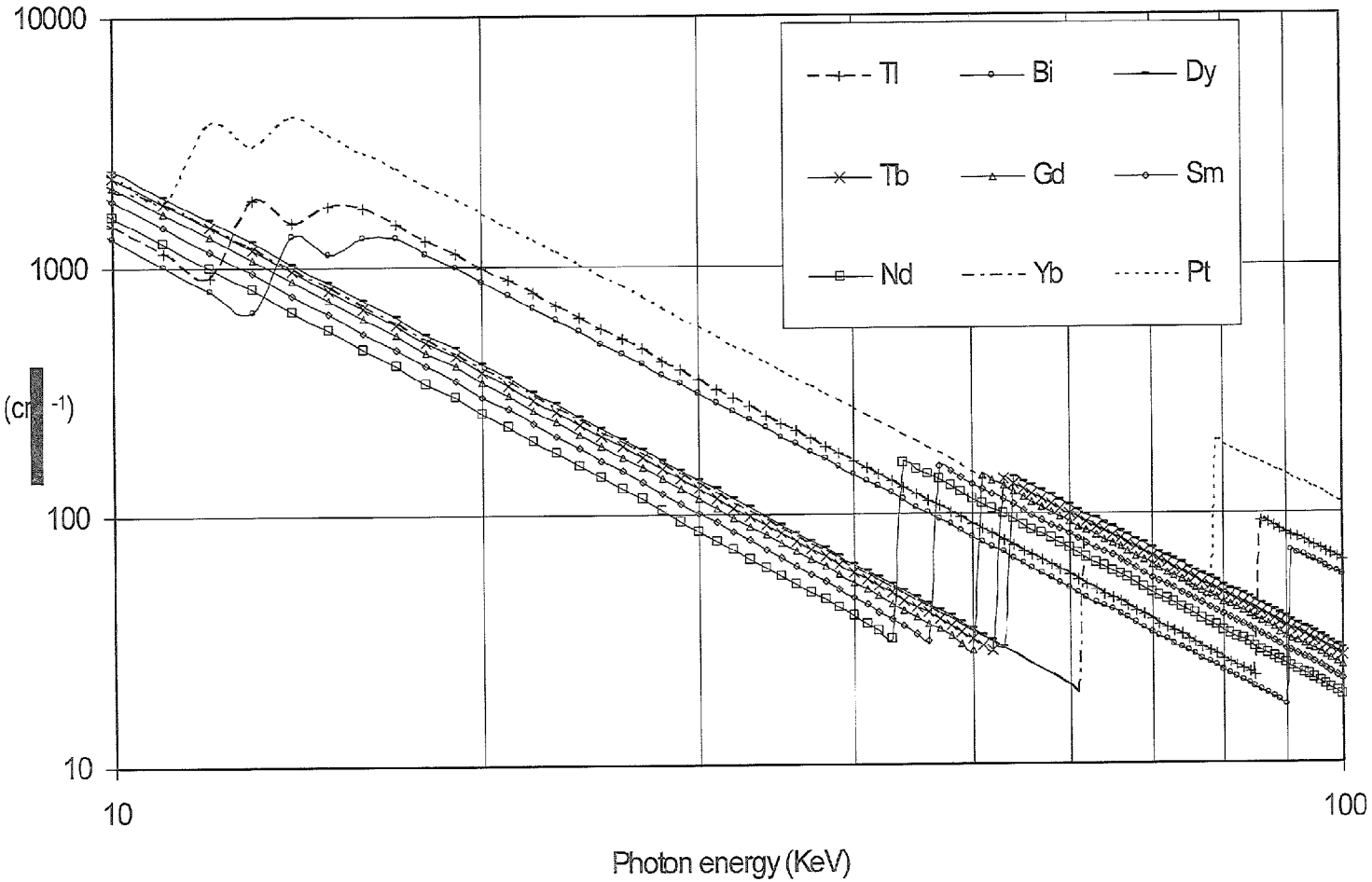
FIG. 2 is a graph of linear absorption coefficient versus photon energy for several rare earth (RE) elements and platinum.
Figure 3:
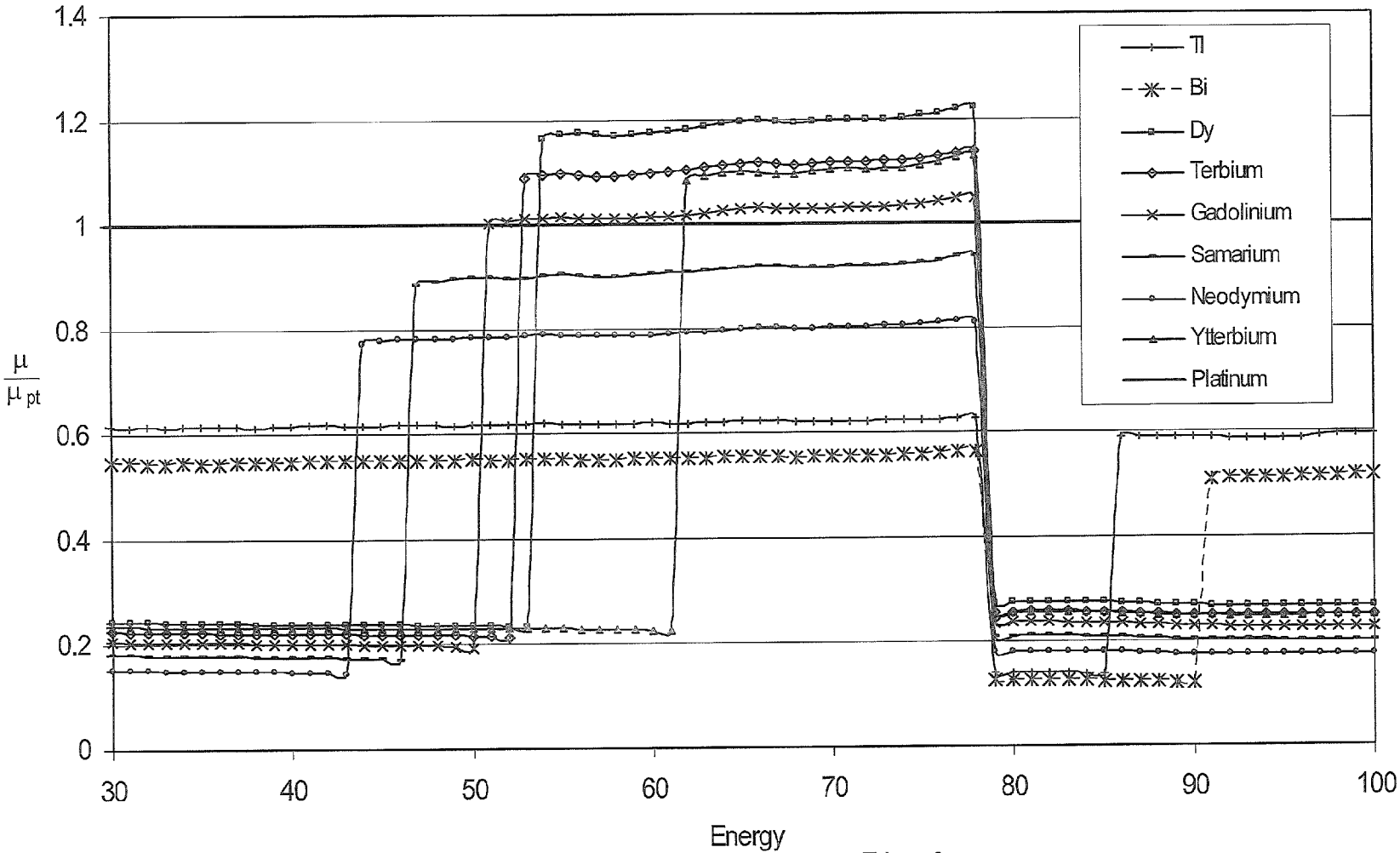
FIG. 3 is a graph of the linear absorption coefficient of FIG. 2 normalized with respect to the linear absorption coefficient of platinum versus photon energy.

Linear absorption coefficients μ were calculated for several rare earth elements and also for platinum for comparison. The results are shown in FIG. 2. In FIG. 3, the linear absorption coefficients μ are shown normalized with respect to the linear absorption coefficient of platinum $\mu_{Pt}$. The figures indicate that the absorption of the rare earth elements tends to peak in the photon energy range of about 40 to 80 keV, with some rare earth elements exceeding the absorption of platinum in this region.

Linear absorption coefficients also were calculated for several Ni—Ti-RE alloy compositions, as will be described below. The calculations were carried out under simulated x-ray conditions in order to evaluate the potential for rare earth alloying additions to improve the radiopacity of nickel-titanium medical devices.

To carry out a typical diagnostic x-ray procedure, a x-ray source or tube may be disposed in opposition to a patient with at least one filter placed between the source and the patient. A diagnostic x-ray tube typically has a built-in aluminum filter of about 2.5 mm in thickness per Food and Drug Administration (FDA) regulations, and additional filters may be used to achieve further filtering of the emitted x-ray beam. The x-ray photons may be generated when electrons from a tungsten filament are accelerated by a tube voltage and bombard a W or W/Re anode within the x-ray tube. Typically, for diagnostic procedures, the tube voltage is in the range of from about 50 kVp to about 150 kVp. The x-rays generated by the bombardment may pass through a beryllium window and through the one or more filters disposed between the source and the patient. The x-rays also experience a filtering or attenuation effect when passing through air and through tissues of the patient.

Figure 4A:
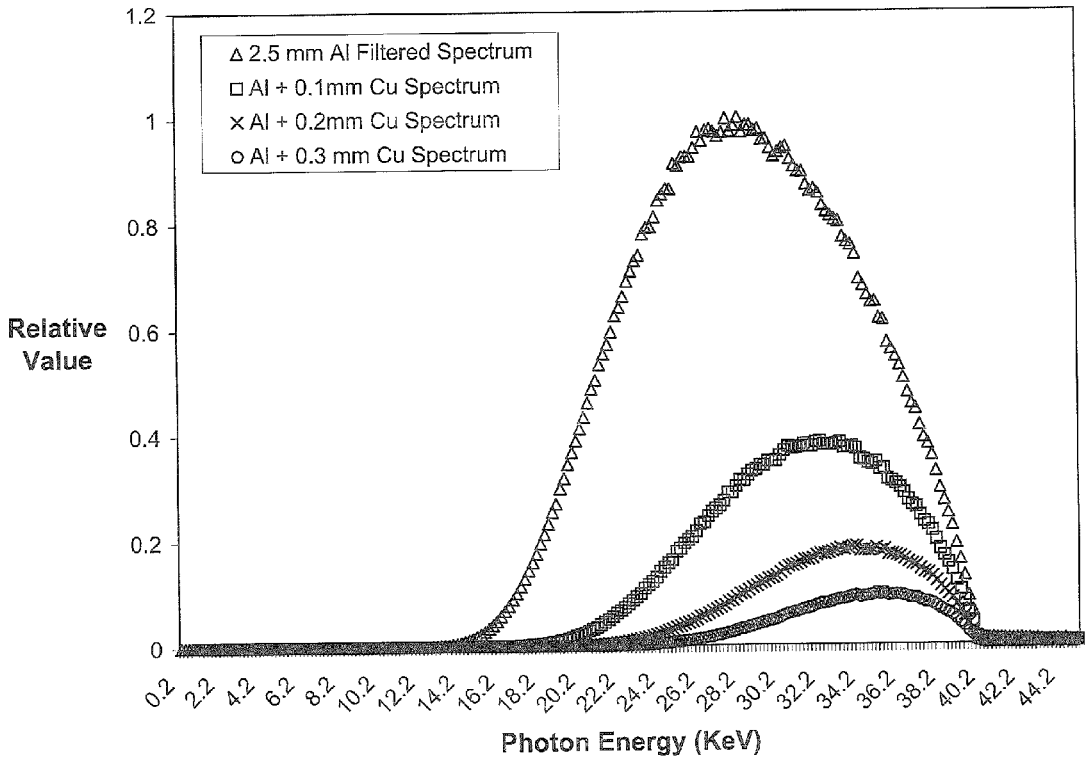
FIG. 4A is graph of relative incidence versus photon energy at a 40 kVp tube voltage for four different filtration levels.
Figure 4B:
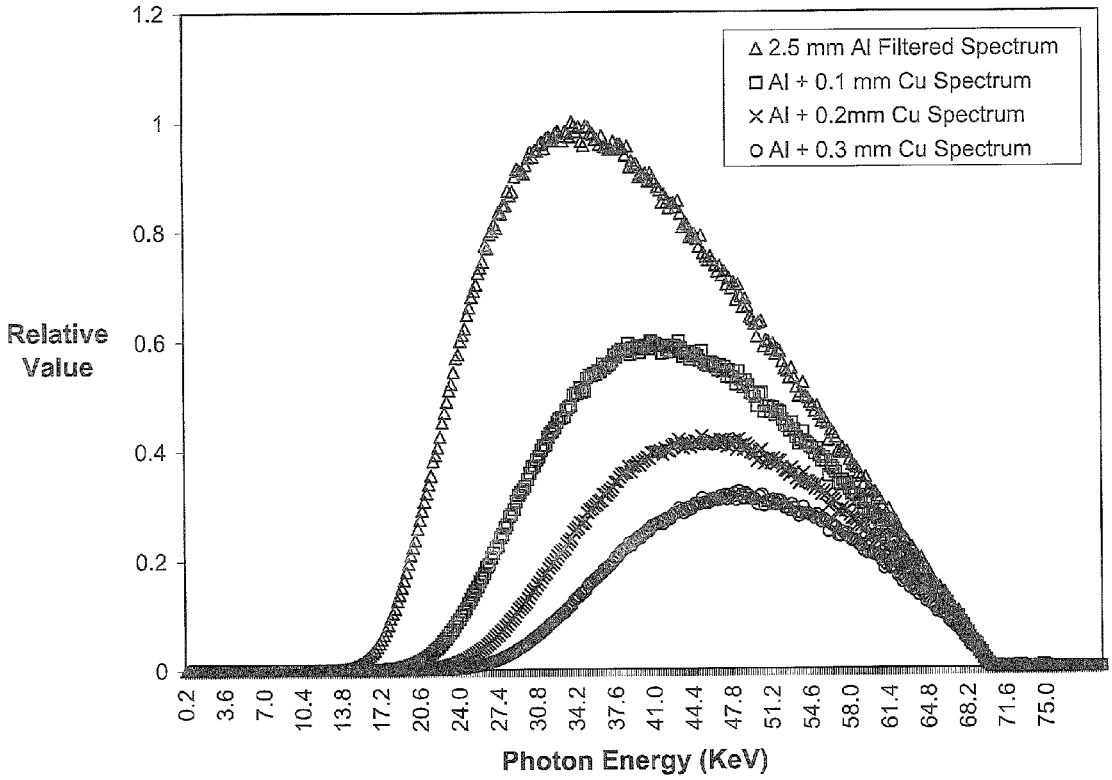
FIG. 4B is graph of relative incidence versus photon energy at a 70 kVp tube voltage for four different filtration levels.
Figure 4C:
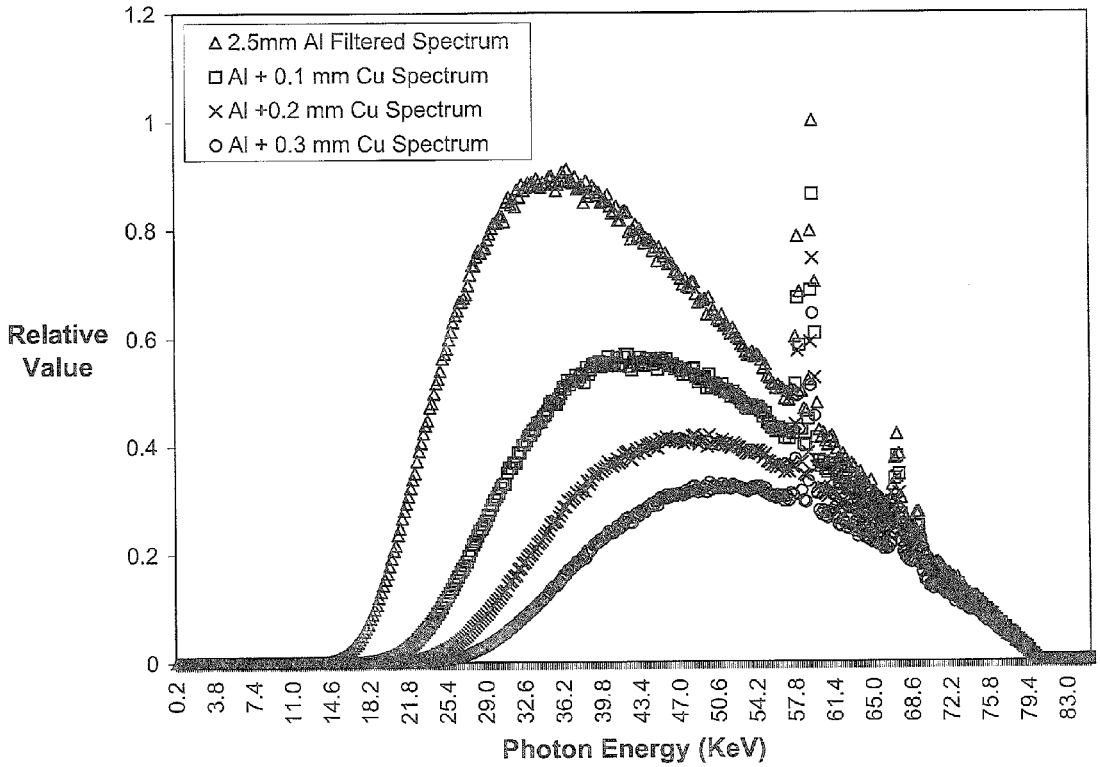
FIG. 4C is graph of relative incidence versus photon energy at a 80 kVp tube voltage for four different filtration levels.
Figure 4D:
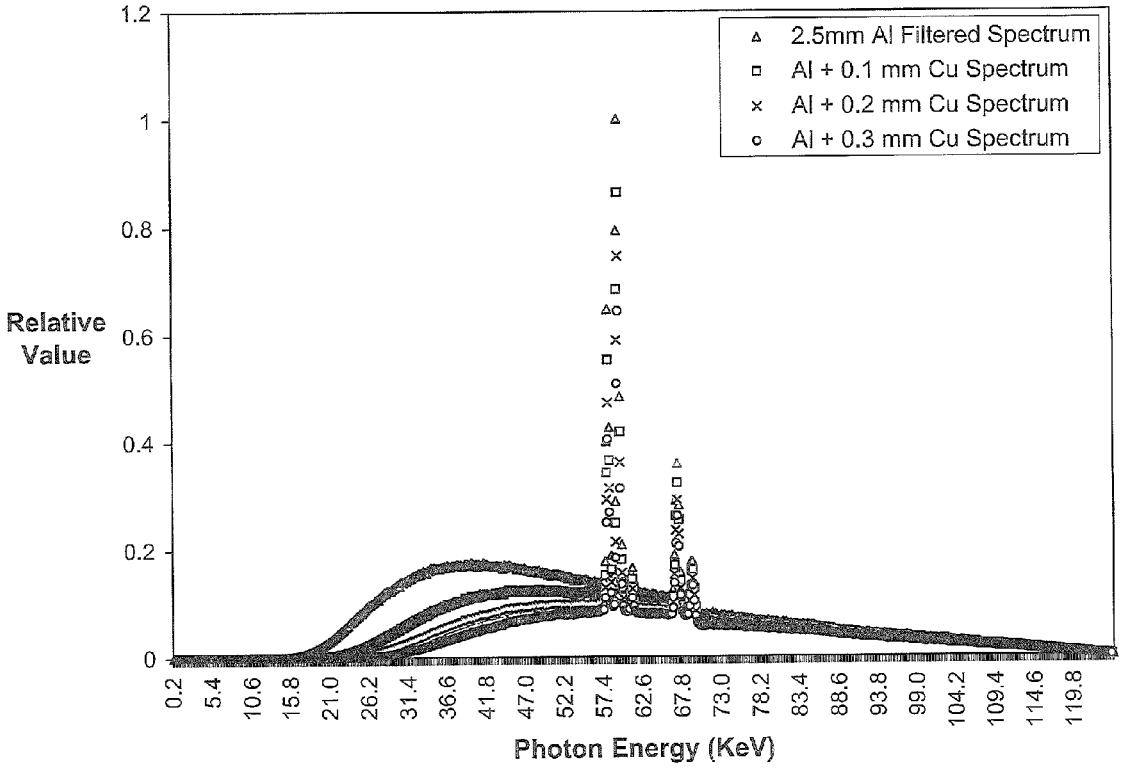
FIG. 4D is graph of relative incidence versus photon energy at a 125 kVp tube voltage for four different filtration levels.
Figure 5:
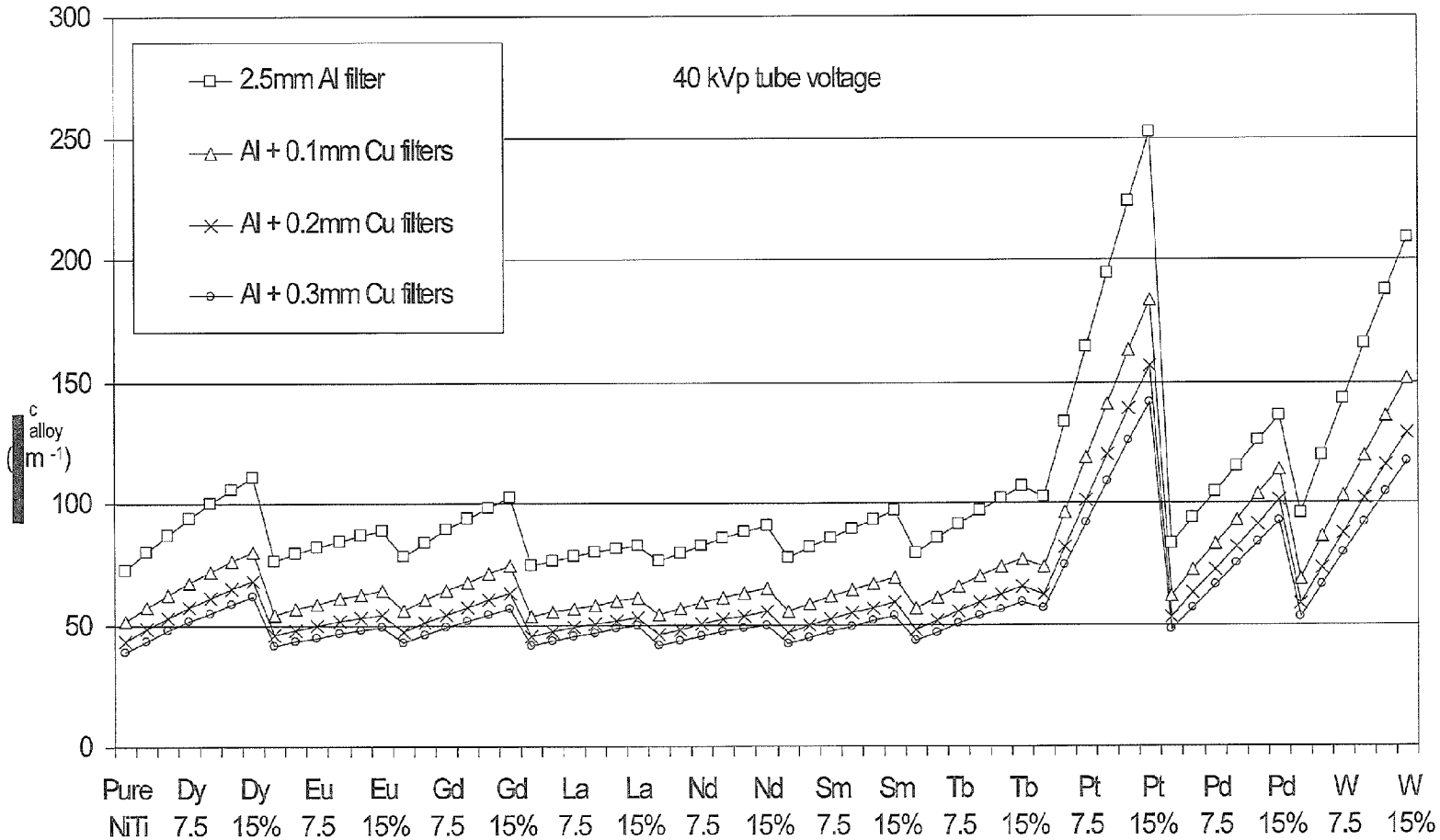
FIG. 5 is a graph of the calculated cumulative linear absorption coefficient of various Ni—Ti-RE alloys for a 40 kVp tube voltage and several filtration schemes.
Figure 6:
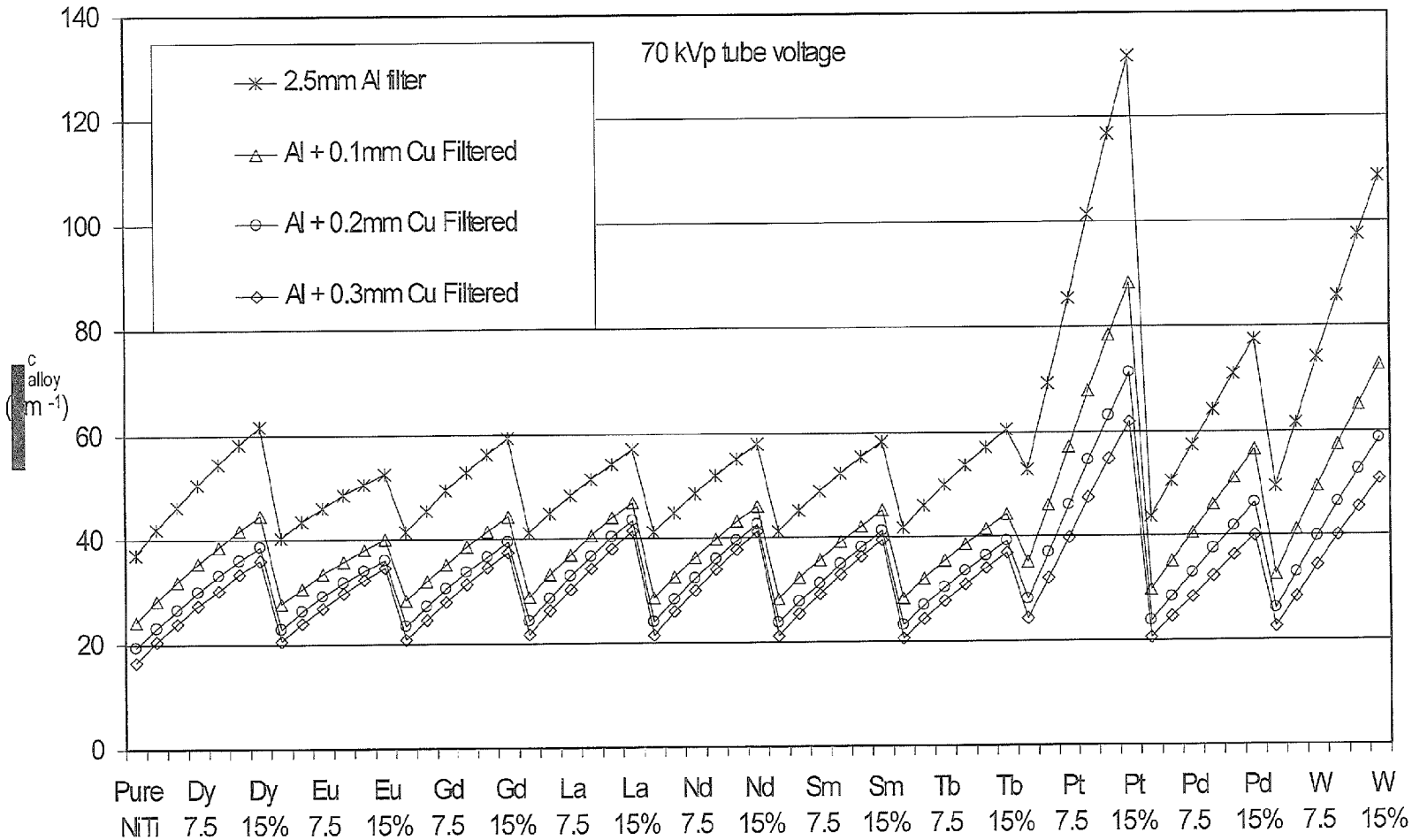
FIG. 6 is a graph of the calculated cumulative linear absorption coefficient (radiopacity) of various Ni—Ti-RE alloys for a 70 kVp tube voltage and several filtration schemes.
Figure 7:
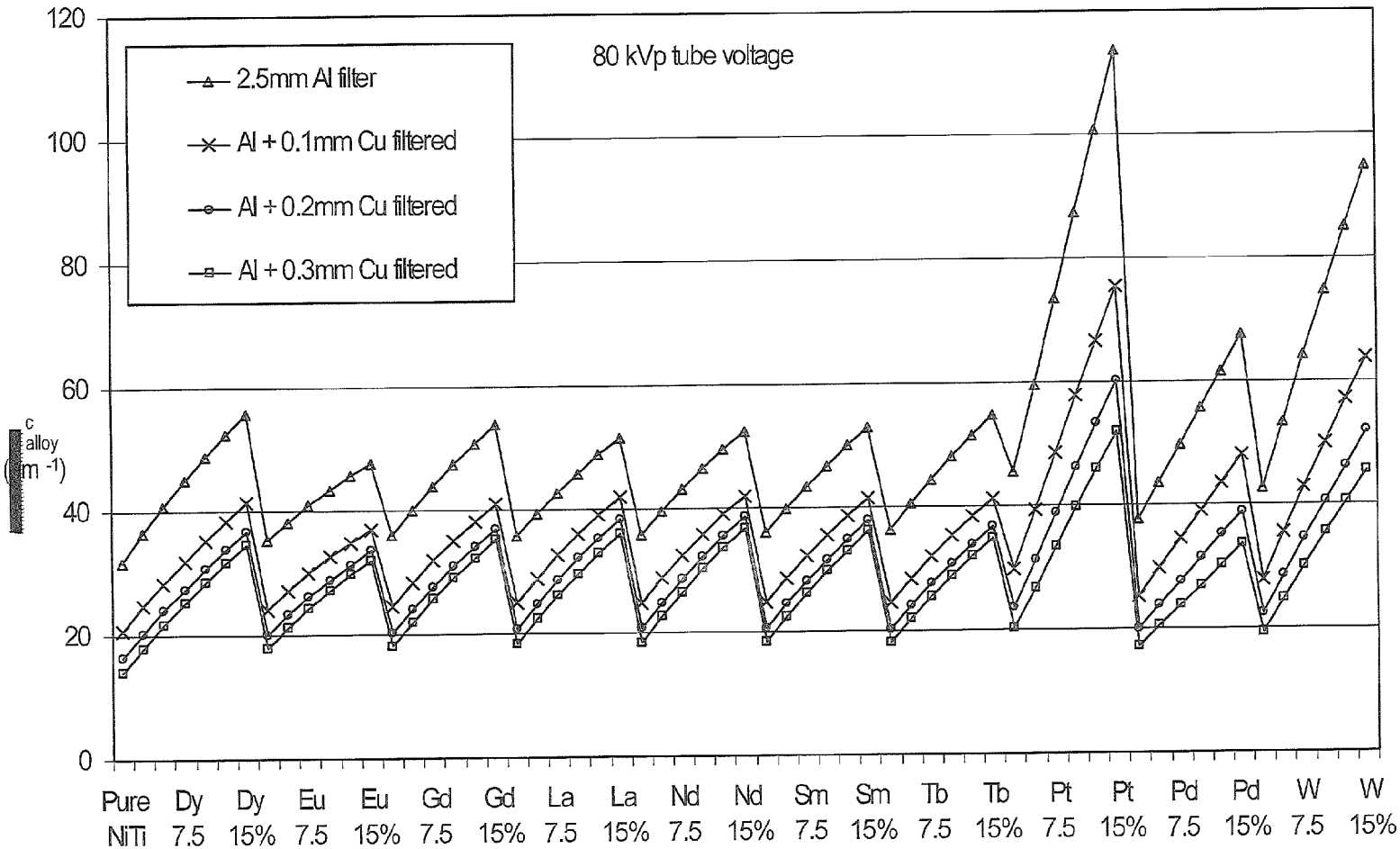
FIG. 7 is a graph of the calculated cumulative linear absorption coefficient (radiopacity) of various Ni—Ti-RE alloys for a 80 kVp tube voltage and several filtration schemes.
Figure 8:
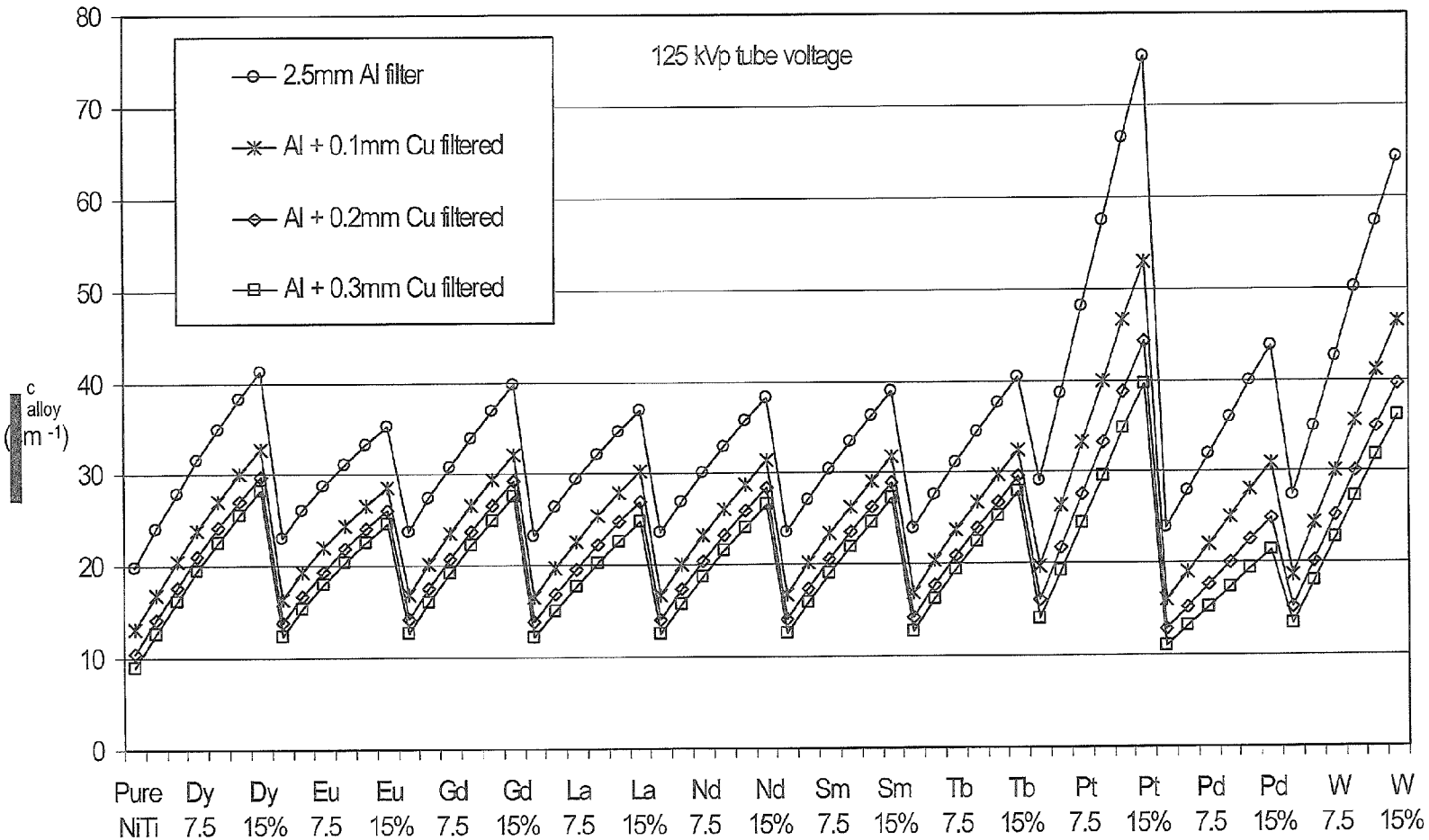
FIG. 8 is a graph of the calculated cumulative linear absorption coefficient (radiopacity) of various Ni—Ti-RE alloys for a 125 kVp tube voltage and several filtration schemes.
Figure 9:
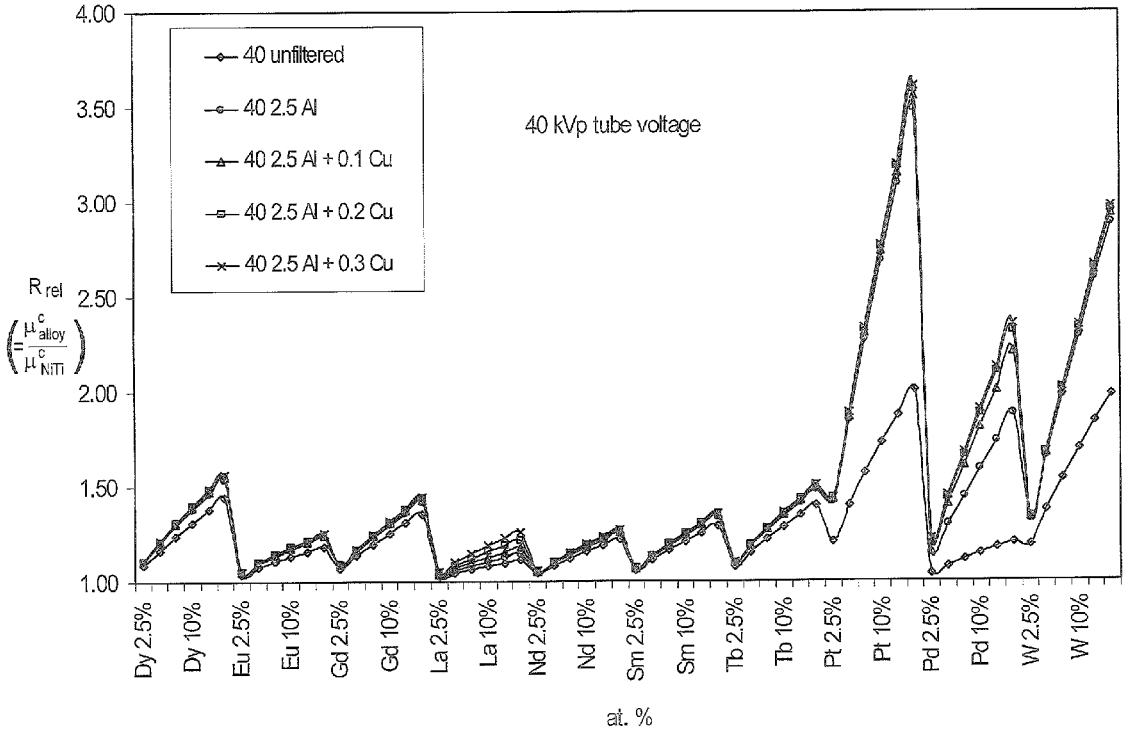
FIG. 9 is a graph of the radiopacity of various Ni—Ti-RE alloys relative to the radiopacity of a near-equiatomic binary nickel-titanium alloy for a 40 kVp tube voltage and several filtration schemes.
Figure 10:
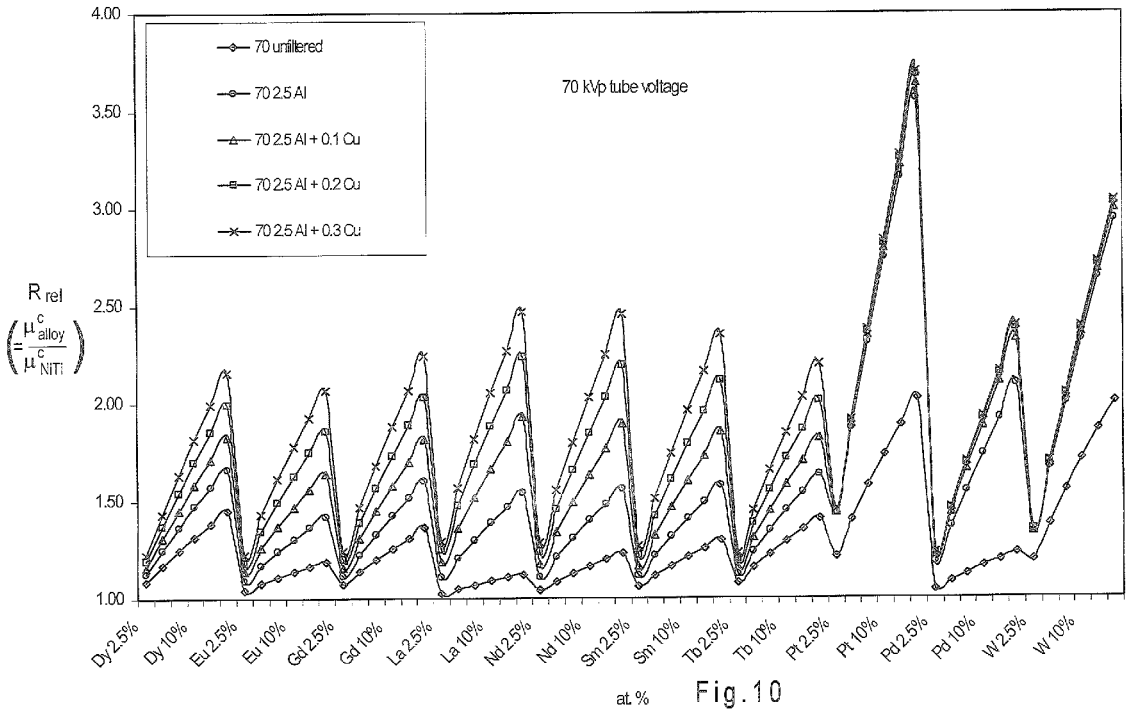
FIG. 10 is a graph of the radiopacity of various Ni—Ti-RE alloys relative to that of near-equiatomic binary nickel-titanium alloy for a 70 kVp tube voltage and several filtration schemes.
Figure 11A:
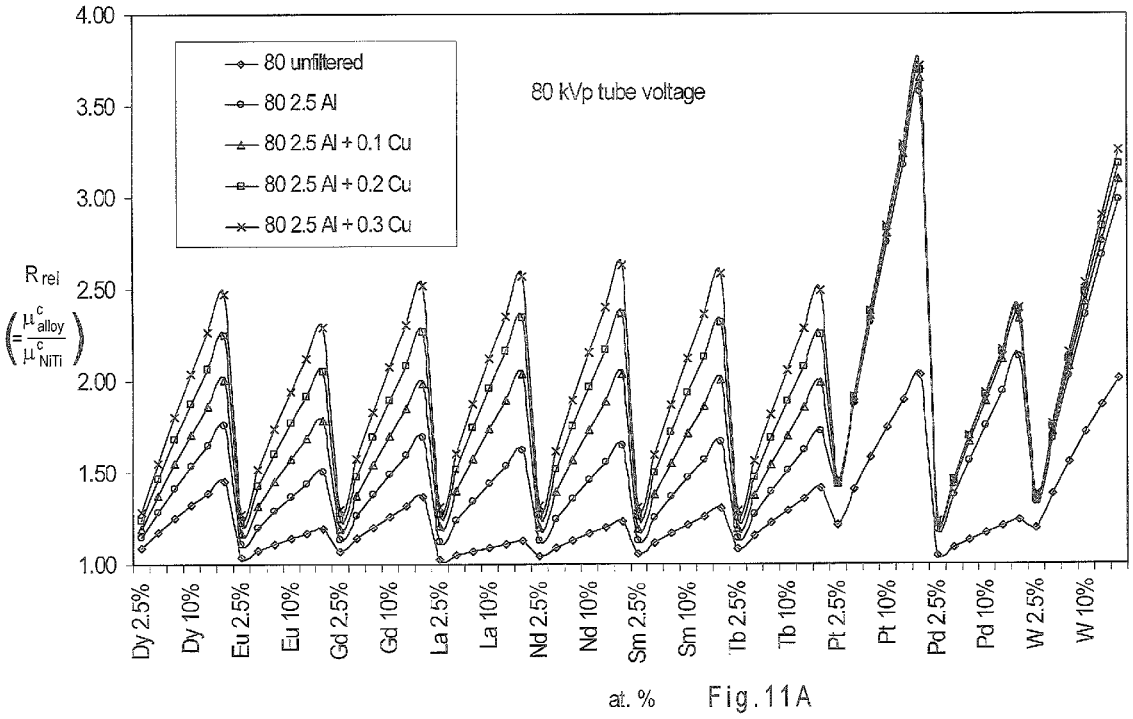
FIG. 11A and FIG. 11B are graphs of the radiopacity of various Ni—Ti-RE alloys relative to that of a near-equiatomic binary nickel-titanium alloy for a 80 kVp tube voltage and several filtration schemes.
Figure 11B:
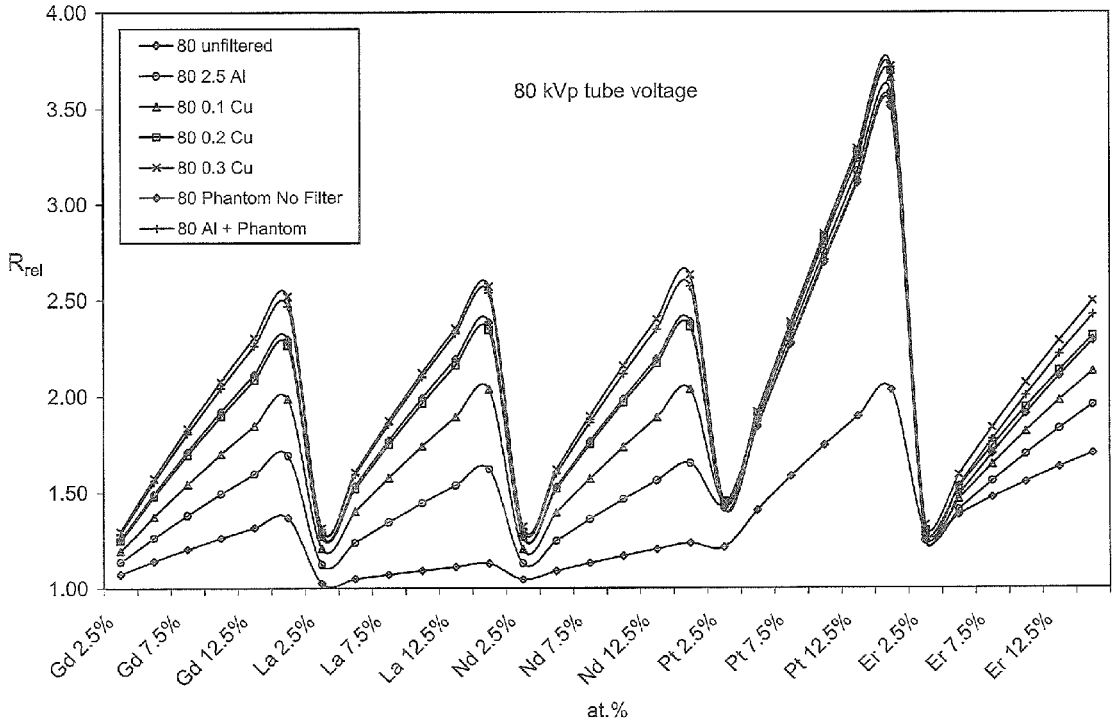
Figure 12:
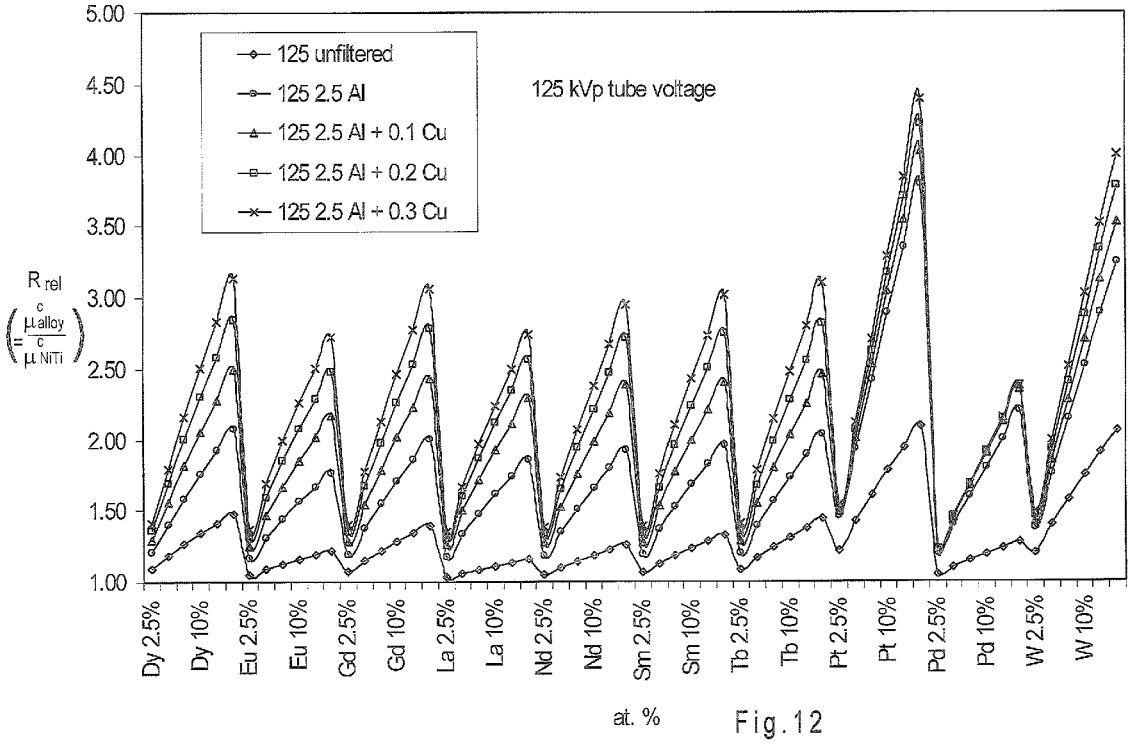
FIG. 12 is a graph of the radiopacity of various Ni—Ti-RE alloys relative to that of near-equiatomic binary nickel-titanium alloy for a 125 kVp tube voltage and several filtration schemes.

The x-ray beam emitted from the x-ray tube is not monochromatic, but rather includes a distribution of photons over a range of energies. Referring to FIGS. 4A-4D, the x-ray photons have a maximum energy corresponding to the tube voltage. For example, at a tube voltage of 70 kVp (see FIG. 4B), the maximum energy of the x-ray beam is 70 keV. The x-ray beam has a peak intensity (maximum number of photons) at an energy corresponding to about one-third of the maximum photon energy. The peak intensity may be shifted to higher energies, however, by the use of one or more filters. Other attenuation effects, such as passage of the x-ray beam through body tissue, also may cause a shift of the maximum intensity to higher energies, a phenomenon that may be referred to as beam hardening. For example, as shown in FIG. 4B, the peak intensity of the x-ray beam may be shifted to about 45 keV from about 35 keV by including a 0.2 mm copper filter in addition to a 2.5 mm aluminum filter between the x-ray source and the patient. By replacing the 0.2 mm copper filter with a 0.3 mm copper filter, the peak intensity of the x-ray beam may be shifted to about 50 keV. Generally speaking, the one or more filters may cause a shift of between 5 keV and 30 keV in the peak intensity of the radiation passing through the filter.

The intensity of x-rays transmitted through a material $I_x$ is related to the incident intensity $I_0$, material thickness x, and the linear absorption coefficient μ:

$$I_x = I_0 e^{-\mu x}$$

Materials or tissues that substantially transmit incident x-rays are not readily visible in x-ray images. In contrast, radiopaque materials absorb incident x-rays over a given energy range and tend to show high contrast and good visibility in x-ray images. The magnitude of the linear absorption coefficient of a material may be a good indicator of its capacity for absorbing x-ray radiation, and thus its radiopacity.

Linear absorption coefficients were calculated for several Ni—Ti-RE alloy compositions using a software program called XMuDat developed by Robert Nowotny of the Institut f. Biomed. Technik and Physik at the University of Wien, Wien, Austria. XMuDat is a computer program for the presentation and calculation of various photon interaction coefficients for materials of dosimetric interest. Data for mass attenuation-, mass energy transfer- and mass energy absorption coefficients in a photon energy range of 1 keV to 50 MeV are available. For calculation the program uses photon interaction coefficients collected from J M. Boone, A E. Chavez; *Medical Physics* 23, 12 (1996) 1997-2005.

The effects of various diagnostic x-ray tube voltages and filtration schemes were considered, as summarized in Table 10 below. The raw data for unfiltered photons at various tube voltages were taken from Horst Aichinger, Joachim Dierker, Sigrid Joite-Barfuβ and Manfred Säbel, *Radiation Exposure and Image Quality in X-Ray Diagnostic Radiology: Physical Principles and Clinical Applications*, Springer: Berlin. The polychromatic nature of the x-ray beam generated from a W/Re anode and the role of beam attenuation with various filters also were taken into account.

TABLE 10

Parameters of Linear Absorption Coefficient Calculations

| Parameter | Range Considered |
|---|---|
| Tube voltage | 40 kVp-125 kVp |
| Filtration | Unfiltered |
| | 2.5 mm Al |
| | 2.5 mm Al + 0.1 mm Cu |
| | 2.5 mm Al + 0.2 mm Cu |
| | 2.5 mm Al + 0.3 mm Cu |
| Rare earth (RE) addition | Dy, Eu, Gd, La, Nd, Sm, Tb |
| Concentration of RE addition | 2.5, 5, 7.5, 10, 12.5, and 15 at. % |

As a first step in the calculations, mass absorption coefficients $A_{alloy}$ for various alloy compositions were calculated using a rule of mixtures approach:

$$A_{alloy} = pA_{Ni} + qA_{Ti} + rA_{RE}$$

where $$p = \frac{aM_{Ni}}{(aM_{Ni} + bM_{Ti} + cM_{RE})}$$

$$q = \frac{bM_{Ti}}{(aM_{Ni} + bM_{Ti} + cM_{RE})}$$

$$r = \frac{cM_{RE}}{(aM_{Ni} + bM_{Ti} + cM_{RE})}$$

The variables $A_{Ni}$, $A_{Ti}$, and $A_{RE}$ represent elemental mass absorption coefficients, which are equivalent $\mu/\rho$ to for each element. The variables $M_{Ti}$, $M_{Ni}$, and $M_{RE}$ represent the molecular weight of each element and a, b, and c are atomic percentages of each element in the alloy. It was assumed in estimating the atomic percentages that the rare earth element substituted for titanium. This assumption was made based on the closer proximity of the rare earth elements to titanium than to nickel in the periodic table. Since the radiopacity of nickel is comparable to the radiopacity of titanium in the energy range of interest for diagnostic x-ray procedures, the specifics of the substitution are believed to be less important than the atomic percentage of the rare earth element in the Ni—Ti-RE alloy.

Once the mass absorption coefficient $A_{alloy}$ was obtained for a given alloy composition, the linear absorption coefficient $\mu_{alloy}$ was calculated as the product of $A_{alloy}$ and the density $\rho_{alloy}$ of the alloy. The density $\rho_{alloy}$ was calculated using the same rule of mixtures approach as above.

Next, a cumulative linear absorption coefficient $\mu_{alloy}{}^{C}$ was calculated for each alloy composition to take into account the polychromatic nature of the x-ray beam. Using x-ray intensity distributions for a W/Re anode at various x-ray tube voltages and with different levels of filtration, photon probability distributions were calculated. Cumulative linear absorption coefficients $\mu_{alloy}{}^{C}$ were obtained for various tube voltages and filtration levels by multiplying the values of $\mu_{alloy}$ determined above by the respective photon probability at a given energy and then summing the values over the entire energy spectrum. The resulting values of $\mu_{alloy}{}^{C}$, or radiopacity, are shown in graphical form in FIGS. 5-8 for various Ni—Ti-RE alloy compositions in atomic percent (at. %), tube voltages and filtration schemes. Calculated data also are presented for Ni—Ti—Pt, Ni—Ti—Pd, and Ni—Ti—W alloys for comparison.

It is desirable that the Ni—Ti-RE alloys exhibit improved radiopacity compared to a binary Nitinol alloy. Therefore, the cumulative linear absorption coefficients $\mu_{alloy}{}^{C}$ obtained for various Ni—Ti-RE alloy compositions were normalized to the cumulative linear absorption coefficient $\mu_{NiTi}{}^{C}$ of binary Nitinol, thus obtaining values of relative radiopacity $R_{rel}$, i.e., $$\left(R_{rel} = \frac{\mu^{C}_{alloy}}{\mu^{C}_{NiTi}}\right).$$

Figure 20:
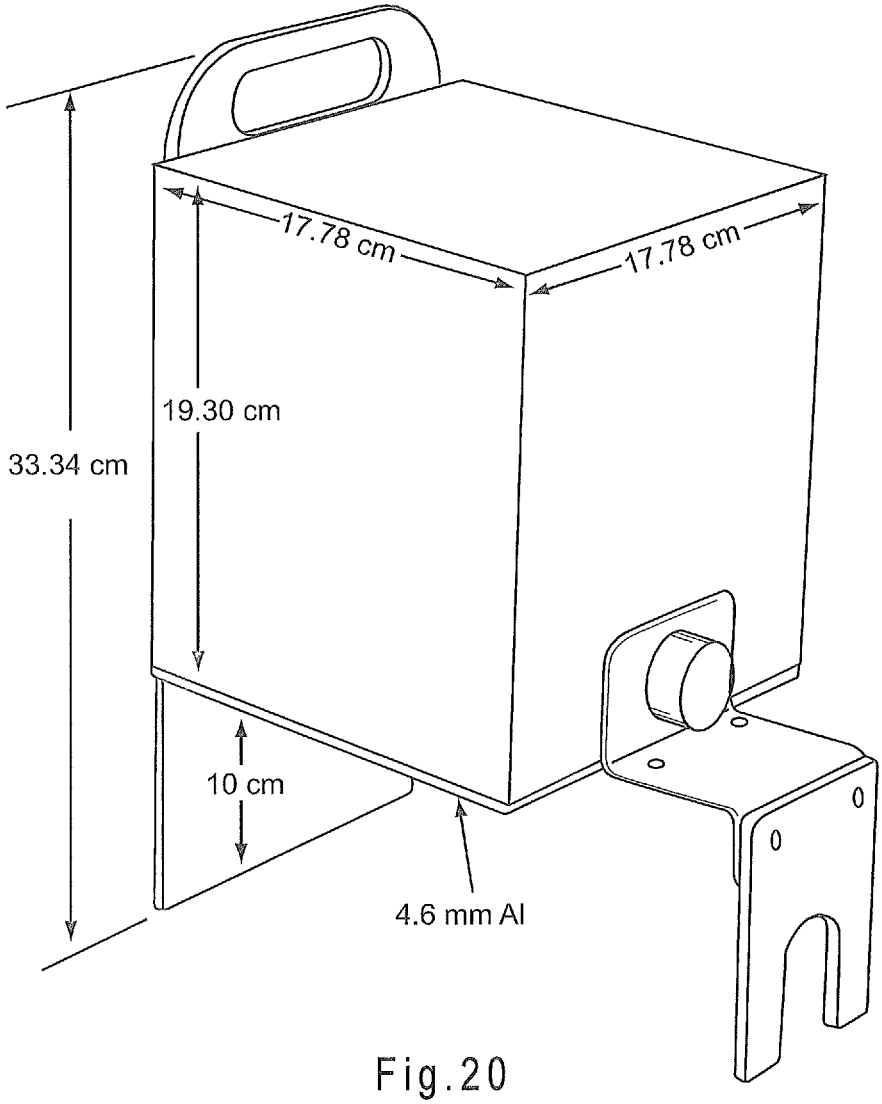
FIG. 20 is a schematic of a phantom developed by the Center for Devices and Radiological Health (CDRH) to simulate x-ray attenuation through the lower abdomen of a typical adult.

A slightly nickel-rich composition of 50.6 at. % Ni was assumed in calculating $\mu_{NiTi}{}^{C}$ for binary Nitinol. Using this approach, it is possible to compare the radiopacity of the Ni—Ti-RE alloys to the radiopacity of a near-equiatomic binary Ni—Ti alloy. The relative radiopacity values $R_{rel}$ are shown in graphical form in FIGS. 9-12 for various Ni—Ti-RE alloy compositions in atomic percent (at. %), tube voltages and filtration schemes (e.g., unfiltered, Al filter, Cu filter, or CDRH phantom, which is described later and shown in FIG. 20). Calculated data also are presented for Ni—Ti—Pt, Ni—Ti—Pd, and Ni—Ti—W alloys for comparison.

The calculated data in FIGS. 9-12, show that the radiopacity of the Ni—Ti-RE alloys is greater than that of a near-equiatomic binary nickel-titanium alloy. The Ni—Ti-RE alloys have a cumulative absorption coefficient $\mu_{alloy}{}^{C}$ (radiopacity) ranging from greater than about 1 to about 3.2 times that of a near-equiatomic binary nickel-titanium alloy when exposed to radiation having an energy in the range of from 15 keV to 125 keV. This is shown, for example, in FIG. 12, which corresponds to a tube voltage of 125 kVp. The Ni—Ti-RE alloys have a cumulative absorption coefficient $\mu_{alloy}{}^{C}$ (radiopacity) ranging from greater than about 1 to about 2.7 times that of a near-equiatomic binary nickel-titanium alloy when exposed to radiation having an energy in the range of from 15 keV to 80 keV, as shown, for example, in FIG. 11A, which corresponds to a tube voltage of 80 kVp. The Ni—Ti-RE alloys have a cumulative absorption coefficient $\mu_{alloy}{}^{C}$ (radiopacity) ranging from greater than about 1 to about 2.5 times that of a near-equiatomic binary nickel-titanium alloy when exposed to radiation having an energy in the range of from 15 keV to 70 keV, as shown, for example, in FIG. 10, which corresponds to a tube voltage of 70 kVp.

By using more than one rare earth element and/or additional alloying elements in the nickel-titanium alloy, the radiopacity may be increased in a cumulative manner consistent with the radiopacity of the individual alloying elements.

Preferably, the nickel-titanium alloy has a radiopacity in the range of from greater than about 1 to about 8 times that of a near-equiatomic binary nickel-titanium alloy (i.e., the relative radiopacity $R_{rel}$ is in the range of from about 1 to about 8) when exposed to radiation having an energy in the range of from 15 keV to 150 keV. The radiopacity of the nickel-titanium alloy also may be in the range of from greater than about 1 to about 8 times that of a near-equiatomic binary nickel-titanium alloy when the alloys are exposed to radiation in the range of from 15 keV to 125 keV. According to other embodiments, the radiopacity may be in the range of from greater than about 1 to about 8 times that of a near-equiatomic binary nickel-titanium alloy when the alloys are exposed to radiation in the range of from 15 keV to 80 keV, from 15 keV to 70 keV, or from 15 keV to 60 keV.

More preferably, the nickel-titanium alloy has a radiopacity in the range of from about 1.2 to about 8 times that of a near-equiatomic binary nickel-titanium alloy (i.e., the relative radiopacity $R_{rel}$ is in the range of from about 1.2 to about 8) when exposed to radiation having an energy in the range of from 15 keV to 150 keV. The radiopacity of the nickel-titanium alloy also may be in the range of from about 1.2 to about 8 times that of a near-equiatomic binary nickel-titanium alloy when the alloys are exposed to radiation in the range of from 15 keV to 125 keV. According to other embodiments, the radiopacity may be in the range of from about 1.2 to about 8 times that of a near-equiatomic binary nickel-titanium alloy when the alloys are exposed to radiation in the range of from 15 keV to 80 keV, from 15 keV to 70 keV, or from 15 keV to 60 keV.

Even more preferably, the nickel-titanium alloy has a radiopacity in the range of from about 1.2 to about 5 times that of a near-equiatomic binary nickel-titanium alloy (i.e., the relative radiopacity $R_{rel}$ is in the range of from about 1.2 to about 5) when exposed to radiation having an energy in the range of from 15 keV to 150 keV. The radiopacity of the nickel-titanium alloy also may be in the range of from about 1.2 to about 5 times that of a near-equiatomic binary nickel-titanium alloy when the alloys are exposed to radiation in the range of from 15 keV to 125 keV. According to other embodiments, the radiopacity may be in the range of from about 1.2 to about 5 times that of a near-equiatomic binary nickel-titanium alloy when the alloys are exposed to radiation in the range of from 15 keV to 80 keV, from 15 keV to 70 keV, or from 15 keV to 60 keV.

It may be even more advantageous if the radiopacity of the nickel-titanium alloy is in the range of from about 1.5 to about 5 times greater than that of a near-equiatomic binary nickel-titanium alloy when the alloys are exposed to radiation having an energy within any of the above-mentioned ranges (i.e., from 15 keV to 150 keV, from 15 keV to 125 keV, from 15 keV to 80 keV, from 15 keV to 70 keV, or from 15 keV to 60 keV).

According to a preferred embodiment, the nickel-titanium alloy has a radiopacity in the range of from greater than about 1 to about 8 times that of a near-equiatomic binary nickel-titanium alloy when exposed to radiation having a peak intensity at an energy in the range of from 30 keV to 60 keV. It also is preferable that the radiopacity of the nickel-titanium alloy is in the range of from greater than about 1 to about 8 times that of a near-equiatomic binary nickel-titanium alloy when exposed to radiation having a peak intensity at an energy in the range of from 35 keV to 55 keV, or from 40 keV to 50 keV.

According to another preferred embodiment, the nickel-titanium alloy has a radiopacity in the range of from greater than about 1.2 to about 5 times that of a near-equiatomic binary nickel-titanium alloy when exposed to radiation having a peak intensity at an energy in the range of from 30 keV to 60 keV. It also is preferable that the radiopacity of the nickel-titanium alloy is in the range of from greater than about 1.2 to about 5 times that of a near-equiatomic binary nickel-titanium alloy when exposed to radiation having a peak intensity at an energy in the range of from 35 keV to 55 keV, or from 40 keV to 50 keV.

Again referring to the calculated data shown in FIGS. 9-12, the radiopacity of the Ni—Ti-RE alloys is comparable to or better than that of Ni—Ti—Pd at a tube voltage in the range of from 70 kVp to 125 kVp, depending on the filter selection. FIGS. 9-12 correspond to tube voltages of 40 kVp, 70 kVp, 80 kVp, and 125 kVp, respectively. Referring to FIG. 11A, for example, a nickel-titanium alloy including 7.5 at. % Nd has a relative radiopacity $R_{rel}$ of approximately 1.9 when a 2.5 mm Al filter and 0.3 mm Cu filter are used, whereas a nickel-titanium alloy including 7.5 at. % Pd has a relative radiopacity $R_{rel}$ of about 1.7 under the same conditions. Preferably, the radiopacity of the Ni—Ti-RE alloys is comparable to or better than that of Ni—Ti—Pd at a tube voltage in the range of from 60 kVp to 150 kVp.

It also can be observed from the calculated data that the radiopacity of the Ni—Ti-RE alloys increases at higher concentrations of the rare earth alloying addition. Referring again to FIG. 11A, for example, the maximum radiopacity (largest value of $\mu_{rel}^{C}$) for each alloy composition is achieved at the highest rare earth element concentration (15 at. %) considered in the calculations.

Additional data showing improvements in the x-ray opacity of Ni—Ti-RE alloys containing varying amounts of Er along with, in some alloys, Pd, Cr, and/or B are presented in FIGS. 23A to 23F. The data were obtained at different tube voltages, specifically, 70 kV, 80 kV, 90 kV, 100 kV, 110 kV, and 125 kV for samples of about 0.5 mm in thickness and about 0.75 mm in thickness. The bar graphs show the improvement in radiopacity of the respective alloys compared to binary Ni—Ti of similar thickness. The alloys designated in the graphs have the compositions indicated in Table 11 below.

TABLE 11

Composition of Specimens Examined in CF Mode Static Images

| Designation in Graphs | Composition |
|---|---|
| Pt | Ni—Ti-7.5 at. % Pt |
| Comp 3 | Ni—Ti-4.5 at. % Er + 35 ppm B |
| Comp 4 | Ni—Ti-6 at. % Er + 35 ppm B |
| Comp 8 | 50.50 Ni—44.50 Ti—3.00 Er—2.00 Pd (at. %) |
| Comp 9 | 50.25 Ni—44.50 Ti—3.00 Er—2.00 Pd—0.25 Cr (at. %) |
| Comp 10 | 50.75 Ni—45.00 Ti—2.25 Er—2.00 Pd (at. %) |
| Comp 11 | 50.50 Ni—45.00 Ti—2.25 Er—2.00 Pd—0.25 Cr (at. %) |
| SS1 | Ni—Ti-7.5 at. % Er |
| SS2 | Ni—Ti-10 at. % Er |
| SS3 | Ni—Ti-12.5 at. % Er |
| SS4 | Ni—Ti-15 at. % Er |

The data were obtained based on the previously presented relationship between the intensity of x-ray transmission through a material and other variables (incident intensity, thickness, etc.), which can be rewritten as:

$$T = \frac{I_1}{I_0} = e^{-\mu x}.$$

When viewing x-ray images on a screen or printout, a doctor sees the different regions of darkness and brightness in a gray scale defined by the Hounsfield Scale, which defines air at a value of −1000 and water at a value of 0, with denser materials having a higher value. However, the actual performance of a material is based on its attenuation, which depends on both the material and its thickness. Its brightness on-screen is determined by how much of the on-coming x-rays it blocks: the more photons blocked, the brighter it appears. Thus, the brightness a doctor sees will depend on how many photons are shined on the sample (the incident intensity or photon flux).

In an ideal situation, all samples receive the same photon flux, but the realities of both the x-ray emitter and the imaging device make this unlikely. Thus, samples of the same thickness and material may not exhibit the same brightness if they are in areas of different photon flux. A way to obtain an objective measure of their visibility is to benchmark each sample against the photon flux it is receiving, determined by the background around it.

If the materials attenuation $\mu$ and thickness x remain the same, then the transmission T is the same. What varies is $I_0$, the photon flux, measured from the brightness of the background, and $I_1$, the brightness of the sample. Thus, T is found by dividing $I_1$ by $I_0$, and will be the same regardless of position.

The brightness of samples in x-ray images are measured on a scale from −1024 (total darkness) to +3056 (total brightness) on the Hounsfield scale. These are adjusted to fraction of possible photon flux: −1024 becomes 1 (total darkness on an x-ray image means all photons get through), and +3056 becomes 0 (total brightness means all photons are stopped).

For example, two samples of the same material and thickness are in the same picture, but in different regions. One has a brightness of 2356 and a background of 1656, which is a difference of 700. The other has a brightness of 2156 and a background of 1256, which is a difference of 900. The two appear to have different relative improvements in brightness in grayscale, but once an adjustment is made for the true "top" of the scale, 3056:

$$\frac{2356-3056}{1656-3056}=\frac{2156-3056}{1256-3056}=0.5$$

Both are now the same, as they should be. Results for the CF mode static images, as modified by the above-described method, are provided in FIGS. 23A to 23F. As the data show, the alloys including the highest amounts of rare earth alloying elements show the largest improvement in x-ray visibility compared to binary Ni—Ti alloys. Generally speaking, the improvement ranges from about 5% to over 60%, depending on the composition and thickness of the alloy.

In addition to considering the impact of the rare earth element(s) on the radiopacity of the nickel-titanium alloy, it also is desirable to consider the impact on the superelastic and mechanical properties of the alloy. The improved radiopacity achieved at high concentrations of rare earth elements preferably may be balanced against the effects of high concentrations of alloying elements on the superelastic and mechanical properties of the nickel-titanium alloy.

According to a preferred embodiment, the nickel-titanium alloy exhibits superelastic or shape memory behavior. That is, the nickel-titanium alloy undergoes a reversible phase transformation that allows it to "remember" and return to a previous shape or configuration. The nickel-titanium alloy transforms between a lower temperature phase (martensite) and a higher temperature phase (austenite). Austenite is characteristically the stronger phase, and martensite may be deformed up to a recoverable strain of about 8%. Strain introduced in the alloy in the martensitic phase to achieve a shape change may be substantially recovered upon completion of a reverse phase transformation to austenite, allowing the alloy to return to a previous shape. The strain recovery may be driven by the application and removal of stress (superelastic effect) and/or by a change in temperature (shape memory effect).

Figure 13:
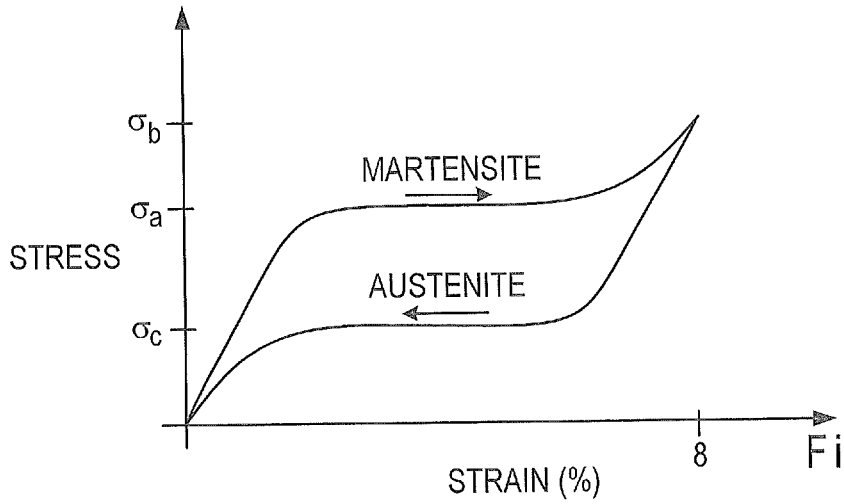
FIG. 13 is a diagram of stress versus strain for an exemplary shape memory alloy at a temperature above an austenitic final temperature of the alloy.

The stress-strain diagram in FIG. 13 illustrates the superelastic effect for an exemplary nickel-titanium alloy at a temperature above the austenitic final temperature ($A_f$) of the alloy. Upon application of a stress $\sigma_a$, an alloy in a first configuration begins to transform from austenite to martensite as a result of the formation of stress-induced martensite. The martensitic phase of the alloy can accommodate several percent strain at a nearly constant stress. At a stress of $\sigma_b$, which corresponds to 8% strain in this example, the martensitic transformation is complete and the alloy has been deformed to a second configuration. Upon release of the stress, the martensite begins to transform back to austenite and the alloy recovers the strain at a lower plateau stress of $\sigma_c$. The nickel-titanium alloy thus returns to the first configuration.

Figure 14:
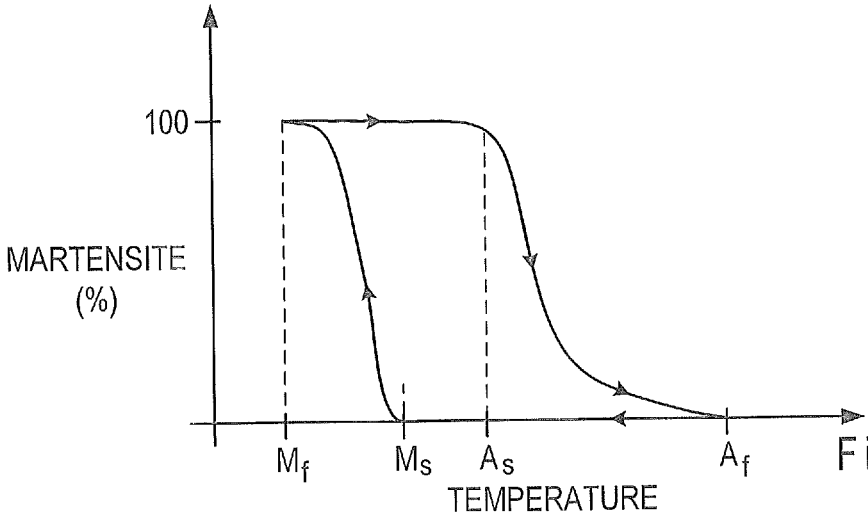
FIG. 14 is a transformation temperature curve for an exemplary shape memory alloy.

FIG. 14 shows a typical transformation temperature curve for an exemplary nickel-titanium shape memory alloy, where the y-axis represents the amount of martensite in the alloy and the x-axis represents temperature. At or above a temperature of $A_f$, the nickel-titanium alloy has a fully austenitic structure. Following the arrows, the alloy may be cooled to a temperature of $M_s$, at which point the transformation to the martensitic phase begins. Further cooling leads to an increase in the percentage of martensite in the material, ultimately leading to a fully martensitic structure at a temperature of $M_f$, as shown in FIG. 14.

Figure 15:
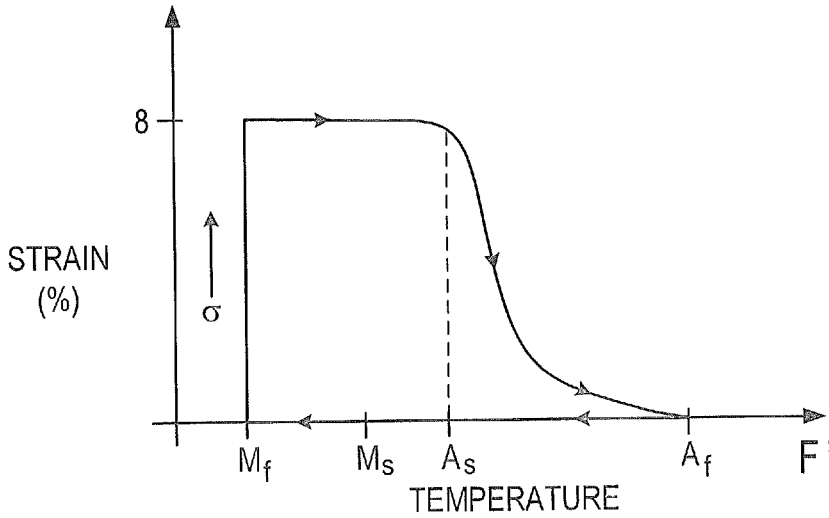
FIG. 15 is a diagram of strain versus temperature for an exemplary shape memory alloy.

Now referring also to FIG. 15, which shows strain versus temperature for an exemplary nickel-titanium shape memory alloy, the fully martensitic structure attained at a temperature of $M_f$ may be strained from a first configuration to a second configuration (as shown by the stress symbol $\sigma$). The alloy may accommodate several percent recoverable strain (8% in this example). To reverse the phase transformation and recover the strain, the temperature of the alloy is increased. Again following the arrows, the nickel-titanium alloy may be warmed to a temperature of $A_s$, at which point the alloy begins to transform to the austenitic phase. Upon further heating, the transformation to austenite progresses and the alloy gradually recovers the first configuration. Ultimately, at a temperature of $A_f$ or higher, the material has completed the return transformation to the austenitic phase (0% martensite) and has fully recovered the 8% strain.

According to one embodiment, the nickel-titanium alloy may include an intermediate temperature R-phase in addition to the higher temperature austenitic phase and the lower temperature martensitic phase. In other words, the R-phase may appear prior to martensite upon cooling from austenite. Similarly, the R-phase may appear prior to austenite upon heating from martensite. Whether or not the nickel-titanium alloy includes the R-phase depends on the composition and processing history of the alloy.

For the purposes of this disclosure, a nickel-titanium alloy that provides a substantial amount of recoverable strain (i.e., an elastic strain of at least about 0.5%) upon the removal of a deforming stress may be referred to as a superelastic alloy, whether or not the behavior is driven by phase transformations between martensite and austenite. For example, a recoverable strain of about 0.75% may be obtained by stress- and/or temperature-induced phase transformations between austenite and the R-phase (*Using Nitinol Alloys*, Johnson Mathey, San Jose, Calif. (2004) p. 17). It also is known that cold-worked martensitic nickel-titanium alloys can provide a recoverable strain of several percent (e.g., 3-4%) without a phase transformation to austenite (Duerig, T. W. et al., Linear Superelasticity in Cold-Worked Ni—Ti, *Engineering Aspects of Shape Memory Alloys*, Butterworth-Heinemann Ltd., London (1990) pp. 414-419). Preferably, the nickel-titanium alloy of the present disclosure provides a recoverable strain in the range of from about 0.5% to about 10%. More preferably, the recoverable strain is in the range of from about 2% to about 10%. Even more preferably, the recoverable strain is in the range of from about 3% to about 10%. Most preferably, the recoverable strain is in the range of from about 5% to about 10%.

Preferably, the medical device includes at least one component comprising the nickel-titanium alloy described herein. The component may be formed in whole or in part of the nickel-titanium alloy from wire, tubing, ribbon, button, bar, disk, sheet, foil, or another cast or worked shape. According to one embodiment, the component has a composite structure in which one or more portions of the structure are formed of the Ni—Ti-RE alloy, and one or more portions of the structure are formed of a different material. For example, the component may include distinct constituents, such as layers, cladding, filaments, strands, cables, particles, fibers, and/or phases, where one or more of the constituents are formed from the Ni—Ti-RE alloy, and one or more are formed from the different material. The different material may be a near-equiatomic binary nickel-titanium alloy, according to one embodiment, or a material including one or more elements selected from the group consisting of: Al, Cr, Mn, Fe, Co, Cu, Zn, Ga, Ge, Tc, Cd, In, Sn, Sb, Hg, Tl, Pb, Bi, Po, V, Ir, Pt, Au, Re, W, Pd, Rh, Ta, Ag, Ru, Hf, Os, Zr, Nb, and Mo. Such a composite structure may provide a component having improved radiopacity and optimized superelastic and/or mechanical properties compared to a monolithic component.

Figure 16:
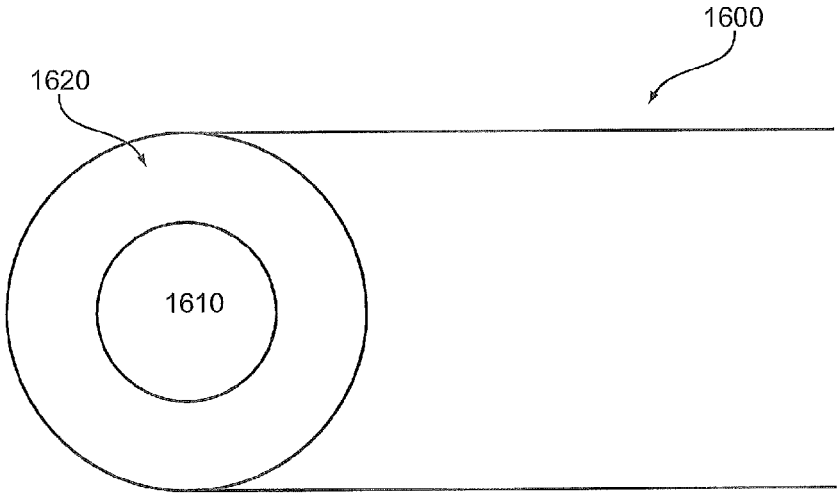
FIG. 16 is a schematic of an exemplary wire having a composite structure including at least one layer formed of a Ni—Ti-RE alloy.

The component including the nickel-titanium alloy described herein may include at least one wire. The wire may have a composite structure including, for example, a core layer and one or more outer layers disposed about the core layer. Preferably, one or more of the layers are formed of the Ni—Ti-RE alloy. One or more of the layers may be formed of a different material. The different material may be a binary nickel-titanium alloy or a material including one or more of the elements mentioned above. According to the embodiment shown in FIG. 16, the wire 1600 may include a core layer 1610 made of the Ni—Ti-RE alloy and an outer layer 1620 made of a near-equiatomic binary nickel-titanium alloy. Alternatively, the core layer 1610 may be made of the near-equiatomic binary nickel-titanium alloy and the outer layer 1620 may be made of the Ni—Ti-RE alloy. The wire 1600 may be formed by, for example, drawing or extruding a preform including multiple coaxial layers to form the composite structure. Alternatively, the wire 1600 may be formed by coating one or more layers on a core layer by plating or another deposition technique.

Figure 17A:
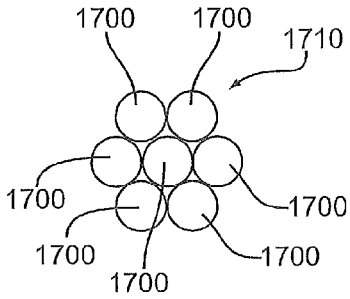
FIG. 17A is a cross-sectional schematic of an exemplary cable formed from seven wire strands, where one or more of the strands are formed of a Ni—Ti-RE alloy.
Figure 17B:
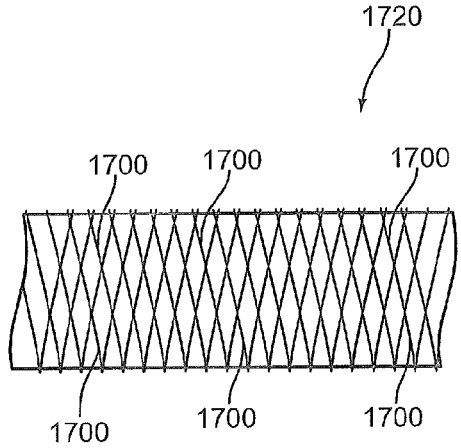
FIG. 17B is a side view schematic of an exemplary braided wire structure, where one or more strands of the wire structure are formed of a Ni—Ti-RE alloy.

The component may include two, three, four, five, six, or more wires, according to one embodiment, where each wire is made in whole or in part of the nickel-titanium alloy of the present disclosure. It also is contemplated that one or more of the wires may be made in whole or in part of a different material, such as a near-equiatomic binary nickel-titanium alloy or a radiopaque metal. Referring to FIGS. 17A and 17B, for example, the component may include a plurality of wire strands 1700 in a twisted configuration 1710 (e.g., a cable) or a plurality of wire strands 1700 in a braided configuration 1720, where one or more of the strands are made of the Ni—Ti-RE alloy and one or more of the strands are made of a near-equiatomic binary nickel-titanium alloy.

Figure 18:
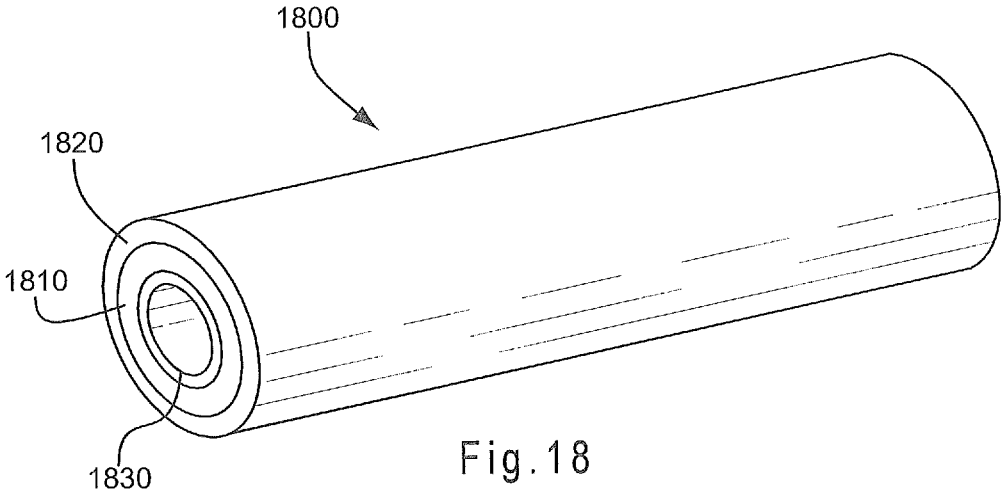
FIG. 18 is a schematic of an exemplary cannula having a composite structure, where one or more layers of the cannula are formed of a Ni—Ti-RE alloy.

According to another embodiment, the component comprises a tube or "cannula," to use terminology common in the medical device community. The cannula may have a composite structure. According to one embodiment, the cannula may be formed from a multilayered tube. Referring for example to FIG. 18, the cannula 1800 may include one or more coaxial layers 1810 of Ni—Ti-RE and one or more coaxial layers 1820, 1830 of another material, such as a binary nickel-titanium alloy or a radiopaque metal. The multilayered tube may be formed by drawing or extruding coaxial tubing. Alternatively, the multilayered tube may be prepared from a clad sheet that has been formed into a tube.

According to another embodiment, the component comprises another cast or worked shape, such as a ribbon, button, bar, rivet, sphere, disk, sheet, or foil.

The above described components may be employed individually or in combination as part of an insertable or implantable medical device, such as, for example, a stent, a stent graft, a wire guide, a radiopaque marker or marker band, a torqueable catheter, an introducer sheath, an orthodontic arch wire, or a manipulation, retrieval, or occlusive device such as a grasper, a snare, a basket (e.g., stone extraction or manipulation basket), a vascular plug, or an embolic protection filter.

Figure 19:
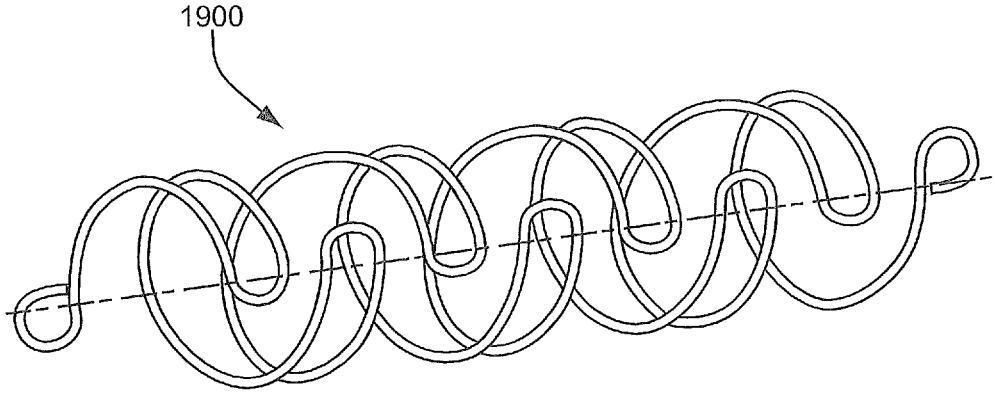
FIG. 19 is a schematic of an exemplary stent formed from one or more wires, where all or a portion of the wires is formed of a Ni—Ti-RE alloy.

According to one embodiment, the device is a stent. All or a portion of the stent may be made of the nickel-titanium alloy. The stent may further include a graft material attached thereto. Preferably, the stent is a self-expanding stent. However, balloon-expandable stents also may benefit from the Ni—Ti-RE alloy of the present disclosure. The stent may be formed from one or more wires or cut (e.g., laser cut) from a tube (cannula) using techniques known in the art. The cannula may have a composite structure as described above. According to another embodiment shown in FIG. 19, the stent 1900 may have a wire structure including one or more wires. A portion of the wire structure may be formed of Ni—Ti-RE and a portion of the wire structure may be formed of a different material, such as a binary nickel-titanium alloy. The one or more wires of such a stent may be formed as described above. The stent may further include a therapeutic surface coating comprising a drug such as, for example, paclitaxel. The therapeutic surface coating may help to prevent, for example, re-stenosis and the build-up of minerals at the treatment site.

According to another embodiment, the device is a radiopaque marker or marker band ("marker") that provides high x-ray contrast. Such a radiopaque marker may be more readily bonded to a nickel-titanium medical device than radiopaque markers formed of other materials (e.g., Pt or Au) due to the similarity between Ni—Ti-RE and binary nickel-titanium. In addition, Ni—Ti-RE radiopaque markers may better resist galvanic corrosion than other materials when used with nickel-titanium based devices. According to one embodiment, the superelastic properties of a Ni—Ti-RE radiopaque marker may aid in attaching the marker to a catheter, stent, wire guide or other medical device. The marker may be designed to fully expand or contract at or above a temperature corresponding to $A_f$ of the Ni—Ti-RE alloy to facilitate the securing of the marker to the device. For example, a Ni—Ti-RE marker band may shrink to fit around a catheter, or a Ni—Ti-RE marker may expand to fit securely within an eyelet of a stent. Ni—Ti-RE radiopaque markers may be formed by mechanical working techniques known in the art, such as swaging, and marker bands may be cut from thin-walled Ni—Ti-RE tubes.

A method of imaging a medical device within a patient according to the present disclosure includes delivering a medical device having at least one component made from a nickel-titanium alloy including from about 34 at. % to about 60 at. % nickel, from about 34 at. % to about 60 at. % titanium, and from about 0.1 at. % to about 15 at. % at least one rare earth element to a site in a patient. The rare earth element is selected from the group consisting of La, Pr, Nd, Pm, Sm, Eu, Gd, Tb, Dy, Ho, Er, Tm, Yb, Lu, Ac, Th, Pa, and U.

The patient is then preferably exposed to radiation having an energy in the range of from 15 keV to 125 keV to image the medical device. More preferably, the energy is in the range of from 15 keV to 80 keV for imaging. Even more preferably, the energy is in the range of from 15 keV to 70 keV, or from 15 keV to 60 keV, for imaging. It is also preferred that the radiation has a peak intensity at an energy in the range of from 30 keV to 60 keV. More preferably, the radiation has a peak intensity at an energy in the range of from 35 keV to 55 keV. Even more preferably, the radiation has a peak intensity at an energy in the range of from 40 keV to 50 keV.

To expose the patient to the radiation, the patient may be situated in opposition to an x-ray source with at least one filter disposed between the x-ray source and the patient. The filter may be an aluminum filter (e.g., a 2.5 mm aluminum filter) and/or a copper filter (e.g., a 0.1 mm copper filter, 0.2 mm copper filter, or a 0.3 mm copper filter), for example. The x-ray source preferably operates at a voltage ("tube voltage") in the range of from 60 kVp to 150 kVp.

A method of using a medical device according to the present disclosure includes providing a medical device including at least one component comprising the nickel-titanium alloy. The medical device (e.g., a stent, stent graft, retrieval device, or an embolic protection filter) may be loaded into a delivery system, according to one aspect of the method. The medical device may then be inserted into a patient and then delivered to a treatment site in the patient. When positioned at the treatment site, the device may be deployed. The superelastic and/or the shape memory effect may be used to deliver and deploy the medical device.

According to a preferred embodiment in which the superelastic effect is utilized for delivery and deployment, the device may be maintained in a delivery configuration by a constraining member. For example, a self-expandable stent is typically maintained at a compressed diameter for delivery within a vessel by a tubular delivery sheath which overlies the stent. When the constraining member (e.g., the delivery sheath) is removed and the stress is released, the martensite transforms to austenite and the medical device may reach (recover) its deployed configuration. For example, the self-expandable stent may expand from the compressed diameter to an expanded diameter and come into contact with the vessel wall. The radiopacity of the alloy aids in positioning the device in the desired location in the body passageway during delivery and deployment.

According to this embodiment, the nickel-titanium alloy has an austenite finish temperature ($A_f$) which is less than or equal to human body temperature (37° C.) so that removal of the constraining member is sufficient to trigger the transformation to the austenitic phase. Preferably, the $A_f$ may be in the range of from about −15° C. to about 37° C. Even more preferably, the $A_f$ may be in the range of from about −15° C. to about 20° C. An austenite start temperature ($A_s$) of the nickel-titanium alloy is preferably in the range of from about −25° C. to about 20° C., according to one embodiment.

Alternatively, the shape memory effect may be utilized to deliver and deploy the medical device comprising the nickel-titanium alloy. In other words, a change in temperature instead of an applied (removed) stress may control the transformation from martensite to austenite. For example, the stent of the previous example may be deployed by heating instead of retraction of a delivery sheath. According to this embodiment, the nickel-titanium alloy has an austenite finish temperature ($A_f$) which is less than or equal to body temperature (37° C.). The medical device is maintained at a temperature of less than $A_f$, and preferably less than $A_s$, prior to and during delivery of the device into the body, thereby maintaining a martensitic structure of the nickel-titanium alloy. The device transforms to the austenitic structure and thus deploys when warmed up to about body temperature. Cooling of the device during delivery is desirable to prevent the martensitic structure from prematurely transforming to austenite. As the device is being advanced in the body, the cooling may entail keeping the device at a temperature below $A_s$ by, for example, flushing a cold fluid through the device or through a delivery system of the device. Preferably, the nickel-titanium alloy has a value of $A_f$ of at least about 27° C., although an $A_f$ of less than about 27° C. also is possible. Even more preferably, the nickel-titanium alloy has a value of $A_f$ of at least about 32° C. It also is preferred that $A_f$ is no higher than about 37° C.

In another example utilizing the shape memory effect, the $A_f$ of the nickel-titanium alloy is greater than body temperature (37° C.) but below a temperature that may be damaging to nearby tissue. Preferably, the $A_f$ is at least about 38° C. It also is preferred that the $A_f$ is no higher than about 58° C. More preferably, the $A_f$ is no higher than about 50° C. According to this embodiment, the medical device is advanced through the body to the treatment site without the need for cooling or a constraining member to maintain a martensitic structure. When the device is in place at the treatment site, the device is warmed up to a temperature of $A_f$ or higher to transform the martensite to austenite, and the device deploys to the deployed configuration. The heating may entail, for example, flushing a warm fluid through the medical device or the delivery system for the device. Once the deployed configuration has been obtained, the heating is halted and the device remains in the body passageway in the deployed configuration. To maintain the austenitic structure of the nickel-titanium alloy while the medical device is in place within the passageway, the nickel-titanium alloy may be chosen such that $M_f$, and preferably $M_s$, are below body temperature. Since austenite is stronger than martensite, it is preferable to retain the austenitic phase of the nickel-titanium alloy when the medical device is deployed. If the martensitic finish temperature ($M_f$) and the martensitic start temperature ($M_s$) are not below body temperature, it may be necessary to continuously heat the device during deployment to prevent an unwanted phase transformation to martensite.

The transformation temperatures of the present nickel-titanium alloys may be adjusted as desired by controlling the composition and processing of the alloys. The transformation temperatures are sensitive to small changes in the ratio of nickel to titanium and to the presence of rare earth or other alloying elements. For example, the $A_f$ of stoichiometric NiTi alloys—those having exactly a one-to-one proportion of nickel atoms to titanium atoms—is generally above 100° C., while the $A_f$ of a slightly off-stoichiometric alloy including an excess of nickel (e.g., from about 50.6 to about 50.8 at. % Ni) is generally around 0° C. Increasing the proportion of nickel to titanium in the alloy, therefore, provides a means of reducing the $A_f$ to the desired level.

The presence of rare earth or other alloying elements also can provide an increase or decrease in the transformation temperatures or alter the magnitude of the temperature hysteresis. By selecting the appropriate concentration, type, and/or combination of rare earth alloying elements, $A_f$ and the other transformation temperatures can be fine-tuned to within the desired temperature range. Furthermore, one or more additional alloying elements can be included in combination with the one or more rare earth alloying elements to obtain the desired transformation temperatures. For example, additions of chromium, palladium, cobalt and/or iron may be effective in reducing $A_f$. Additions of vanadium and/or cobalt may be effective in reducing $M_s$. Copper is useful for eliminating the R-phase.

In practice, differential scanning calorimetry (DSC) techniques known in the art may be used to determine the phase transformation temperatures of the phases present in the nickel-titanium alloys. DSC measurements may be carried out according to the American Society for Testing and Materials (ASTM) standard F2004-05 entitled "Standard Test Method for Transformation Temperature of Nickel-Titanium Alloys by Thermal Analysis," which is hereby incorporated by reference. Alternatively, methods known as constant load dilatometry and bend and free recovery may be employed to determine the transformation temperatures. Bend and free recovery tests may be carried out in accordance with the ASTM standard F2082-03 entitled "Standard Test Method for Determination of Transformation Temperature of Nickel-Titanium Shape Memory Alloys by Bend and Free Recovery," which is hereby incorporated by reference. Electrical resistivity measurements also are known in the art for determining the phase transformation temperatures of metals and alloys. Such measurements may be carried out by heating and cooling the alloy of interest while recording voltage using a four-probe constant current technique, for example. Using electrical resistivity measurements, it is possible to characterize phase transformations occurring in the nickel-titanium alloy as a function of applied stress as well as temperature.

According to a preferred embodiment, the nickel-titanium alloy is biocompatible. When introduced into a patient, a biocompatible material or device will not cause an adverse reaction or response in a majority of the patients. The biocompatibility of the nickel-titanium alloy may be assessed according to American Society for Testing and Materials (ASTM) standards F748-04 entitled "Standard Practice for Selecting Generic Biological Test Methods for Materials and Devices," F813-01 entitled "Standard Practice for Direct Contact Cell Culture Evaluation of Materials for Medical Devices," and/or F895-84 entitled "Standard Test Method for Agar Diffusion Cell Culture Screening for Cytotoxicity." Additionally, the International Standards Organization (ISO) Standard No. 10993 and/or the U.S. Pharmacopeia (USP) 23 and/or the U.S. Food and Drug Administration (FDA) blue book memorandum No. G95-1, entitled "Use of International Standard ISO-10993, Biological Evaluation of Medical Devices Part-1: Evaluation and Testing" may be useful in evaluating the biocompatibility of the nickel-titanium alloy and/or a medical device comprising the alloy. The aforementioned standards set forth practices and methods designed for evaluating cytotoxicity, infectivity, pyrogenicity, irritation potential, reactivity, hemolytic activity, carcinogenicity and/or immunogenicity, and are hereby incorporated by reference. Since biocompatibility is a function of the type of bodily tissue contact and the duration of contact, the amount of testing required generally depends on the application. For example, the biocompatibility testing requirements for a short term contacting basket are substantially different from those of a permanently implanted stent.

To produce the nickel-titanium alloys of the present disclosure and medical devices comprising the alloys, a melt including the desired amounts of alloying elements is formed and then cooled into a solid (e.g., an ingot). For example, from about 34 at. % to about 60 at. % nickel, from about 34 at. % to about 60 at. % titanium, and from about 0.1 at. % to about 15 at. % at least one rare earth element may be added to the melt. Up to about 14.9 at. % additional alloy elements may also be included in the melt. High purity raw materials (e.g., Ti>99.7 wt. % purity and Ni>99.99 wt. % purity) are preferably melted in an inert gas or vacuum atmosphere.

Melting methods, including but not limited to vacuum induction melting (VIM), vacuum consumable arc melting (VAR), and electron beam melting, may be employed to form the melt. Remelting is generally desirable to obtain satisfactory microstructural homogeneity in the ingot. For example, successive VAR processes or a VIM/VAR double melting process may be employed.

The ingot may then be hot worked into a first shape (e.g., bar, rod, tube hollow, or plate) by, for example, extruding, hot rolling, or forging. Hot working is generally employed to refine the cast structure of the ingot and to improve mechanical properties. The hot working is generally carried out at temperatures in the range of from about 700° C. to about 950° C., and may require multiple hot working and reheating cycles. The reheating may be carried out over an eight hour period, for example. Preferably, the ingot undergoes a minimum deformation of about 90% during hot working in order to homogenize the as-cast, dendritic microstructure. Prior to hot working, it may be beneficial to carry out a solution heat treatment that involves soaking the ingot at an elevated temperature for a given time duration, followed by quenching. The solution heat treatment may aid in homogenizing the microstructure of the alloy and may be carried out at a temperature in the range of from about 750° C. to about 1150° C., for example. Preferably, in the case of Ni—Ti—Er alloys, the solution heat treatment is carried out at a temperature in the range of from about 750° C. to about 875° C., as discussed further below.

The first shape (e.g., bar, rod, tube, or plate) may then be cold worked into a component by cold drawing or cold rolling, for example. The cold working typically involves several passes in combination with interpass annealing treatments at temperatures in the range of from about 600° C. to about 800° C. The interpass annealing treatments soften the material through recrystallization and growth of the austenite grains between cold work passes, where 30-40% deformation is typically imparted. In some cases, the cold work imparted may range from about 30-50%. If cold drawing is employed to form a wire, for example, a polycrystalline diamond die with a molybdenum disulphide or other suitable lubricant may be employed in order to reduce the drawing stress.

Machining operations, such as, for example, drilling, cylindrical centerless grinding, or laser cutting also may be employed to fabricate the component. Other operations, such as wire braiding or winding, also may be carried out.

A heat treatment is employed to impart a "memory" of a desired final shape and to optimize the shape memory/superelastic and mechanical properties of the component. This is generally referred to as "heat setting." The number, duration and the temperature of the heat setting treatments may alter the transformation temperatures. Typically, heat set temperatures of 350° C. to 550° C. are appropriate to set the final shape and optimize the shape memory/superelastic and mechanical properties. Preferably, the heat setting involves annealing the component while constrained in a final shape at a temperature in the range of from about 350° C. to about 550° C. More preferably, heat setting or annealing temperatures in the range of from 450° C. to 550° C. are appropriate. In alloys having an excess of nickel atoms (e.g., from about 50.6 to about 50.8 at. % Ni), for example, the heat setting treatments described above may cause nickel-rich precipitates to form, thereby reducing the nickel content of the matrix and causing the transformation temperatures to increase. The precipitates also may improve the tensile strength of the nickel-titanium alloy. Precipitation of these nickel-rich particles may be desirable so as to obtain a thermoelastic martensitic phase transformation from austenite.

The inventors have developed an improved method of homogenizing the nickel-titanium-rare earth alloys that leads to better workability. The homogenization heat treatment is carried out after melting and casting of the alloy, but generally prior to further processing of the alloy, as described above. The development of the improved method was motivated by interdendritic cracking and failure that may occur during mechanical working of the Ni—Ti-RE alloys when the microstructure includes an interdendritic cellular network of rare earth-rich intermetallic phases. An objective of the homogenization heat treatment is to avoid formation of and/or break up the interdendritic cellular network to improve the workability and mechanical properties of the alloy.

The method entails heat treating a nickel-titanium-rare earth alloy at a homogenization temperature below a critical temperature for a time duration sufficient for spheroidization of one or more rare earth-rich second phases to occur, where spheroidization refers to the formation of a plurality of discrete particles or precipitates in the alloy. These particles, which may be referred to as spheroids, impart better properties (e.g., ductility and workability) to the alloy than does a brittle interdendritic cellular network. The spheroids are preferably fine in size and well-dispersed, although they need not be spherical. The critical temperature may be an incipient melting temperature of the rare earth-rich second phase. Incipient melting refers to melting of the second phase prior to melting of the matrix of the alloy.

The inventors believe that maintaining the homogenization temperature below the critical temperature allows solid state diffusion and migration of Ni atoms to occur. During this process, the surface energy of the RE-rich phase becomes unfavourable to wet the interdendritic regions, and instead spheroids of RE-rich phases form. Differential thermal analysis (DTA) may be employed to determine the incipient melting temperature of the RE-rich second phase for a given alloy system. In the case of Ni—Ti—Er alloys, the incipient melting temperature has been found to be about 925° C. A similar effect can be seen for Ni—Ti-7.5 at. % Gd, which suggests that the process is applicable to Ni—Ti-RE systems in general.

Table 12 provides values for the incipient melting temperature of the RE-rich second phase in several Ni—Ti-RE alloy systems. The values for the Ni—Ti—Er, Ni—Ti—Gd, and Ni—Ti—Nd systems are based on DTA measurements of alloys including 7.5 at. % Er, Gd, or Nd, and the Ni—Ti—Dy values are based on a phase diagram analysis. The homogenization temperature ranges set forth in the table are expected to be suitable for Ni—Ti-RE alloys over a range of RE concentrations, for example, from about 2.5 at. % RE to about 12.5 at. % RE, or from 5 at. % RE to about 10 at. % RE. In addition, the homogenization temperature ranges set forth also may be suitable for hot working of the respective alloys, as discussed further below.

TABLE 12

Incipient Melting and Homogenization Temperature Ranges for Several Ni—Ti-RE Alloy Systems

| Alloy System | Incipient Melting Temperature | Exemplary Homogenization Temperature Range |
|---|---|---|
| Ni—Ti—Er | ~925° C. | 750-875° C. |
| Ni—Ti—Gd | ~850° C. | 750-840° C. |
| Ni—Ti—Dy | ~1055° C. | 825-950° C. |
| Ni—Ti—Nd | ~800° C. | 550-750° C. |

The spheroidization of the RE-rich phase(s) becomes more favorable as the temperature difference between the homogenization temperature and the incipient melting temperature increases. However, the beneficial effect of homogenization at a lower temperature may be counteracted by the problem that, at too low of a temperature, solid state diffusion may become extremely slow and the spheroidization may not work. The inventors believe that homogenization at a temperature in the range of about 750° C. to about 875° C. may be advantageous for Ni—Ti—Er alloys, based on heat treatment experiments that are described below.

Because the spheroidization process is kinetically driven, the temperature of homogenization is a key factor in breaking down the cellular network of RE-rich phases. The spheroidization does not occur instantaneously, but rather over a suitable time duration. Generally, the time duration for homogenization is from about 24 h to about 72 h.

The alloy that undergoes the homogenization heat treatment may include nickel at a concentration of from about 40 at. % to about 60 at. %, a rare earth element at a concentration of from about 1.5 at. % to about 12 at. %, with the balance of the alloy being titanium. Any of the rare earth elements (RE) mentioned previously may be employed in the homogenized alloy, which also may include from about 3 at. % RE to about 7.5 at. % RE, or from about 4.5 at. % RE to about 6 at. % RE. The alloy may further include boron at a concentration of up to about 0.1 at. %.

Preferably, the rare earth element is erbium and the concentration of erbium is from about 3 at. % to about 7.5 at. %. In another example, the homogenized alloy may include nickel at a concentration of from about 45 at. % to about 55 at. %, erbium at a concentration of from about 4.5 at. % to about 6 at. %, boron at a concentration of from about 0.001 at. % to about 0.1 at. %, with the balance being titanium. For the Ni—Ti—Er alloy system, the critical temperature is about 925° C., and the homogenization temperature may be between about 750° C. and about 875° C. As indicated above, suitable homogenization temperature ranges for other exemplary alloys systems are provided in Table 12.

The homogenization heat treatment is typically carried out in an inert gas (e.g., Ar, He, $N_2$), vacuum, or reducing atmosphere. If the heat treatment is carried out in air, the alloy is generally canned in a Cu—Ni tube, packed in silica or glass beads, or encapsulated in a quartz tube. The method may further entail furnace cooling the alloy after the homogenization heat treatment. Alternatively, the alloy may be water quenched after homogenizing.

To promote solid state diffusion and the consequent spheroidization, pressure may be applied to the alloy while at the homogenization temperature; that is, the alloy may be hot worked during the homogenization heat treatment. Alternatively, the alloy may be hot worked after homogenizing at a temperature below the critical temperature. The hot working temperature preferably does not exceed the incipient melting temperature, and may be within the homogenization temperature range. The method also may include applying an electric field to the alloy during homogenization and/or hot working to enhance solid state migration.

The alloy also may undergo thermal cycling to assist in the spheroidization or refinement of the Er-rich second phase. The thermal cycling may be carried out between temperatures above and below the critical temperature. For example, the alloy may be cycled between temperatures of ±50° C. with respect to the critical temperature (e.g., the incipient melting temperature). Alternatively, the alloy may be cycled between temperatures that are below the critical temperature. For example, in the case of Ni—Ti—Er alloys, the alloy may be heated to a temperature above 500° C. but below 925° C., cooled, and cycled back to a temperature in this range, as discussed further below. After the hot working step, the alloy may be cold worked to achieve at least a 30% reduction in dimension without cracking of the alloy.

According to a preferred embodiment, the nickel-titanium alloys of the present disclosure have an ultimate tensile strength of at least about 1350 MPa. As is generally known to those of skill in the art, the ultimate tensile strength (or tensile strength) of a material corresponds to the maximum engineering stress that can be sustained by the material in tension without fracture. Engineering stress is defined as $F/A_0$, where F represents tensile force and $A_0$ represents the original cross-sectional area of the specimen prior to application of the force. Tensile testing of the alloys is preferably carried out in accordance with American Society of Testing and Materials (ASTM) standards F2063, "Standard Specification for Wrought Nickel-Titanium Shape Memory Alloys for Medical Devices and Surgical Implants" and/or F2516 "Standard Test Method for Tension Testing of Nickel-Titanium Superelastic Materials," which are hereby incorporated by reference.

In the case of nickel-titanium alloys in which a two-way shape memory effect is desired, additional "training" at lower temperatures may be carried out to set a second shape.

EXAMPLE 1

Melting and Characterization of Selected Ni—Ti-RE Alloys

Ingots of several rare-earth doped nickel-titanium alloys were produced using vacuum induction melting (VIM). Specifically, Ni—Ti—Er, Ni—Ti—La, Ni—Ti—Gd, and Ni—Ti—Nd, each containing 7.5 at. % rare earth element, were melted. A Ni—Ti-7.5 at. % Pt ingot and a binary nickel-titanium alloy also were produced by VIM for comparison. The ingots of 2.25 inches in diameter and 3 inches in height were rolled to form plates. Each of the Ni—Ti—X plates showed some interdendritic cracking as a consequence of rolling, although the Er-doped nickel-titanium alloy seemed to withstand rolling the best. The rolled plates were soaked for 24 hours at 850° C. and then hot worked to a size of slightly greater than 1 inch (2.54 cm) in height. The composition of each specimen is given in weight percent in Table 13. The concentration of carbon, oxygen, and nitrogen impurities also is shown in parts per million (ppm).

TABLE 13

Composition Data for Ni—Ti and Ni—Ti—X (X = Er, La, Gd, Nd, or Pt) Specimens

| Sample | Carbon (ppm) | Oxygen (ppm) | Nitrogen (ppm) | Ni | Ti (wt. %) | RE or Pt (wt. %) |
|---|---|---|---|---|---|---|
| Ni—Ti—Er | 1320 | 236 | 60 | Balance | 32.04 | 20.12 |
| Ni—Ti—La | 760 | 307 | 8 | Balance | 33.17 | 17.30 |
| Ni—Ti—La | 33 | 2130 | 23 | Balance | 33.17 | 17.30 |
| Ni—Ti—Gd | 380 | 149 | 6 | Balance | 32.43 | 19.15 |
| Ni—Ti—Nd | 140 | 124 | 4 | Balance | 32.95 | 17.85 |
| Ni—Ti—Pt | 720 | 270 | 12 | Balance | 31.00 | 22.71 |
| Ni—Ti | 980 | 254 | 15 | Balance | Wash chemistry | — |

Prior to rolling, the surfaces of the as-cast specimens were polished to prepare the samples for conventional Brinell hardness tests. Such tests involve pressing a spherical indenter of a specified diameter under a known load into the surface of the specimen, and measuring the diameter (d) of the indentation after the test. A Brinell hardness number (BHN) may then be obtained by dividing the load used, in kilograms, by the actual surface area of the indentation, in square millimeters. Brinell hardness numbers obtained from hardness tests on polished, as-cast specimens are presented in Table 14 below. A steel ball of 1.68 mm in diameter was pushed into the surface of each specimen with a 30 kg force for a dwell time of 10 seconds. Four indentations were made for each sample, with two measurements of diameter ($d_1$, $d_2$) for each indentation. Higher average BHN numbers are obtained from specimens exhibiting greater resistance to plastic deformation (i.e., showing increased hardness), and lower average BHN numbers are obtained from softer specimens. As indicated in Table 14, the Ni—Ti-RE specimens exhibited lower hardnesses than did the binary Ni—Ti specimen. The Ni—Ti—Pt sample exhibited a higher hardness than did the binary Ni—Ti specimen.

TABLE 14

Brinell Hardness Data for As-Cast, Polished Specimens

| Alloy | $d_1$ | $d_2$ | BHN | Average BHN |
|---|---|---|---|---|
| Ni—Ti—Gd | 0.4096 | 0.4274 | 317.4 | 304 |
| | 0.437 | 0.4373 | 291 | |
| | 0.4266 | 0.4467 | 291 | |
| | 0.4153 | 0.4244 | 315 | |
| Ni—Ti—Nd | 0.4816 | 0.5093 | 226.5 | 247 |
| | 0.4531 | 0.4579 | 268.1 | |
| | 0.4614 | 0.4676 | 257.8 | |
| | 0.4919 | 0.4858 | 235.7 | |
| Ni—Ti—Pt | 0.3679 | 0.3522 | 429 | 460 |
| | 0.3735 | 0.3618 | 411.4 | |
| | 0.3447 | 0.3023 | 531.5 | |
| | 0.3535 | 0.3349 | 469.5 | |
| Ni—Ti—Er | 0.4266 | 0.4289 | 303.9 | 294 |
| | 0.4254 | 0.4207 | 311.5 | |
| | 0.4582 | 0.4466 | 271.8 | |
| | 0.4355 | 0.4405 | 289.9 | |
| Ni—Ti | 0.4395 | 0.4386 | 288.5 | 311 |
| | 0.4265 | 0.4315 | 302.2 | |
| | 0.4188 | 0.3953 | 335.6 | |
| | 0.4159 | 0.4203 | 318 | |

The microstructures of the hot worked specimens were investigated using a scanning electron microscope (SEM) equipped with an energy dispersive x-ray spectrometer (EDS). The SEM allowed regions of the alloys to be viewed at high magnifications and the EDS provided localized chemical information. Used together, the tools showed that the rare earth elements tended to segregate to the grain boundaries of the Ni—Ti-RE specimens. The alloy microstructure showed a dendritic form and included oxide and carbide precipitates. It is believed that compositional nonuniformity may inhibit shape memory phase transformations near human body temperature. Indeed, DSC experiments conducted by heating and cooling the specimens over temperatures ranging from −150° C. to 80° C. revealed no phase transformations. Accordingly, the inventors believe that a homogenization heat treatment at a temperature in excess of 850° C., or in the range of from about 700° C. to about 900° C. and for a longer time duration (e.g., 2-3 days) may be advantageous for improving the compositional homogeneity of the Ni—Ti-RE ingots and obtaining a suitable phase structure for shape memory behavior around body temperature.

Experiments to compare the x-ray contrast of two of the Ni—Ti-RE alloys and Ni—Ti—Pt with the x-ray contrast of a binary Nitinol alloy were conducted using a Picker Clinix RF fluoroscope and a phantom developed by the Center for Devices and Radiological Heath (CDRH) of the U.S. Food and Drug Administration (FDA). The phantom was used to simulate x-ray attenuation through the lower abdomen of a typical adult. In particular, the phantom was designed to represent the upper gastrointestinal tract of a 5' 8" adult weighing about 165 lbs with a posterior-anterior thickness of 23 cm. The dimensions of the phantom, which is composed primarily of polymethyl methacrylate (PMMA) and aluminum, are given in FIG. 20.

The three ternary nickel-titanium alloy specimens used in the radiopacity experiments included, respectively, 7.5 at. % Er, 7.5 at. % Gd, and 7.5 at. % Pt. The experiments were carried out using the CDRH phantom in fluoroscopic mode and static mode. The intensity of the radiation transmitted through each specimen and the background intensity were measured at various tube voltages. Values of x-ray contrast were obtained by subtracting the radiation transmitted through the specimen from the background intensity at each voltage. The x-ray contrast values were then normalized by the x-ray contrast obtained for the binary Ni—Ti sample to obtain relative x-ray contrast values for each specimen, as shown in Tables 15 and 16.

Figure 21:
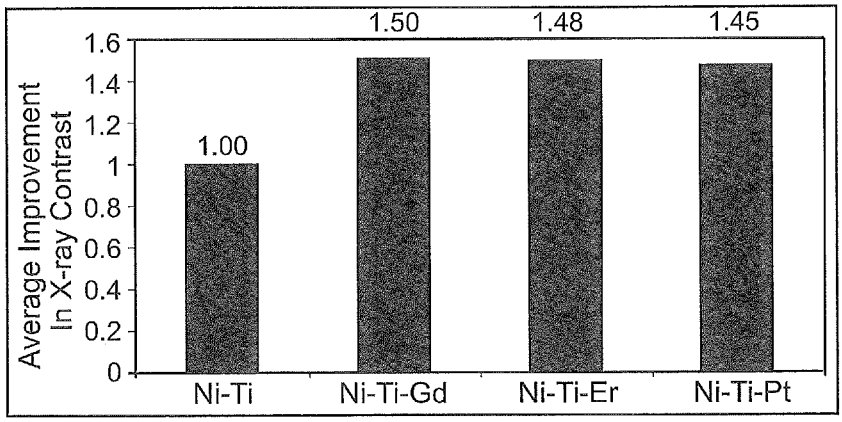
FIG. 21 is a bar graph showing the average improvement in x-ray contrast for Ni—Ti—X specimens (X=Gd, Er or Pt) relative to binary Ni—Ti as determined using the CDRH phantom at various tube voltages in fluoroscopic mode.

As indicated by the x-ray contrast data, each ternary alloy showed an improvement in radiopacity relative to the binary Nitinol alloy. Table 15 shows the relative x-ray contrast values of the alloys as determined using the CDRH phantom at various voltages in fluoroscopic mode, and FIG. 21 shows the average value of relative x-ray contrast for each alloy over the range of voltages used. Overall, the Ni—Ti—Gd alloy exhibited the highest x-ray contrast, with an average relative x-ray contrast of 1.50 for the voltage range of 40-110 kV. The Ni—Ti—Er alloy showed an average relative x-ray contrast of 1.48 for the same voltage range, while the Ni—Ti—Pt alloy exhibited an average relative x-ray contrast of 1.45.

TABLE 15

Values of Relative X-Ray Contrast (Fluoroscopic Mode)

| Specimen | | 40 kV | 50 kV | 60 kV | 70 kV | 80 kV | 90 kV | 100 kV | 110 kV | Avg. |
|---|---|---|---|---|---|---|---|---|---|---|
| Ni—Ti | x-ray contrast | 293 | 301 | 372 | 370 | 300 | 370 | 295 | 333 | 329.3 |
| | relative value | 1.00 | 1.00 | 1.00 | 1.00 | 1.00 | 1.00 | 1.00 | 1.00 | 1.00 |
| Ni—Ti—Gd | x-ray contrast | 532 | 464 | 477 | 495 | 492 | 484 | 490 | 525 | 494.9 |
| | relative value | 1.82 | 1.54 | 1.28 | 1.34 | 1.64 | 1.31 | 1.66 | 1.58 | 1.50 |
| Ni—Ti—Er | x-ray contrast | 546 | 492 | 488 | 488 | 377 | 523 | 500 | 490 | 488.0 |
| | relative value | 1.86 | 1.63 | 1.31 | 1.32 | 1.26 | 1.41 | 1.69 | 1.47 | 1.48 |
| Ni—Ti—Pt | x-ray contrast | 482 | 435 | 480 | 560 | 499 | 453 | 490 | 422 | 477.6 |
| | relative value | 1.64 | 1.45 | 1.29 | 1.51 | 1.66 | 1.22 | 1.66 | 1.27 | 1.45 |

Figure 22:
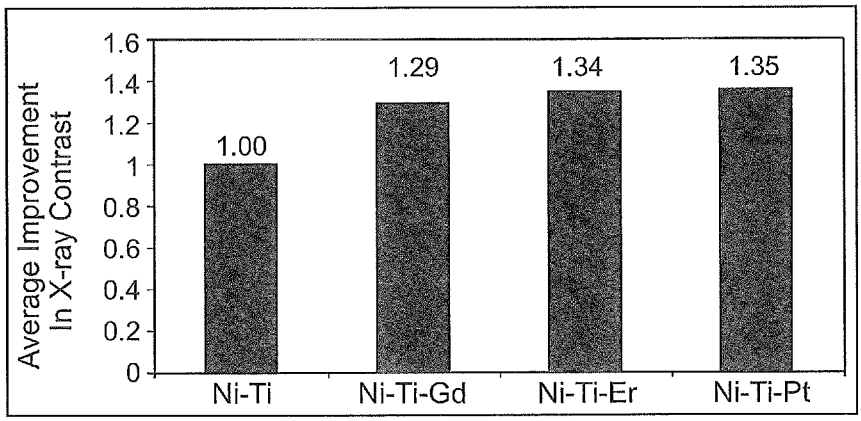
FIG. 22 is a bar graph showing the average improvement in x-ray contrast for Ni—Ti—X specimens (X=Gd, Er or Pt) relative to binary Ni—Ti as determined using the CDRH phantom at various tube voltages in static mode.
Figure 23A:
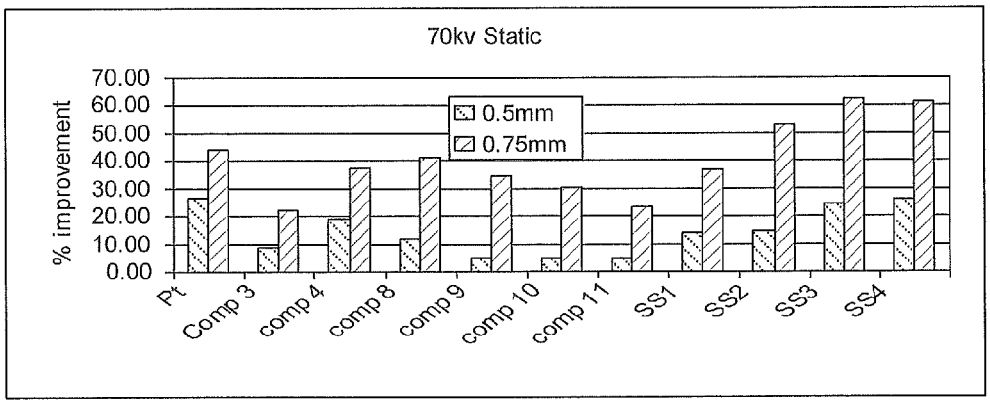
FIGS. 23A-23F are bar graphs showing the improvement in radiopacity of various Ni—Ti—X alloys over binary Ni—Ti, where the data were obtained at different tube voltages.
Figure 23B:
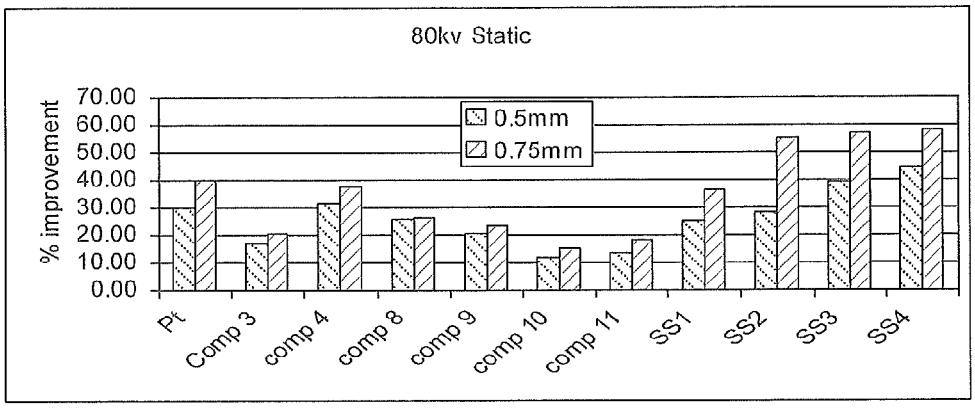
Figure 23C:
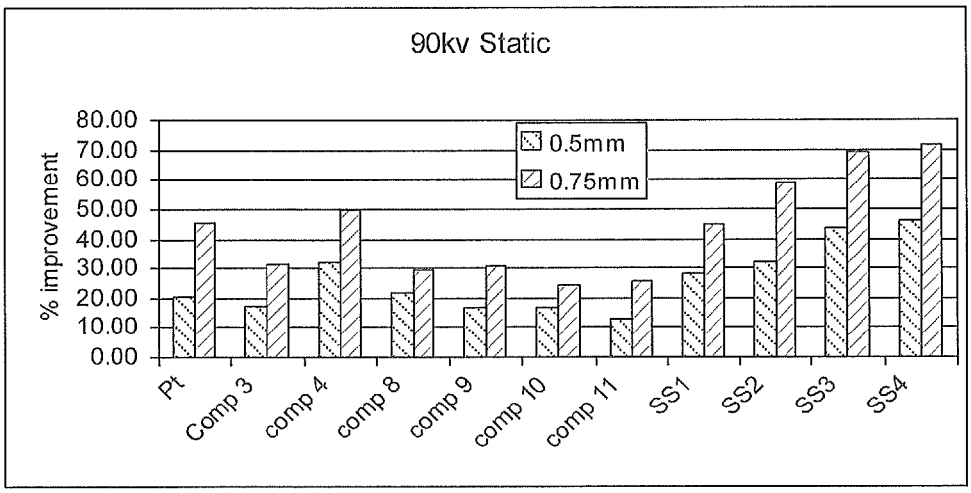
Figure 23D:
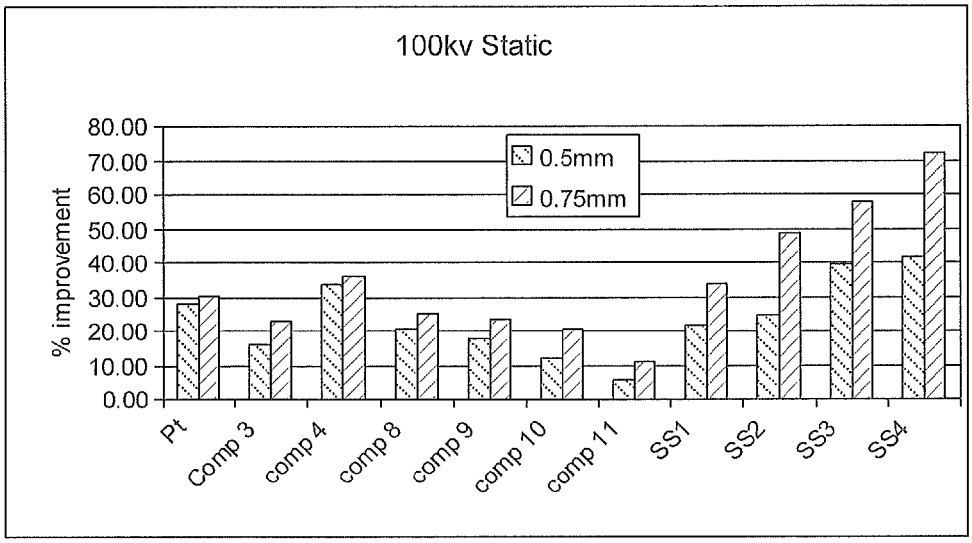
Figure 23E:
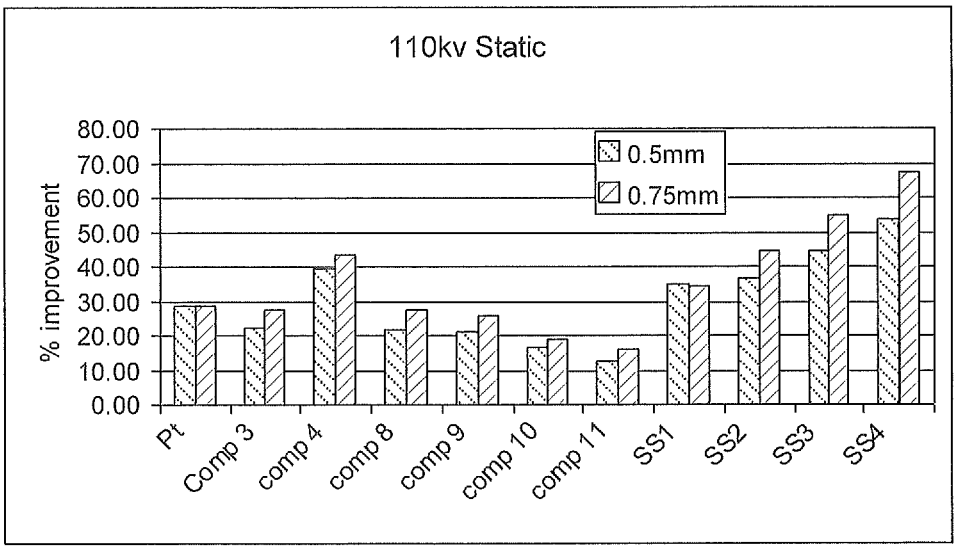
Figure 23F:
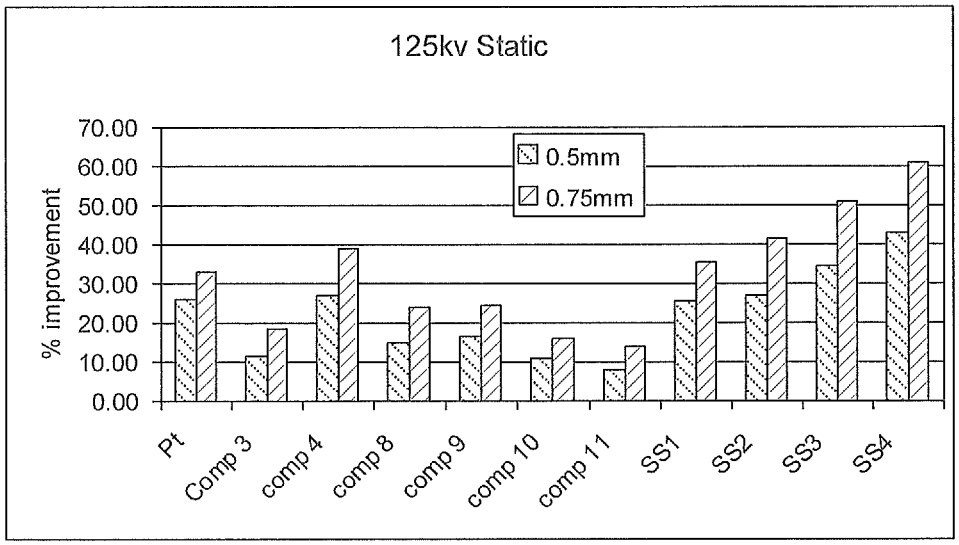

Table 16 shows the relative x-ray contrast values of the alloys as determined using the CDRH phantom at several voltages in static mode, and FIG. 22 shows the average value of relative x-ray contrast for each alloy over the range of voltages used. Overall, the Ni—Ti—Pt alloy exhibited the highest x-ray contrast under these conditions, with an average relative x-ray contrast of 1.35 for the voltage range of 60-100 kV. The Ni—Ti—Er alloy showed an average relative x-ray contrast of 1.34 for the same voltage range, while the Ni—Ti—Gd alloy exhibited an average x-ray contrast of 1.29.

TABLE 16

Values of Relative X-Ray Contrast (Static Mode)

| Specimen | | 60 kV | 70 kV | 80 kV | 90 kV | 100 kV | Avg. |
|---|---|---|---|---|---|---|---|
| Ni—Ti | x-ray contrast | 540 | 490 | 437 | 399 | 380 | 449.2 |
| | relative value | 1.00 | 1.00 | 1.00 | 1.00 | 1.00 | 1.00 |
| Ni—Ti—Gd | x-ray contrast | 605 | 610 | 572 | 572 | 540 | 579.8 |
| | relative value | 1.12 | 1.24 | 1.31 | 1.43 | 1.42 | 1.29 |

TABLE 16-continued

| Values of Relative X-Ray Contrast (Static Mode) | | | | | | | |
|---|---|---|---|---|---|---|---|
| Specimen | | 60 kV | 70 kV | 80 kV | 90 kV | 100 kV | Avg. |
| Ni—Ti—Er | x-ray contrast | 555 | 620 | 600 | 651 | 583 | 601.8 |
| | relative value | 1.03 | 1.27 | 1.37 | 1.63 | 1.53 | 1.34 |
| Ni—Ti—Pt | x-ray contrast | 644 | 662 | 570 | 580 | 571 | 605.4 |
| | relative value | 1.19 | 1.35 | 1.30 | 1.45 | 1.50 | 1.35 |

Preferably, the x-ray contrast of a Ni—Ti-RE alloy is in the range of from greater than 1 to about 2 times that of a near-equiatomic binary nickel-titanium alloy when the alloys are exposed to radiation having an energy in the range of from 40 keV to 110 keV. More preferably, the x-ray contrast of the Ni—Ti-RE alloy is in the range of from about 1.2 to about 1.9 times that of the near-equiatomic binary nickel-titanium alloy when the alloys are exposed to radiation having an energy in the range of from 40 keV to 110 keV.

Twelve additional alloys having the compositions given in Table 17 below are being melted. After melting and casting, the alloys may undergo a homogenization heat treatment at 1000° C. for 72 hours. The homogenized alloys may then be mechanically worked into specimens as described above.

TABLE 17

| Composition Data for Ni—Ti—Er and Ni—Ti—Er—X (X = Pd or Cr) Specimens | | | | | |
|---|---|---|---|---|---|
| | Ni (at. %) | Ti (at. %) | Er (at. %) | Pd (at. %) | Cr (at. %) |
| Series A | 51 | 45 | 4 | | |
| | 51 | 44 | 4 | 1 | |
| | 51 | 44 | 4 | | 1 |
| Series B | 52.5 | 43.5 | 4 | | |
| | 52.5 | 42.5 | 4 | 1 | |
| | 52.5 | 42.5 | 4 | | 1 |
| Series C | 55 | 41 | 4 | | |
| | 55 | 40 | 4 | 1 | |
| | 55 | 40 | 4 | | 1 |
| Series D | 47 | 49 | 4 | | |
| | 45 | 51 | 4 | | |
| | 43 | 53 | 4 | | |

EXAMPLE 2

Homogenization Heat Treatments

Rare-earth (RE) rich intermetallic phases are prone to interdendritic segregation and the consequent formation of an interdendritic cellular network. During mechanical working of the alloy, the presence of this cellular network may lead to interdendritic cracking and failure.

Figure 24A:
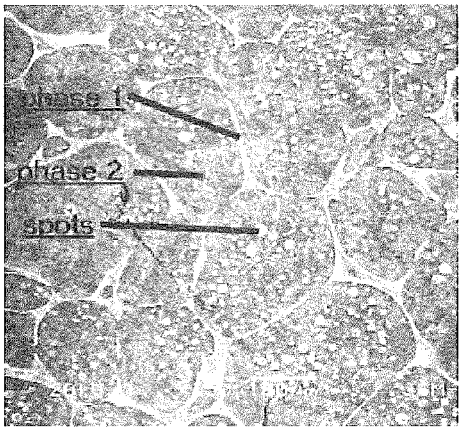
FIG. 24A shows the as-cast structure for NiTi-4.5 at. % Er.
Figure 24B:
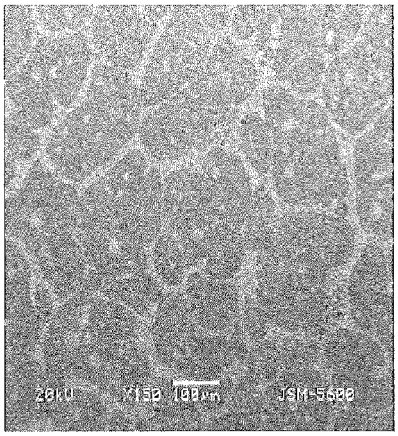
FIG. 24B shows the structure of a NiTi-7.5 at. % Er alloy after a homogenization treatment at 925° C.
Figure 24C:
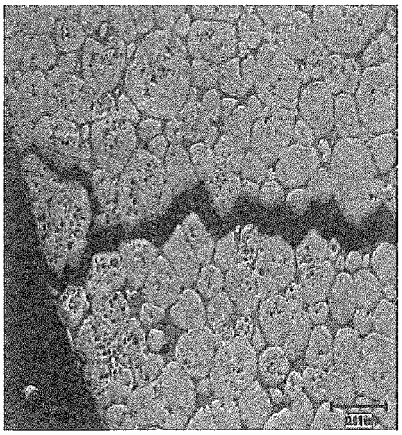
FIG. 24C shows a NiTi-4.5 at. % Er alloy after homogenization at 1000° C. for seven days, followed by mechanical working.

FIG. 24A shows interdendritic segregation of an Er-rich second phase in the as-cast structure of a NiTi-4.5 at. % Er alloy. A similar network forms in NiTi-7.5 at. % Er ingots and persists even after a homogenization treatment at 925° C., as shown in FIG. 24B. Interdendritic segregation of this second phase makes RE-doped Ni—Ti alloys prone to interdendritic failure during mechanical working, such as cold rolling. FIG. 24C shows a fractured sample of NiTi-4.5 at. % Er that was homogenized at 1000° C. for 7 days.

Figure 24D:
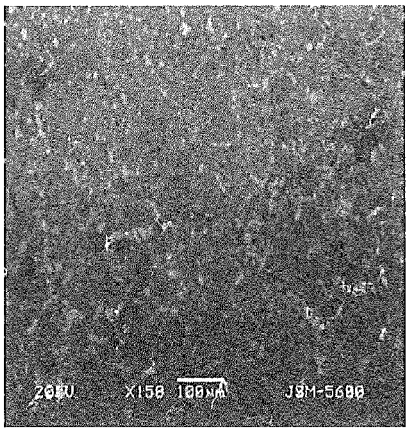
FIG. 24D shows a Ni—Ti—Er alloy homogenized at 900° C. for three days.

To solve this problem, the inventors have identified suitable heat treatment parameters to break down and/or avoid formation of the cellular interdendritic network of rare earth-rich second phase. The heat treatment process creates spherical and nearly spherical precipitates of RE-Ni and RE-$Ni_2$ compositions, as shown in FIG. 24D, which is a micrograph of a NiTi-4.5 at. % Er alloy that was homogenized at 900° C. for 3 days. The inventors believe that Ni—Ti-RE alloys homogenized as described here may be able to withstand conventional hot and cold working procedures with intermittent heat treatments.

Figure 25A:
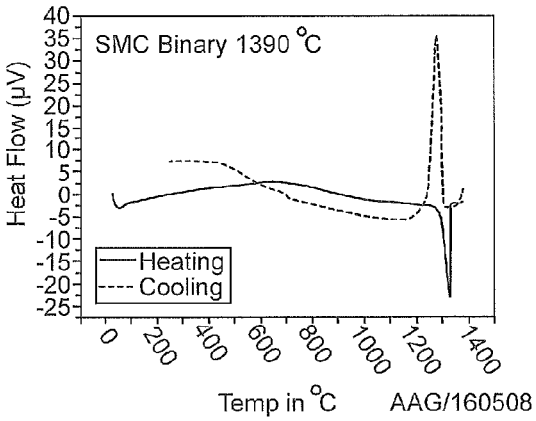
FIGS. 25A-25F show the DSC/DTA response of: (A) a binary NiTi alloy heated to 1390° C.; (B) incipient melting of NiEr phases in a NiTi-7.5 at. % Er alloy heated to 1390° C.; (C) incipient melting of NiEr phases when the NiTi-7.5 at. % Er alloy is homogenized at 925° C. for 24 hours and subsequently solidified; (D) a NiTi-7.5 at. % Er alloy homogenized at 900° C. for 72 hours to avoid incipient melting; (E) same as (D) but homogenized at 875° C. for 24 hours and (F) 825° C. for 24 hours.
Figure 25B:
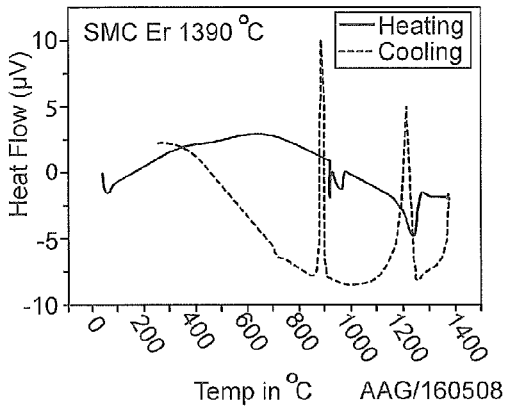
Figure 25C:
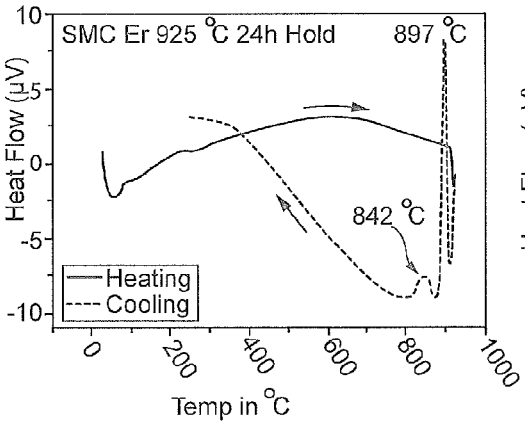
Figure 25D:
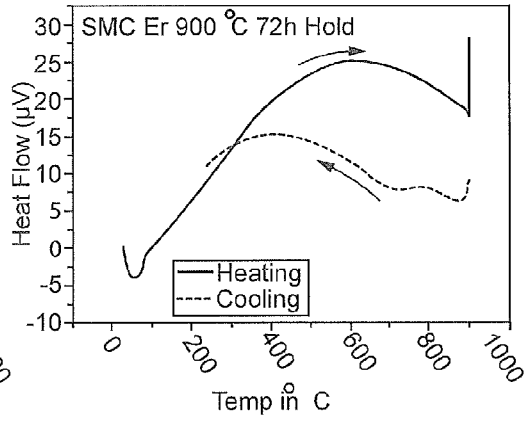
Figure 25E:
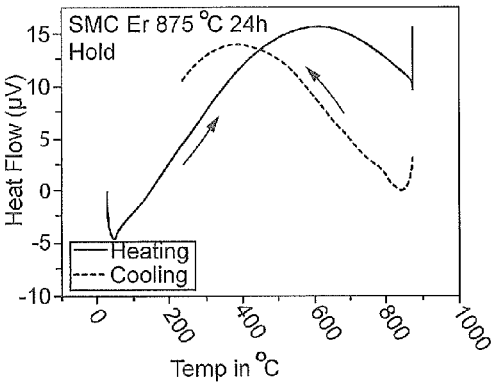
Figure 25F:
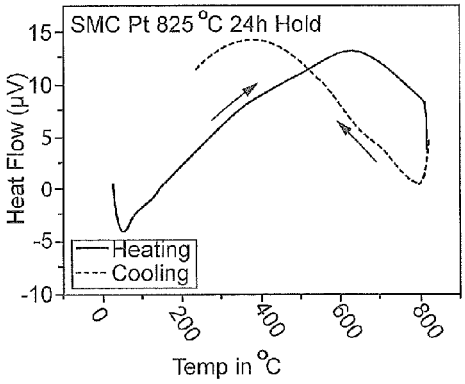
Figure 26:
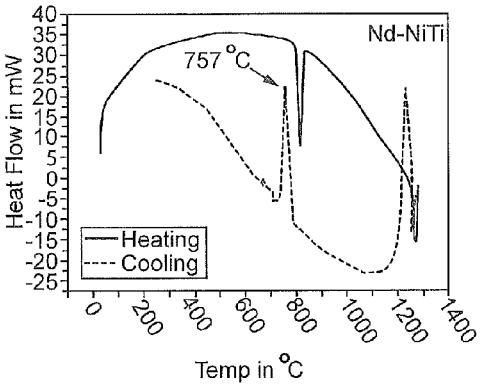
FIG. 26 shows the DSC/DTA response of a Ni—Ti—Nd alloy.
Figure 27:
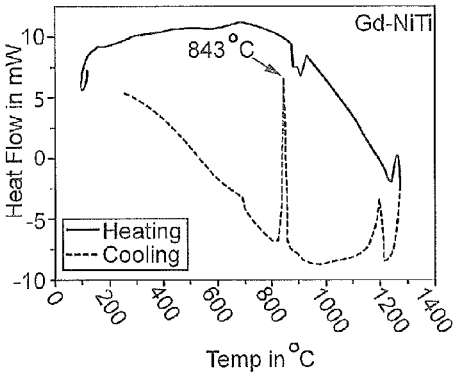
FIG. 27 shows the DSC/DTA response of a Ni—Ti—Gd alloy.

Homogenization of Ni—Ti—Er alloys at temperatures at or above 925° C. is associated with incipient melting of Er-rich second phases, as has been observed by DSC/DTA technique. Incipient melting in a NiTi-7.5% Er alloy in the vicinity of 925° C. is shown in FIG. 25C. Slow cooling through this temperature results in the solidification of Er-rich phases, which, during solidification, re-wet the surfaces of the interdendritic regions. Accordingly, the cellular network may reform and nullify the intended effect of the homogenization heat treatment.

FIGS. 25A-25F show the DSC/DTA response of: (A) a binary NiTi alloy heated to 1390° C.; (B) incipient melting of NiEr phases in a NiTi-7.5 at. % Er alloy heated to 1390° C.; (C) incipient melting of NiEr phases when the NiTi-7.5 at. % Er alloy is homogenized at 925° C. for 24 hours and subsequently solidified; (D) a NiTi-7.5 at. % Er alloy homogenized at 900° C. for 72 hours to avoid incipient melting; (E) same as (D) but homogenized at 875° C. for 24 hours and (F) 825° C. for 24 hours.

The inventors have discovered that homogenization at temperatures below 925° C. may avoid incipient melting in Ni—Ti—Er alloys. The lower the homogenization temperature from this incipient melting temperature, the lower is the risk of re-forming the cellular network.

The inventors believe that maintaining the homogenization temperature below a critical temperature allows solid state diffusion and migration of Ni atoms to occur so as to promote spheroidization. In the case of Ni—Ti—Er alloys, the critical temperature has been found to be 925° C. The inventors believe that homogenization at a temperature in the range of about 750° C. to about 875° C. may be advantageous for Ni—Ti—Er alloys, based on the heat treatment experiments described below. These experiments have also demonstrated that from about 24 hours to about 72 hours is a suitable time duration for the spheroidization.

Homogenization heat treatment experiments were carried out on specimens of 50Ni-42.5Ti-7.5Er (at. %) of 1 cm×1.5 cm×1.5 cm in size. The specimens were heat treated in a nitrogen atmosphere in a horizontal tube furnace for at least 24 hours. A heating rate of 20° C./min was employed, and the specimens were furnace cooled. FIGS. 28A to 28H show (A) the as-cast alloy microstructure and the microstructures after (B) heat treatment at 925° C. for one day; (C) heat treatment at 900° C. for one day; (D) heat treatment at 900° C. for three days; (E) heat treatment at 875° C. for one day (center); (F) heat treatment at 875° C. for one day (edge); (G) heat treatment at 825° C. for one day (center); and (H) heat treatment at 825° C. for one day (edge).

Figure 28A:
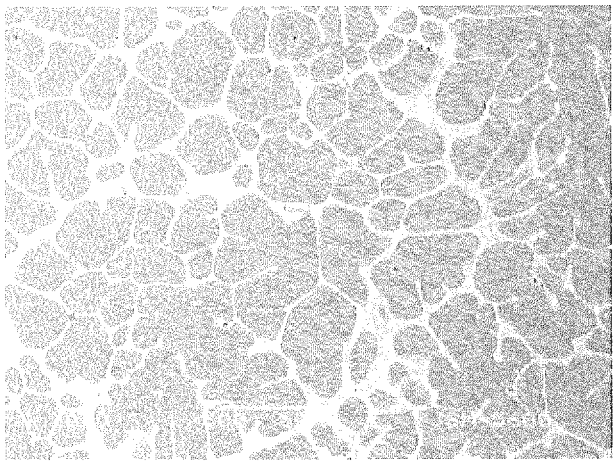
FIGS. 28A to 28H show (A) the as-cast microstructure of a Ni—Ti-7.5 at. % Er alloy and the microstructure of the alloy after (B) heat treatment at 925° C. for one day; (C) heat treatment at 900° C. for one day; (D) heat treatment at 900° C. for three days; (E) heat treatment at 875° C. for one day (center); (F) heat treatment at 875° C. for one day (edge); (G) heat treatment at 825° C. for one day (center); and (H) heat treatment at 825° C. for one day (edge)
Figure 28B:
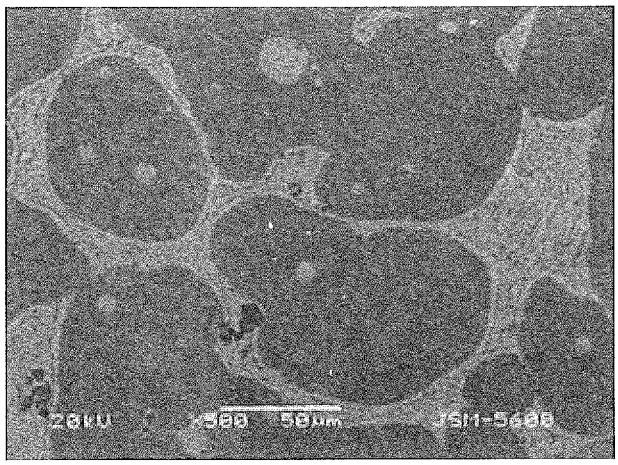
Figure 28C:
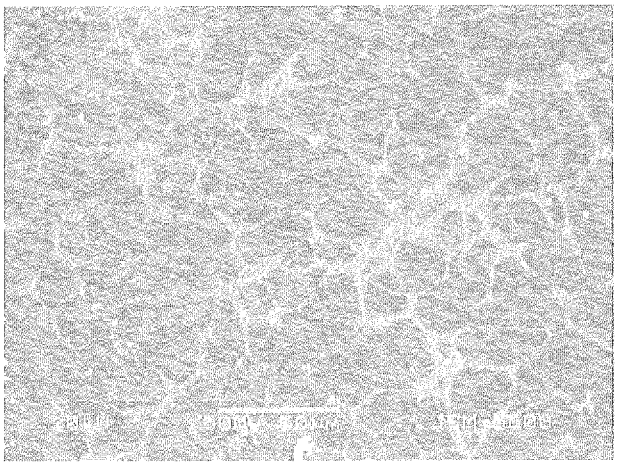
Figure 28D:
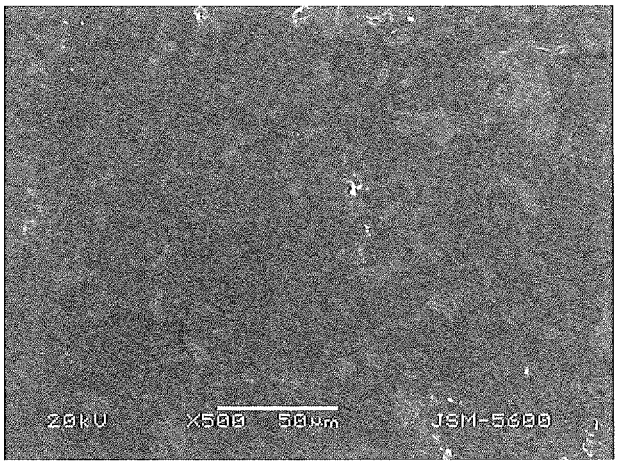
Figure 28E:
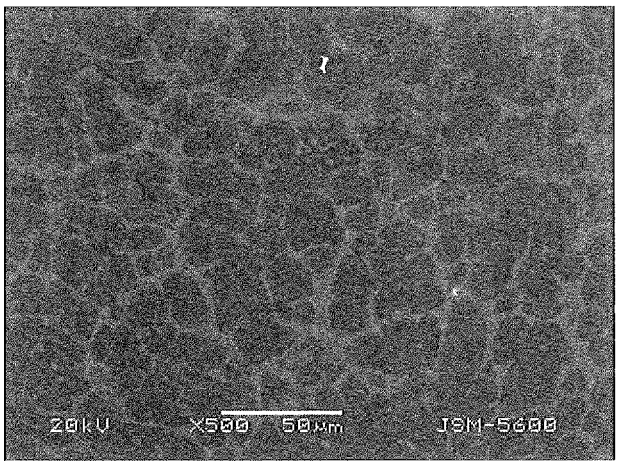
Figure 28F:
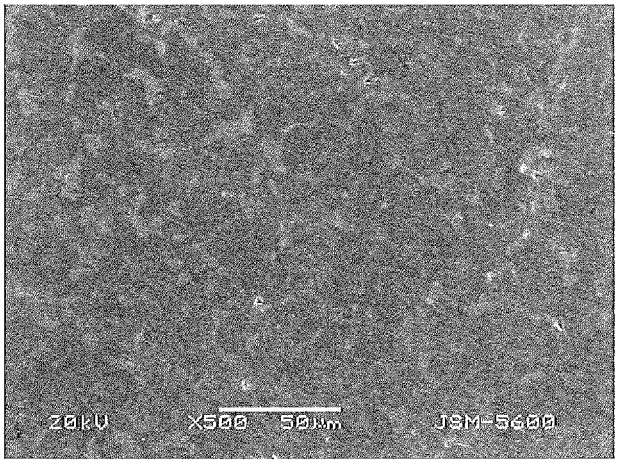
Figure 28G:
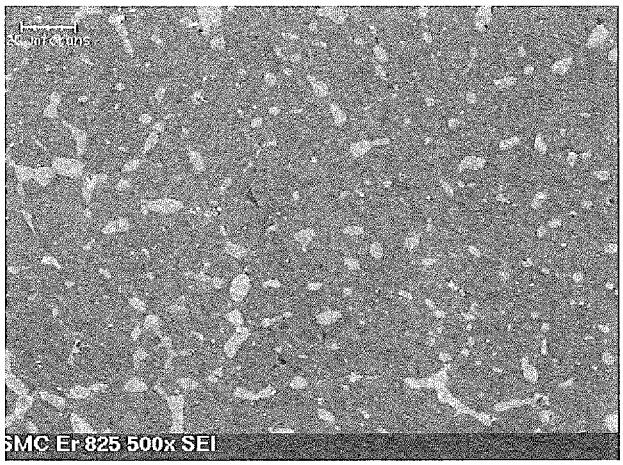
Figure 28H:
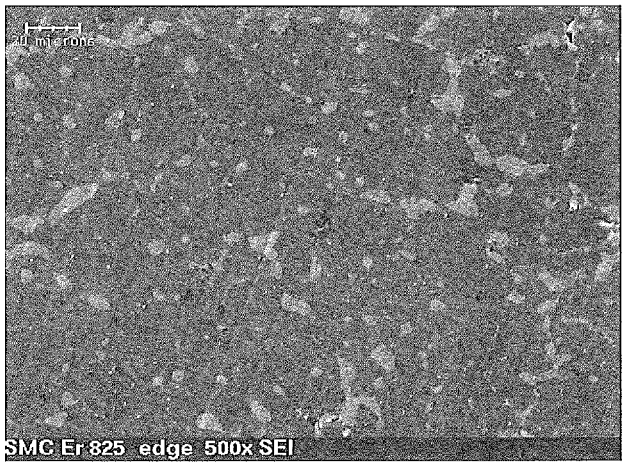
Figure 28I:
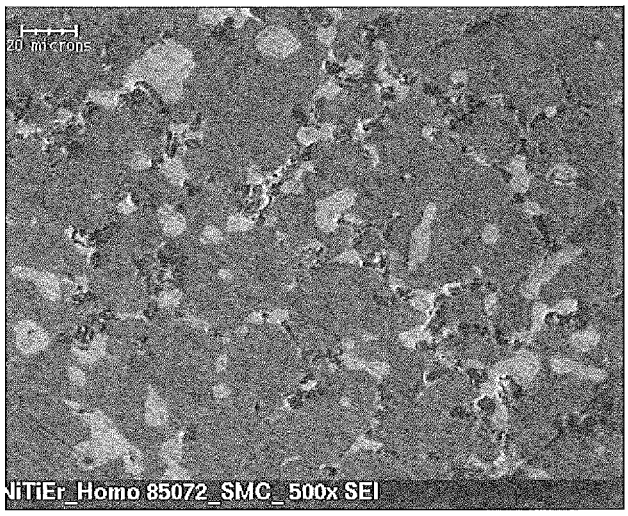
FIGS. 28I and 28J show the microstructure of a Ni—Ti-7.5 at. % Er alloy obtained after heat treating for 3 days at 850° C. (I) and after 1 day at 825° C. (J)
Figure 28J:
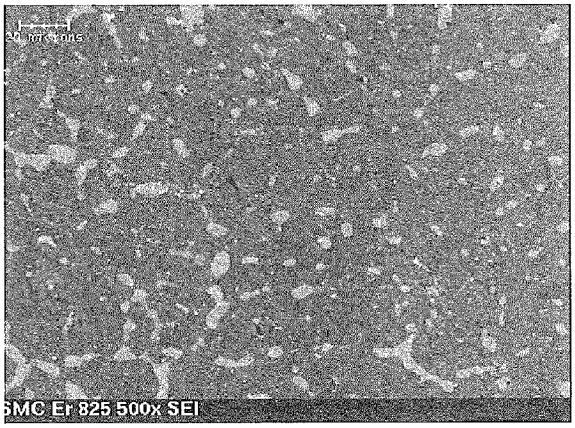

It can be seen that the second phase agglomerates at high temperatures (e.g., 925° C.), while at temperatures of about 900° C. and below there is evidence of a broken network after only one day of heat treatment. It also appears that at lower temperatures (e.g., 825° C. and 875° C.), the broken Er second phase network structure develops in a shorter time. FIGS. 28I and 28J, respectively, show that the microstructure obtained after heat treating for 3 days at 850° C. is similar to that obtained after 1 day at 825° C.

Thermal cycling experiments were conducted to study the effect of cycling the homogenized Ni—Ti-7.5 at. % Er specimens between 0° C. and 500° C. in air. A specimen that was homogenized at 825° C. for one day was ramped up to 500° C. at a rate of 50° C./min, held at 500° C. for four hours, and then furnace cooled as fast as possible. The specimen was cycled three times. Micrographs of the specimen structure suggest that thermal cycling to 500° C. has little or no effect on the second phase network distribution. After thermal cycling the specimen to 800° C. twice, inclusions in the specimen seemed to be limited to about 10 microns in size, whereas prior to thermal cycling to 800° C., the specimen had inclusions of up to about 20 microns in size. Repeated cycling of the alloy at temperatures below 925° C. but above 500° C. can assist in further spheroidization; however, the hardness of the alloy may increase.

Refinement of the RE-rich phases in the form of fine precipitates may be achieved by heating the alloy to a temperature beyond the incipient melting zone (e.g., 925° C. in the case of Ni—Ti—Er) so that the alloy reaches the liquid/solid (conventionally known as the L+S) region of the quasi-binary equilibrium system of NiTi, NiEr and/or $Ni_2Er$. The alloy may be held at that temperature for a predetermined time followed by rapid cooling in air, water, brine or oil. This treatment can be repeated several times to achieve finer precipitates. For example, the alloy may be thermally cycled about the critical temperature (incipient melting temperature) to enhance the refinement of the RE-rich phases. It may be advantageous to carry out the thermal cycling between temperatures of about ±50° C. with respect to the critical temperature (e.g., incipient melting temperature of second phase). For example, in the case of Ni—Ti—Er alloys, the thermal cycling may be conducted between about 875° C. and about 975° C. This process may promote diffusion of erbium back into the NiTi matrix as well as enhance the precipitation of finer (Ni,Er) particles. The thermal cycling also may be effectively carried out at temperatures of about ±25° C. with respect to the critical temperature, or about ±75° C. with respect to the critical temperature.

Mechanical working during or subsequent to the homogenization/solution treatment may cause the incompressible broken pieces of RE-rich phases to coagulate, thereby increasing the notch sensitivity of the alloy and making further working, in particular, cold working impractical. A quick repeat heating cycle of between about 750° C. and about 850° C. in the case of Ni—Ti—Er alloys may cause enough micromovement in (Ni,Er)-rich phases that they will spread again, thus making further working possible.

The effect of rapidly cooling (quenching) the specimen following the homogenization heat treatment was also investigated. As cast specimens were heat treated at 900° C. in nitrogen for one day and then quenched in water (water quenched). While the quench may have assisted in breaking down the Er phase network, embrittlement of the (Ni,Er) phase also occurred.

Solid state diffusion to promote spheroidization may be enhanced by the application of pressure while keeping the ingot at an elevated temperature that may be within the homogenization temperature range. Such pressure can be applied by the means of conventional hot working methods (e.g. rolling, extrusion, swaging, or forging). This approach may substantially reduce the holding time at the homogenization temperature. Hot forging of a homogenized alloy at 800° C. resulted in an alloy including a fine Er network with no apparent large agglomerates. Preferably, the Ni—Ti-RE alloy is maintained at a temperature below the critical temperature for any hot working operations.

Further enhancement of solid state migration can be achieved by the application of an electric field during the application of pressure to cause a flow of the broken masses of RE-rich phase(s) in the direction of the applied field. The electric field can be used as a means of heating the alloy to the required temperatures, as is done with spark plasma sintering, for example. The rate of directional migration may be such that the surface energy is unfavorable for spheroidization; however, the alloy treated as described above may still be amenable to further working due to the broken nature of the RE-rich network.

Care is needed to avoid over migration where the RE-rich phase(s) migrate macroscopically, perhaps towards the edge of the ingot. Such a macroscopic out-migration may counteract the beneficial effect of the broken network, due to the accumulation of RE-rich phases at the outer surface of the ingot; if this occurs, the interior of the ingot may be severely depleted of the rare earth element and the radiopacity of the alloy may be diminished.

The addition of Er has minimal effect on the magnetic susceptibility, which in turn defines the MRI compatibility. Heat treatment has a more significant effect on the susceptibility; however, the susceptibility of the homogenized Ni—Ti—Er alloys remains better than 316L stainless steel.

EXAMPLE 3

Boron Additions to Ni—Ti-RE Alloys

To investigate the influence of boron additions on the behavior of Ni—Ti-RE alloys, in particular, Ni—Ti—Er alloys, buttons of the following compositions were melted with and without boron and evaluated for workability.

TABLE 18

Ni—Ti—Er—B Alloys Tested

| Alloy | Ni (at. %) | Er (at. %) | B (ppm) | Ti (at. %) |
|---|---|---|---|---|
| Comp. 1 | 50 | 1.5 | 35 | Balance |
| Comp. 2 | 50 | 3 | 35 | Balance |
| Comp. 3 | 50 | 4.5 | 35 | Balance |
| Comp. 4 | 50 | 6 | 35 | Balance |

Figure 29:
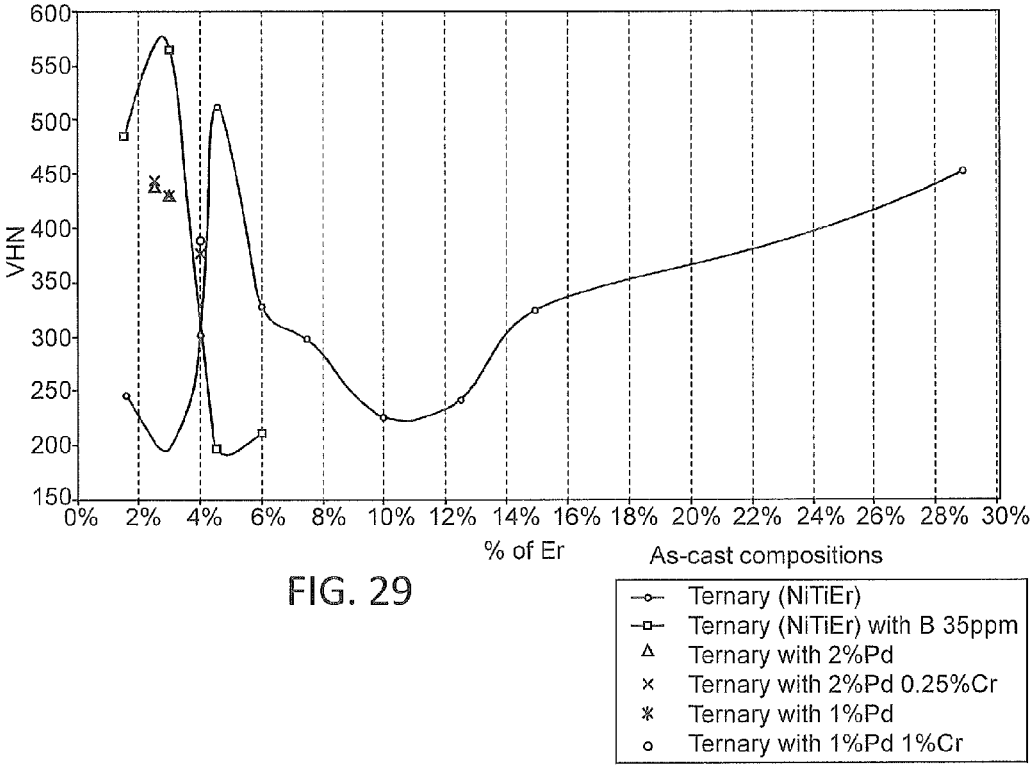
FIGS. 29 and 30 show hardness data for various Ni—Ti—Er alloys as a function of Er, Pd, Cr and B additions for (FIG. 29) as-cast alloys and for (FIG. 30) alloys homogenized at 850° C. for three days.
Figure 30:
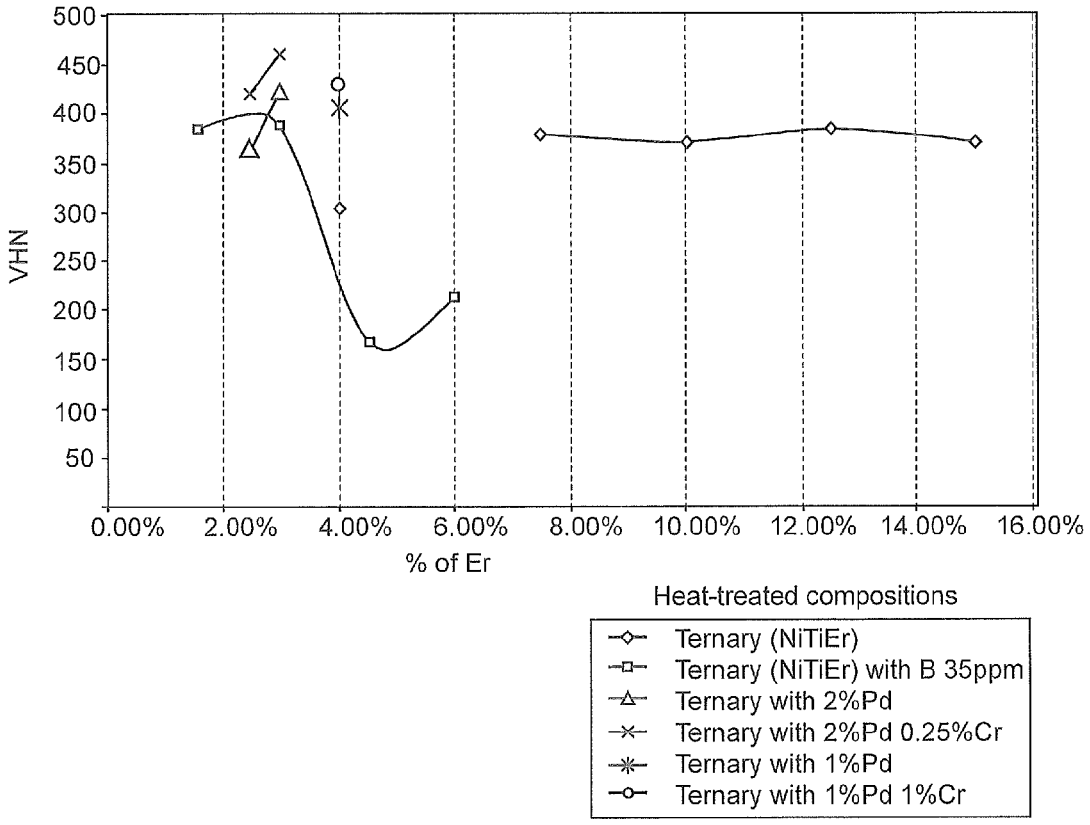
Figure 31:
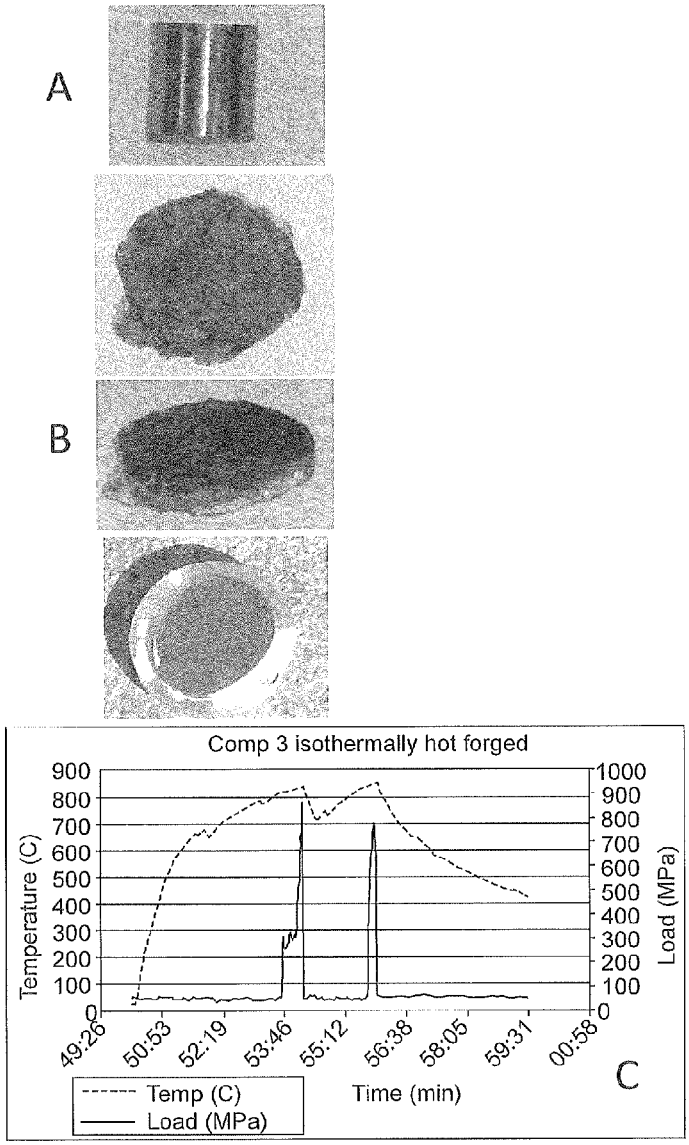
FIGS. 31A-31C show data from hot forging of a Ni—Ti-4.5 at. % Er-35 ppm B alloy, which underwent a reduction from 10 mm down to 2.5 mm after preheating to 850° C.
Figure 32:
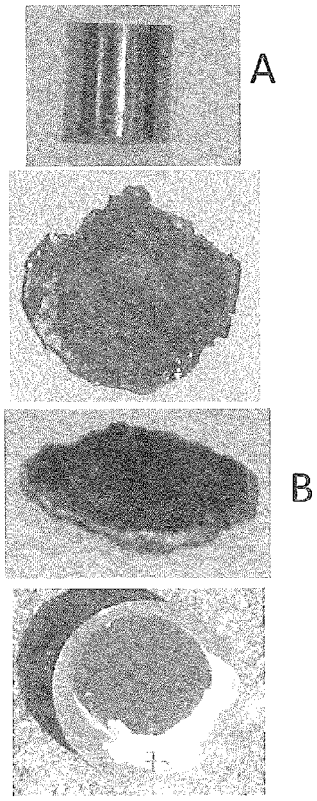
FIGS. 32A-32C show data from hot forging of the Ni—Ti-6 at. % Er-35 ppm B alloy, which underwent a reduction from 10 mm down to 2.5 mm after preheating to 850° C.
Figure 32:
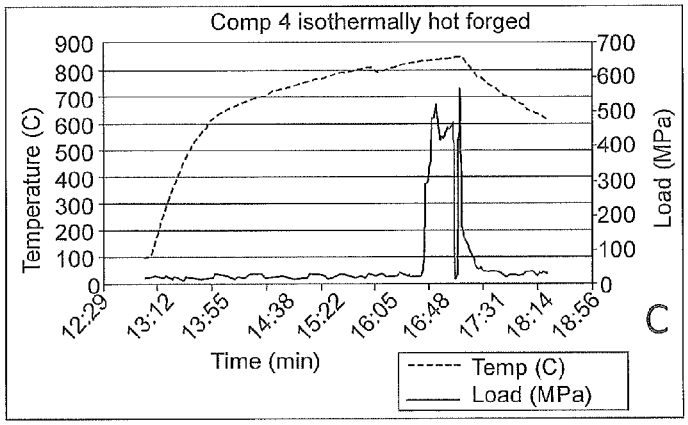

Addition of the boron resulted in a lowered Vicker's hardness number in as-cast and homogenized rare earth-doped Nitinol as compared to binary and non-boron rare earth-doped Nitinol alloys. For example, after homogenization, composition 3 exhibited a Vicker's hardness of 166 as compared to the Vicker's hardness of 230 or greater for binary Nitinol. Hardness data for various Ni—Ti—Er alloys as a function of Er, Pd, Cr and B additions are shown in FIGS. 29 and 30, respectively, for as-cast alloys and for alloys homogenized at 850° C. for three days. Hot forging of 10 mm diameter billets of the composition 3 and 4 alloys from 10 mm in height down to 2.5 mm in height (75% reduction or 1:4 area increase) after preheating to 850° C. occurred without cracking using two hammer type forging strikes, as indicated in FIGS. 31A-31B and 32A-32B, respectively. The composition 3 alloy was further successfully cold rolled to about a 30% reduction in cross section without cracking.

A nickel-titanium-rare earth (Ni—Ti-RE) alloy that exhibits enhanced radiopacity compared to binary Ni—Ti and improved ductility over previous Ni—Ti-RE alloys has been described. Boron may be added to Ni—Ti-RE alloys to enhance the ductility, and the rare earth element is preferably erbium. A method of making a Ni—Ti-RE alloy with improved workability and radiopacity has also been described. The Ni—Ti-RE alloy preferably exhibits superelastic or shape memory behavior, and may be employed for medical devices and other applications, such as actuators and sealing plugs.

Although the present invention has been described in considerable detail with reference to certain embodiments thereof, other embodiments are possible without departing from the present invention. The spirit and scope of the appended claims should not be limited, therefore, to the description of the preferred embodiments contained herein. All embodiments that come within the meaning of the claims, either literally or by equivalence, are intended to be embraced therein.

Furthermore, the advantages described above are not necessarily the only advantages of the invention, and it is not necessarily expected that all of the described advantages will be achieved with every embodiment of the invention.

The nickel-titanium-rare earth alloy may comprise: nickel at a concentration of from about 35 at. % to about 65 at. %; a rare earth element at a concentration of from about 1.5 at. % to about 15 at. %; boron at a concentration of up to about 0.1 at. %; the balance being titanium, the nickel-titanium-rare earth alloy may have a concentration of rare earth element from about 3 at. % to about 7.5 at. %. The rare earth element may be selected from the group consisting of: La, Pr, Nd, Pm, Sm, Eu, Gd, Tb, Dy, Ho, Er, Tm, Yb, and Lu. In particular the rare earth element may be Er.

The concentration of the rare earth element may be from about 1.5 at. % to about 12 at. %. The alloy may have a concentration of rare earth element from about 4.5 at. % to about 6 at. %. The nickel-titanium-rare earth alloy may have a concentration of boron from about 0.005 at. % to about 0.1 at. %, or about 0.01 at. % to about 0.05 at. %. Said alloy may have a concentration of boron of about 35 ppm. The concentration of nickel may be from about 45 at. % to about 55 at. %.

The alloy may be superelastic at body temperature. The alloy may have an $A_f$ temperature of about 35° C. or less. The alloy may have an $A_f$ temperature of about 10° C. or less.

The alloy may comprise:

nickel at a concentration of from about 45 at. % to about 55 at. %;

erbium at a concentration of from about 4.5 at. % to about 6 at. %;

boron at a concentration of from about 0.005 at. % to about 0.1 at. %.;

the balance being titanium, wherein the alloy has a radiopacity greater than that of a binary nickel-titanium alloy.

A method of processing a nickel-titanium-rare earth alloy may comprise:

providing a nickel-titanium-rare earth alloy comprising nickel at a concentration of from about 40 at. % to about 60 at. %, a rare earth element at a concentration of from about 1.5 at. % to about 12 at. %, the balance being titanium;

heating the nickel-titanium-rare earth alloy in a homogenization temperature range below a critical temperature; and forming spheroids of a rare earth-rich second phase in the nickeltitanium-rare earth alloy while in the homogenization temperature range.

The critical temperature may be an incipient melting temperature of the rare earth-rich second phase.

The critical temperature may be about 925° C. The homogenization temperature range may be from about 750° C. to about 875° C. Forming the spheroids may include keeping the nickel-titanium-rare earth alloy in the homogenization temperature range over a time duration of from about 24 h to about 72 h.

The method may further comprise thermal cycling the nickel-titanium-rare earth alloy. The thermal cycling may occur after the spheroids are formed. The thermal cycling may comprise cycling the nickel-titanium-rare earth alloy between temperatures above and below the critical temperature. The temperatures may be no more than about 50° C. away from the critical temperature. The thermal cycling may comprise cycling the alloy between temperatures below the critical temperature. At least one of the temperatures may be in the homogenization temperature range.

The method may further comprise hot working the alloy. Hot working may comprise applying pressure to the alloy during the heating. Hot working may comprise applying pressure to the alloy after the heating, the pressure being applied at an elevated temperature below the critical temperature. The elevated temperature may within the homogenization temperature range.

The method may further comprise applying an electric field to the alloy. The electric field may be applied during hot working. The method may further comprise water quenching the alloy after the heating. The method may further comprise furnace cooling the alloy after the heating. The method may further comprise cold working the alloy to achieve at least a 30% reduction in dimension without cracking of the alloy.

The rare earth element may be selected from the group consisting of: La, Pr, Nd, Pm, Sm, Eu, Gd, Tb, Dy, Ho, Er, Tm, Yb, and Lu. In particular the rare earth element may be erbium. The concentration of the rare earth element may be from about 3 at. % to about 7.5 at. %. The alloy may further comprise boron at a concentration of up to about 0.1 at. %.

The alloy may comprise nickel at a concentration of from about 45 at. % to about 55 at. %; erbium at a concentration of from about 4.5 at. % to about 6 at. %; boron at a concentration of from about 0.005 at. % to about 0.1 at. %.; the balance being titanium, wherein the alloy has a radiopacity greater than that of a binary nickel-titanium alloy.

What is claimed is:

1. A nickel-titanium-rare earth alloy comprising:

nickel at a concentration of from about 34 at. % to about 65 at. %;

at least one rare earth element at a concentration of from about 0.1 at. % to about 15 at. %;

boron at a concentration from about 0.001 at. % to about 0.1 at. %; and titanium at a concentration of from about 34 at. % to about 60 at. %.

2. The alloy of claim 1, wherein the at least one rare earth element is selected from the group consisting of: La, Pr, Nd, Pm, Sm, Eu, Gd, Tb, Dy, Ho, Er, Tm, Yb, and Lu.

3. The alloy of claim 2, wherein the rare earth element is Er.

4. The alloy of claim 1, wherein the concentration of the at least one rare earth element is from about 1.5 at. % to about 12 at. %.

5. The alloy of claim 1, wherein the concentration of boron is from about 0.005 at. % to about 0.1 at. %.

6. The alloy of claim 1, wherein the concentration of nickel is from about 45 at. % to about 55 at. %.

7. The alloy of claim 1 being superelastic at body temperature.

8. The alloy of claim 1 having an $A_f$ temperature of about 35° C. or less.

9. The alloy of claim 1, further comprising iron at a concentration of up to about 3 at.%.

10. The alloy of claim 9, wherein the iron is present at concentration of up to about 1 at.%.

11. The alloy of claim 10, wherein the iron is present at a concentration of from about 0.1 at.% to about 1 at.%.

12. The alloy of claim 1, comprising:

nickel at a concentration of from about 45 at. % to about 55 at. %;

erbium at a concentration of from about 4.5 at. % to about 6 at. %;

boron at a concentration of from about 0.005 at. % to about 0.1 at. %.;

titanium at a concentration of from about 34 at. % to about 60 at. % wherein the alloy has a radiopacity greater than that of a binary nickel-titanium alloy.

13. The alloy of claim 12, further comprising iron at a concentration of up to about 3 at.%.

14. The alloy of claim 13, wherein the iron is present at concentration of up to about 1 at.%.

15. The alloy of claim 14, wherein the iron is present at a concentration of from about 0.1 at.% to about 1 at.%.

* * * * *